US008380109B2

(12) United States Patent
Kurimoto et al.

(10) Patent No.: US 8,380,109 B2
(45) **Date of Patent: *Feb. 19, 2013**

(54) IMAGE FORMING APPARATUS AND PROCESS CARTRIDGE

(75) Inventors: Eiji Kurimoto, Numazu (JP); Keisuke Shimoyama, Numazu (JP); Tomoyuki Shimada, Shizuoka-ken (JP); Masafumi Ohta, Susono (JP); Yuuji Tanaka, Fujinomiya (JP)

(73) Assignee: Ricoh Company, Ltd., Tokyo (JP)

( * ) Notice: Subject to any disclaimer, the term of this patent is extended or adjusted under 35 U.S.C. 154(b) by 762 days.

This patent is subject to a terminal disclaimer.

(21) Appl. No.: 12/319,652

(22) Filed: Jan. 9, 2009

(65) Prior Publication Data

US 2009/0180804 A1 Jul. 16, 2009

(30) Foreign Application Priority Data

Jan. 11, 2008 (JP) ..... 2008-003897
Jan. 17, 2008 (JP) ..... 2008-007489
Sep. 19, 2008 (JP) ..... 2008-240762
Sep. 19, 2008 (JP) ..... 2008-240769

(51) Int. Cl.
*G03G 15/00* (2006.01)
*G03G 5/06* (2006.01)

(52) U.S. Cl. .... 399/159; 430/58.5; 430/58.8; 430/58.85

(58) Field of Classification Search ..... 430/58.5, 430/58.85, 58.8; 399/159
See application file for complete search history.

(56) References Cited

U.S. PATENT DOCUMENTS 1,935,945 A * 11/1933 Eckert et al. ..... 546/41
4,992,349 A * 2/1991 Chen et al. ..... 430/58.5
5,567,560 A * 10/1996 Hagiwara et al. ..... 430/58.85
6,027,846 A 2/2000 Shimada et al.
6,174,638 B1 * 1/2001 Ishigami et al. ..... 430/78
6,316,577 B1 11/2001 Shimada et al.
6,432,596 B2 8/2002 Ikuno et al.
6,548,216 B2 4/2003 Kawamura et al.
6,861,188 B2 3/2005 Ikegami et al.
6,974,654 B2 12/2005 Kawamura et al.
7,056,633 B2 6/2006 Kawamura et al.
7,112,392 B2 9/2006 Shimada et al.
7,122,284 B2 10/2006 Kawamura et al.
7,186,490 B1 3/2007 Niimi et al.
7,267,916 B2 9/2007 Sugino et al.
7,314,693 B2 1/2008 Ikegami et al.
7,341,810 B2 3/2008 Kurimoto et al.
7,381,511 B2 6/2008 Ikegami et al.
7,432,029 B2 * 10/2008 Kim et al. ..... 430/60
7,763,727 B2 * 7/2010 Fujiyama et al. ..... 546/66
7,919,220 B2 * 4/2011 Shimoyama et al. ..... 430/78
2007/0059618 A1 3/2007 Kurimoto et al.
2007/0231720 A1 10/2007 Mori et al.
2007/0248901 A1 10/2007 Shimoyama et al.
2007/0264047 A1 11/2007 Kurimoto et al.
2007/0269729 A1 11/2007 Ikuno et al.

(Continued)

FOREIGN PATENT DOCUMENTS

EP 31065 A2 * 7/1981
EP 1340755 A1 * 9/2003

(Continued)

OTHER PUBLICATIONS

English language machine translation of JP 2005-320288 (Nov. 2005).*

(Continued)

*Primary Examiner* — Christopher Rodee
(74) *Attorney, Agent, or Firm* — Cooper & Dunham LLP

(57) ABSTRACT

An image forming apparatus including at least an image bearing member having a substrate having a photosensitive layer thereon, the image bearing member to bear a latent electrostatic image on a surface thereof, a charging device to the surface of the image bearing member, an irradiation device to irradiate the surface of the image bearing member with light to form a latent electrostatic image thereon, a development device to develop the latent electrostatic with toner to obtain a developed image, a transfer device to transfer the developed image to a recording medium, and a cleaning device to clean the surface of the image bearing member, wherein the photosensitive layer includes naphthalene tetracarbonic acid diimide derivative as a charge transport material represented by the following Chemical Structure (1):

Chemical Structure (1)

In the Chemical Structure (1), Z represents a group represented by the following Chemical Formula (1):

Chemical Formula (1)

or the following Chemical Formula (2):

$-R^9$ Chemical Formula (2).

In the Chemical Structure (1), and the Chemical Formulae (1) and (2), $R^1$, $R^2$, $R^3$, $R^4$ and $R^9$ each, independently, represent a substituted or non-substituted alkyl group or a substituted or non-substituted aromatic hydrocarbon group, $R^5$, $R^6$, $R^7$ and $R^8$ each, independently, represent hydrogen atom, a substituted or non-substituted alkyl group, or a substituted or non-substituted aromatic hydrocarbon group, and $R^1$ and $R^2$ and $R^3$ and $R^4$ optionally share a bond connectivity to form a substituted or non-substituted heterocyclic group including a nitrogen atom.

12 Claims, 7 Drawing Sheets

U.S. PATENT DOCUMENTS

| | | | | |
|---|---|---|---|---|
| 2008/0063962 | A1 | 3/2008 | Toshine et al. | |
| 2008/0096117 | A1 | 4/2008 | Tanaka | |
| 2008/0102391 | A1 | 5/2008 | Yanagawa et al. | |
| 2008/0113286 | A1 | 5/2008 | Shimoyama et al. | |
| 2008/0298840 | A1 * | 12/2008 | Shimada | 399/159 |
| 2008/0305426 | A1 | 12/2008 | Kurimoto et al. | |
| 2009/0068577 | A1 * | 3/2009 | Ohta et al. | 430/58.15 |

FOREIGN PATENT DOCUMENTS

| | | | |
|---|---|---|---|
| JP | 06-130688 | | 5/1994 |
| JP | 3471163 | | 9/2003 |
| JP | 2005320288 | A * | 11/2005 |
| JP | 2006028027 | A * | 2/2006 |
| JP | 2006045165 | A * | 2/2006 |

OTHER PUBLICATIONS

English language machine translation of JP 2006-045165 (Feb. 2006).*

Diamond, Arthur S & David Weiss (eds.) Handbook of Imaging Materials, 2nd ed.. New York: Marcel-Dekker, Inc. (Nov. 2001) pp. 145-168.*

* cited by examiner

IMAGE FORMING APPARATUS AND PROCESS CARTRIDGE

BACKGROUND OF THE INVENTION

1. Field of the Invention

The present invention relates to an image forming apparatus and a process cartridge.

2. Discussion of the Background

A full color image forming apparatus generally employs one of the two typical systems.

One is referred to as a single or single-drum system in which one image bearing member is installed with four color development devices. In this system, a four color (cyan, magenta, yellow and black) toner image is formed on the image bearing member and transferred to a transfer medium directly or via an intermediate transfer body. Devices or members arranged around the image bearing member, which are, for example, a charging member, an irradiation device, a transfer device, a cleaning device and a fixing device, can be shared in the process of producing each color toner image. Therefore, this system can be small-sized and manufactured at a small cost in comparison with a tandem system described below.

The other is referred to as a tandem or tandem drum system, in which multiple image bearing members are provided. Typically, respective members or devices for charging, irradiation, development and cleaning are arranged around one drum (image bearing member) to form one electrophotographic element. A multiple number (typically four) of such electrophotographic elements are provided in an image forming apparatus. In this system, each electrophotographic element forms each corresponding single color toner image, which is sequentially transferred to a transfer medium to form a full color toner image.

The first advantage of this tandem system is high speed image formation since each color toner image is formed in parallel as described above. Therefore, the time to be taken for image formation in the tandem drum system is about a fourth in comparison with that in the single drum system so that the tandem drum system can form a full color toner image four times as fast as the single drum system. The second advantage is that each member or device including an image bearing member provided in one electrophotographic element has a substantially high durability. This is because one image bearing member in the single drum system is subject to the processes of charging, irradiation and development four times in total to form a full color toner image while each image bearing member in the tandem drum system is subject to each process only once.

However, the tandem drum system is large in size and expensive at cost. The image bearing member and each member or device arranged around the image bearing member have been reduced in size to deal with the size problem. This size reduction leads to saving material, which has a small but steady impact on the cost reduction in terms of the entire system. Also, this effect accompanies a new problem, which is about improvement of the sensitivity and stability of the image bearing member.

Generally, the chargeability and the sensitivity of an image bearing member easily deteriorate and the voltage at irradiated portion thereof tends to rise during repetitive use of the image bearing member. For example, as technologies to deal with the rise in the residual voltage of an image bearing member, unexamined published Japanese patent application No. (hereinafter referred to as JOP) H06-130688 and Japanese patent No. 3471163 describe a technology of containing a disphenoquinone based compound having a particular structure and a technology of containing a naphthoquinone derivative having a particular structure, respectively, together with a positive hole transport material in a photosensitive layer.

As described above, the main objective, which is also the main advantage, of this tandem drum system in which multiple electrophotographic elements are arranged in a full color image forming apparatus is high speed performance.

To take advantage of this feature, image formation processes should be performed at a high speed, which requires the improvement on responsiveness and stability of the photosensitivity of an image bearing member. That is, upon irradiation on the surface of a charged image bearing member, the image bearing member needs to optically attenuate quickly and maintain this optical attenuation characteristic during repetitive use.

Depending on the color ratio in produced images, only a particular color, e.g., black color, is repeatedly used. This especially occurs in the case of a full color image forming apparatus having a tandem drum system. This leads to a problem of usage bias (uneven frequency of usage) among the image bearing members in the full color image forming apparatus. This easily leads to deterioration of the optical attenuation property of an image bearing member relatively heavily used in comparison with the other image bearing members and results in variance in color tone of a full color image which is formed by overlapping colors during repetitive use.

In addition, oxidized gas produced by a charging device chemically affects the photosensitivity of an image bearing member, which leads to deterioration of the photosensitivity and production of abnormal images having defects such as deterioration of definition and image flow.

As described above, when the characteristics of an image bearing member are unstable over repetitive use and the image bearing member has been used for a long period of time, an image forming apparatus using the image bearing member produces images having a problem with the quality, resulting in variation in color tone or back ground fouling.

In addition, the inventors of the present invention describe a highly durable image forming apparatus having multiple electrophotographic elements each of which has a latent electrostatic image bearing member including a charge transport material having a particular imide structure, a latent electrostatic image formation device, a development device, a transfer device, etc. and an image formation method using the image forming apparatus in JOP 2007-264589 as a technology to stably produce full color images at a high speed during repetitive use.

SUMMARY OF THE INVENTION

Because of these reasons, the present inventors recognize that a need exists for an image forming apparatus having image bearing members having and maintaining a highly responsive optical attenuation property during repetitive use for an extended period of time in spite of usage bias (uneven frequency of usage) among the image bearing members and in addition having a high environment durability against oxidized gas while producing quality images free from change in color tone, background fouling, deterioration in definition, image flow, etc.

Accordingly, an object of the present invention is to provide an image forming apparatus having image bearing members having and maintaining a highly responsive optical attenuation property during repetitive use for an extended period of time in spite of usage bias (uneven frequency of usage) among the image bearing members and in addition having a high environment durability against oxidized gas while producing quality images free from change in color tone, background fouling, deterioration in definition, image flow, etc. Another objective of the present invention is to reduce the cost of the image forming apparatus.

Briefly these objects and other objects of the present invention as hereinafter described will become more readily apparent and can be attained, either individually or in combination thereof, by an image forming apparatus including at least an image bearing member which includes a substrate having a photosensitive layer thereon and bears a latent electrostatic image on the surface thereof, a charging device to the surface of the image bearing member, an irradiation device to irradiate the surface of the image bearing member with light to form a latent electrostatic image thereon, a development device configured to develop the latent electrostatic with toner to obtain a developed image, a transfer device to transfer the developed image to a recording medium, and a cleaning device to clean the surface of the image bearing member. In the image forming apparatus, the photosensitive layer includes naphthalene tetracarbonic acid diimide derivative as a charge transport material represented by the following Chemical Structure (1).

Chemical Structure (1)

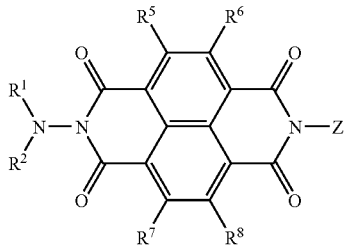

In the Chemical Structure (1), Z represents a group represented by the following Chemical Formula (1):

Chemical Formula (1)

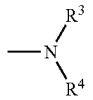

or the following Chemical Formula (2):

$$-R^9$$ Chemical Formula (2).

In the Chemical Structure (1) and the Chemical Formulae (1) and (2), $R^1$, $R^2$, $R^3$, $R^4$ and $R^9$ each, independently, represent a substituted or non-substituted alkyl group or a substituted or non-substituted aromatic hydrocarbon group, $R^5$, $R^6$, $R^7$ and $R^8$ each, independently, represent hydrogen atom, a substituted or non-substituted alkyl group, or a substituted or non-substituted aromatic hydrocarbon group, and $R^1$ and $R^2$ and $R^3$ and $R^4$ optionally share a bond connectivity to form a substituted or non-substituted heterocyclic group including a nitrogen atom.

It is preferred that, in the image forming apparatus mentioned above, the photosensitive layer further includes a charge transport material different from the naphthalene tetracarbonic acid diimide derivative.

It is still further preferred that, in the image forming apparatus mentioned above, the charge transport material different from the naphthalene tetracarbonic acid diimide derivative is a derivative represented by the following Chemical Structure (2):

Chemical Structure (2)

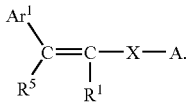

In the Chemical Structure (2), X represents a single bond or vinylene group, $R^1$ represents hydrogen atom, a substituted or non-substituted alkyl group or a substituted or non-substituted aromatic hydrocarbon group, $Ar^1$ represents a substituted or non-substituted aromatic hydrocarbon group, $R^5$ represents hydrocarbon atom, a substituted or non-substituted alkyl group or a substituted or non-substituted aromatic hydrocarbon group, $Ar^1$ and $R^5$ optionally share a bond connectivity to form a ring, A represents 9-anthryl group, a substituted or non-substituted carbazolyl group, or a group represented by the following Chemical Structure (3) or the following Chemical Structure (4), Chemical Structure (3)

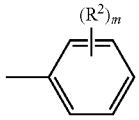

Chemical Structure (4)

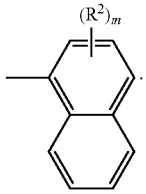

In the Chemical Structures (3) and (4), $R^2$ represents hydrogen atom, an alkyl group, an alkoxy group, or a group represented by the following Chemical Structure (5), Chemical Formula (5)

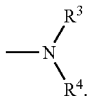

In the Chemical Structure (5), where $R^3$ and $R^4$ each, independently, represent hydrogen atom, a substituted or non-substituted alkyl group or a substituted or non-substituted aromatic hydrocarbon group and optionally share a bond connectivity to form a heterocyclic group including a nitrogen atom, m represents an integer of from 1 to 3 and when m is 2 or 3, each of $R^2$ is independently determined.

It is still further preferred that, in the image forming apparatus mentioned above, the charge transport material different from the naphthalene tetracarbonic acid diimide derivative is a derivative represented by the following Chemical Structure (6):

Chemical Structure (6)

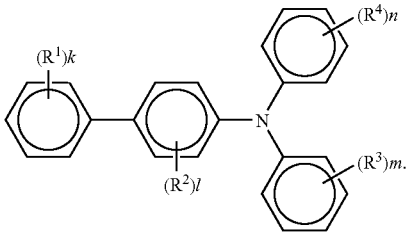

In the Chemical Structure (6), $R^1$, $R^3$, $R^4$ each, independently, hydrogen atom, amino group, an alkoxy group, a thioalkoxy group, an aryloxy group, methylene dioxy group, a substituted or non-substituted alkyl group, a halogen atom or a substituted or non-substituted aromatic hydrocarbon group, $R^2$ represents hydrogen atom, an alkoxy group, a substituted or non-substituted alkyl group, or a halogen atom, k, l, m and n each, independently, represent an integer of from 1 to 4 and when k, l, m and n each, independently, represent 2, 3 or 4, each of respective $R^1$, $R^2$, $R^3$ and $R^4$ is independently determined.

It is still further preferred that, in the image forming apparatus mentioned above, the charge transport material different from the naphthalene tetracarbonic acid diimide derivative is a derivative represented by a following Chemical Structure (7):

Chemical Structure (7)

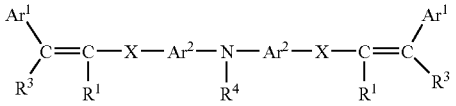

In the Chemical Structure (7), X represents a single bond or vinylene group, $R^1$ represents hydrogen atom, a substituted or non-substituted alkyl group, or a substituted or non-substituted aromatic hydrocarbon group, $Ar^1$ represents a substituted or non-substituted aromatic hydrocarbon group, $R^3$ represents hydrogen atom, a substituted or non-substituted alkyl group, or a substituted or non-substituted aromatic hydrocarbon group, $Ar^1$ and $R^3$ optionally share a bond connectivity to form a ring and $Ar^2$ represents a group represented by the following Chemical Structure (8):

Chemical Structure (8)

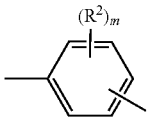

or the following Chemical Structure (9):

Chemical Structure (9)

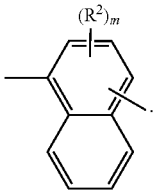

In the Chemical Structures (8) and (9), $R^2$ represents hydrogen atom, an alkyl group, an alkoxy group, or a halogen atom, m represents an integer of from 1 to 3, when m is 2 or 3, each of $R^2$ is independently determined and $R^4$ represents a substituted or non-substituted alkyl group or a substituted or non-substituted aromatic hydrocarbon group.

It is still further preferred that, in the image forming apparatus mentioned above, the charge transport material different from the naphthalene tetracarbonic acid diimide derivative is a derivative represented by a following Chemical Structure (10):

Chemical Structure (10)

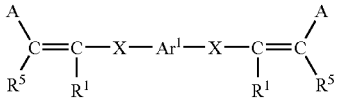

where X represents a single bond or vinylene group, $R^1$ represents hydrogen atom, a substituted or non-substituted alkyl group or a substituted or non-substituted aromatic hydrocarbon group, $Ar^1$ represents a substituted or non-substituted aromatic hydrocarbon group, $R^5$ represents hydrocarbon atom, a substituted or non-substituted alkyl group or a substituted or non-substituted aromatic hydrocarbon group, A represents 9-anthryl group, a substituted or non-substituted carbazolyl group, or a group represented by a following Chemical Structure (3) or a following Chemical Structure (4), Chemical Structure (3)

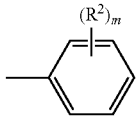

Chemical Structure (4)

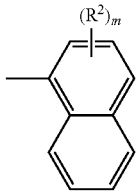

where $R^2$ represents hydrogen atom, an alkyl group, an alkoxy group, a halogen atom or a group represented by a following Chemical Structure (5), Chemical Structure (5)

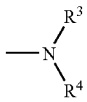

where $R^3$ and $R^4$ each, independently, represent hydrogen atom, a substituted or non-substituted alkyl group or a substituted or non-substituted aromatic hydrocarbon group and optionally share a bond connectivity to form a heterocyclic group including a nitrogen atom, m represents an integer of from 1 to 3 and when m is 2 or 3, each of $R^2$ is independently determined.

It is still further preferred that, in the image forming apparatus mentioned above, the photosensitive layer has a larinate structure including a charge generation layer containing a charge generation material and a charge transport layer containing the naphthalene tetracarbonic acid diimide derivative.

It is still further preferred that, in the image forming apparatus mentioned above, the charge transport layer further includes a charge transport material different from the naphthalene tetracarbonic acid diimide derivative and represented by the following Chemical Structure (2), Chemical Structure (2)

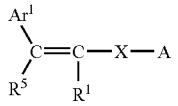

and the total weight of the binder resin is greater than the total weight of the naphthalene tetracarbonic acid diimide derivative and the optional charge transport material.

It is still further preferred that, in the image-forming apparatus mentioned above, the photosensitive layer has a single layer structure including a charge generation material and the naphthalene tetracarbonic acid diimide derivative.

It is still further preferred that, in the image forming apparatus mentioned above, the photosensitive layer further includes a charge transport material different from the naphthalene tetracarbonic acid diimide derivative optionally and a binder resin, and the total weight of the binder resin is greater than the total weight of the naphthalene tetracarbonic acid diimide derivative and the optional charge transport material.

It is still further preferred that, in the image forming apparatus mentioned above, the transfer device includes an intermediate transfer device to which the developed images are primarily and sequentially transferred to form a color image and the color image is secondarily transferred to the recording medium at one time.

As another aspect of the present invention, a process cartridge is provided which includes an image bearing member which includes a substrate having a photosensitive layer thereon and bears a latent electrostatic image on the surface thereof and at least one device selected from the group consisting of a charging device configured to the surface of the image bearing member, a development device to develop the latent electrostatic with toner to obtain a developed image, a cleaning device to clean the surface of the image bearing member and a discharging device configured to discharge the surface of the image bearing member. The photosensitive layer contains naphthalene tetracarbonic acid diimide derivative as a charge transport material represented by the following Chemical Structure (1)

Chemical Structure (1)

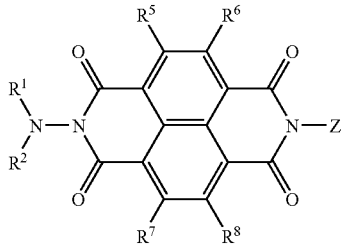

where Z represents a group represented by the following Chemical Formula (1)

Chemical Formula (1)

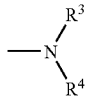

or the following Chemical Formula (2),

—$R^9$ Chemical Formula (2).

In the Chemical Structure (1) and Chemical Formulae (1) and (2), $R^1$, $R^2$, $R^3$, $R^4$ and $R^9$ each, independently, represent a substituted or non-substituted alkyl group or a substituted or non-substituted aromatic hydrocarbon group, $R^5$, $R^6$, $R^7$ and $R^8$ each, independently, represent hydrogen atom, a substituted or non-substituted alkyl group, or a substituted or non-substituted aromatic hydrocarbon group, and $R^1$ and $R^2$ and $R^3$ and $R^4$ optionally share a bond connectivity to form a substituted or non-substituted heterocyclic group including a nitrogen atom. In addition, the image bearing member and the at least one device integrally form the process cartridge and the process cartridge is detachably attached to an image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
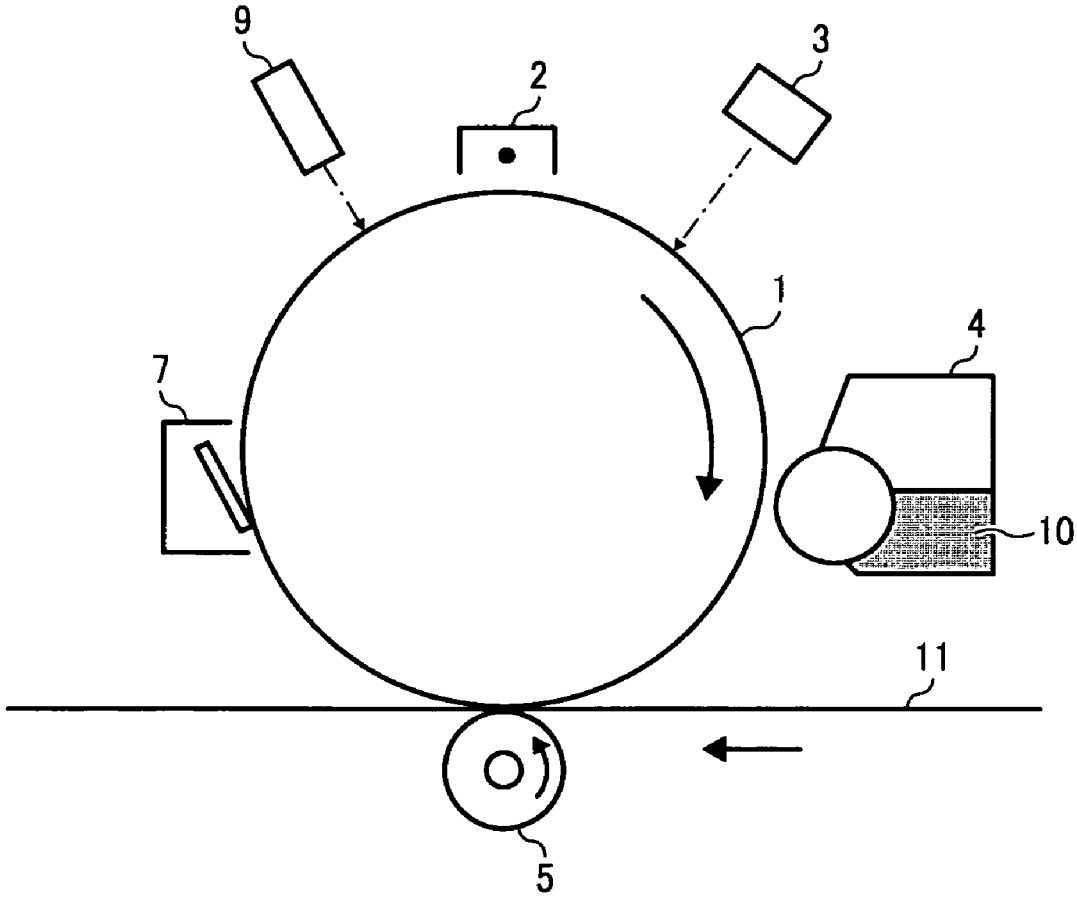
FIG. 1 is a diagram illustrating a cross section of a structure example of the image forming apparatus (full color) of the present invention having multiple image formation elements.

The present invention will be described below in detail with reference to several embodiments and accompanying drawings.

The image forming apparatus (full color) of the present invention includes an image formation element including an image bearing member having at least a substrate and a photosensitive layer thereon, a charging device to charge the surface of the image bearing member, an irradiation device to irradiate the surface of the charged image bearing member to form a latent electrostatic image on the image bearing member, a development device to develop the formed latent electrostatic image by attaching toner thereto, a transfer device to transfer the toner image to a recording medium, etc. The image forming apparatus optionally has a discharging device to discharge the image bearing member and may have multiple image formation elements. In the image forming apparatus, the photosensitive layer contains a naphthalene tetracarbonic acid diimide derivative represented by the following Chemical Structure (1).

Chemical Structure (1)

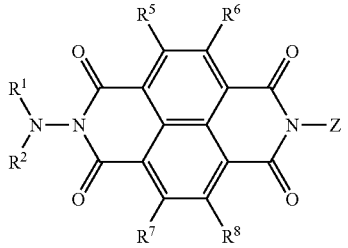

In the Chemical Structure (1), Z represents a group represented by the following Chemical Formula (1)

Chemical Formula (1)

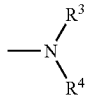

or the following Chemical Formula (2), $-R^9$ Chemical Formula (2)

In the case of Chemical Formula (1), the following Chemical Structure (A) is obtained:

Chemical Structure (A)

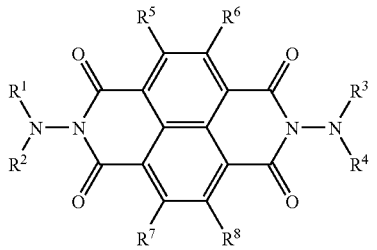

In the case of Chemical Formula (2), the following Chemical Structure (B) is obtained:

Chemical Structure (B)

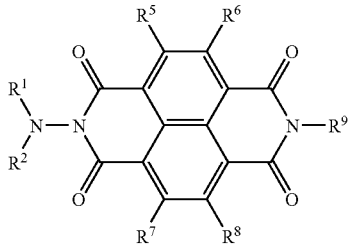

In the Chemical Structures (A) and (B), $R^1$, $R^2$, $R^3$, $R^4$ and $R^9$ each, independently, represent a substituted or non-substituted alkyl group or a substituted or non-substituted aromatic hydrocarbon group, $R^5$, $R^6$, $R^7$ and $R^8$ each, independently, represent hydrogen atom, a substituted or non-substituted alkyl group, or a substituted or non-substituted aromatic hydrocarbon group, and $R^1$ and $R^2$ and $R^3$ and $R^4$ optionally share a bond connectivity to form a substituted or non-substituted heterocyclic group including the nitrogen atom.

In general, the chargeability and the sensitivity of an image bearing member tend to deteriorate and the voltage at irradiated portions thereof tends to rise-during repetitive use. These are basically ascribable to charge transport materials contained in the photosensitive layer of the image bearing member. Improvement of such a charge transport material contributes to make the sensitivity of the image bearing member good at the initial stage and keep it good. As a result, the side effects described above caused by introducing a charge transport material in the photosensitive layer are limited. However, when a suitable material is not selected, the electrostatic contrast is not sufficiently obtained, which is disadvantageous in terms of image formation although the optical responsiveness is good. Therefore, an image bearing member having such a characteristic that the voltage after optical attenuation caused by irradiation drops sufficiently in a skirt shape manner is preferred.

According to the intensive study by the inventors of the present invention on various kinds of compounds in terms of the characteristics described above, the present inventors found that the naphthalene tetracarbonic acid diimide derivative represented by the Chemical Structure (1) satisfies the characteristics described above and thus made the present invention.

That is, image bearing members (corresponding to each color) using the naphthalene tetracarbonic acid diimide derivative can stably maintain the optical attenuation property with a high speed response over a long period of time regardless of usage bias among the image bearing members and have excellent environment durability (against oxidized gas, etc.). A full color image forming apparatus employing a tandem system in which such image bearing members are installed are highly durable and can stably form quality images free from defects such as color tone change, background fouling, definition degradation and image flow during repetitive use.

The reason the naphthalene tetracarbonic acid diimide derivative represented by the Chemical Structure (1) illustrated above is effective to maintain the quality of images during repetitive image formation is not clear at this point. However, the effect is inferred to have relations with the amino group contained in the naphthalene tetracarbonic acid diimide derivative, which is highly basic and has an electrical neutralization effect against oxidized gas which is thought of as an image-blur causing material. In addition, a combinational use of the naphthalene tetracarbonic acid diimide derivative represented by the Chemical Structure (1) for use in the present invention with another charge transport material has a good impact on ameliorating the sensitivity and stability against repetitive use.

In addition, since the naphthalene tetracarbonic acid diimide derivative represented by the Chemical Structure (1) for use in the present invention is a charge transport material, an image bearing member using this diimide derivative can deal with bipolar charging by a suitable selection of layer structure and mixture with a positive hole transport material. Therefore, an image bearing member can be obtained which has a good combination of the durability and the quality of images and deals with bipolar charging which is suitable to maintain the quality of images for repetitive use by satisfying the following structure requirements. Also, the image forming apparatus, the image formation method and the process cartridge using the image baring member are provided to stably produce quality images for repetitive use.

The image forming apparatus of the present invention is described with reference to the accompanying drawings. The image bearing member in any one of the drawings satisfies the requirements of the present invention.

FIG. 1 is a schematic diagram illustrating a cross section of a structure example of the image formation element for use in the image forming apparatus of the present invention for illustration only and thus the variations of the image formation element described later are also within the scope of the present invention.

In FIG. 1, an image bearing member 1 has a drum form but can also employs a sheet form or an endless belt form. A charging device 2 employs any known device such as a corotron, scorotron, a solid state charger, a charging roller, etc. A transfer device 5 functioning as a transfer device employs various kinds of forms and, for example, a roller form as illustrated in FIG. 1 or a charger form.

In addition, the reference numeral 3 represents an irradiation device. Semiconductor laser (LD) or luminescent diode (LED) can be used as the irradiation device 3. Various kinds of filters, for example, a sharp cut filter, a band pass filter, an infrared cut filter, a dichroic filter, a coherency filter and a color conversion filter can be used to irradiate the image bearing member 1 with light having only a desired wavelength.

The reference numeral 9 represents a discharging device, which is optionally used. As the light source, typical luminescent materials, for example, a fluorescent lamp, a tungsten lamp, a halogen lamp, a mercury lamp, a sodium lamp, a luminescent diode (LED), a semi-conductor laser (LD) and electroluminescence (EL) can be used.

Toner 10 for use in developing a latent electrostatic image on the image bearing member 1 by a development device 4 is transferred to a recording medium 11. Not all but some of Toner 10 remains on the image bearing member 1 untransferred. Such residual toner remaining on the image bearing member 1 is removed therefrom by a cleaning device 7. The cleaning device 7 can employ a rubber cleaning blade, a brush such as a fur brush and a magnet fur brush, etc.

When the image bearing member 1 is positively (negatively) charged followed by irradiation according to obtained data information, a positive (negative) latent electrostatic image is formed on the image bearing member 1. When the latent electrostatic image is developed with negatively (positively) charged toner (electric detecting particulates), a positive image is obtained. When the latent electrostatic image is developed with a positively (negatively) charged toner, a negative image is obtained. Typically used methods are applied to the development device 4 and the discharging device 9.

The image forming apparatus of the present invention preferably includes multiple image formation elements as illustrated in FIG. 1. These multiple image formation elements are arranged horizontally or diagonally in actual use.

Figure 2:
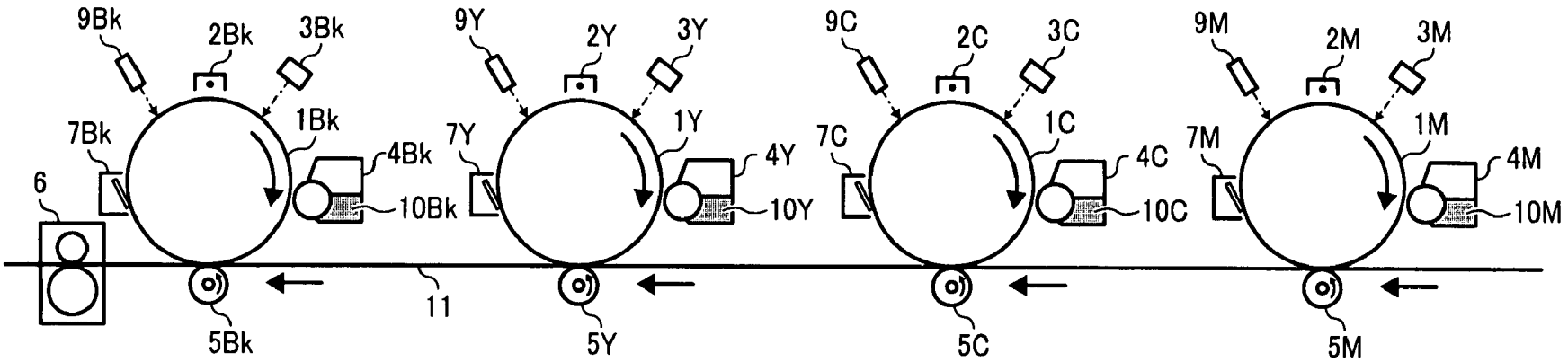
FIG. 2 is a diagram illustrating a cross section of another structure example of the image forming apparatus (full color) of the present invention having multiple image formation elements.

FIG. 2 is a diagram illustrating a cross section of an example of multiple image formation elements provided in the image forming apparatus of the present invention.

In this example, 4 colors of Yellow (10Y), Magenta (10M), Cyan (10C) and Black (10BK) are employed as the toner 10. An image formation element is provided for each color. In addition, image bearing members 1Y, 1M, 1C and 1Bk are provided for respective colors. These image bearing members satisfy the requirements of the present invention. There are provided charging devices (2Y, 2M, 2C and 2Bk), irradiation devices (3Y, 3M, 3C and 3Bk), development devices (4Y, 4M, 4C and 4Bk), transfer devices (5Y, 5M, 5C and 5Bk), cleaning devices (7Y, 7M, 7C and 7Bk) and discharging devices (9Y, 9M, 9C and 9Bk), respectively, around the image bearing members (1Y, 1M, 1C and 1Bk) as in the image forming apparatus illustrated in FIG. 1.

A fixing device 6 in FIG. 2 is situated downstream from the four image formation elements in the direction of conveyance of the recording medium 11 to fix each color toner image formed on the four image formation elements at one time.

In addition, each device or member in the image formation elements illustrated above can be provided inside a photocopier, a facsimile machine, a printer, etc. in a fixed manner or a form of a process cartridge.

Figure 3:
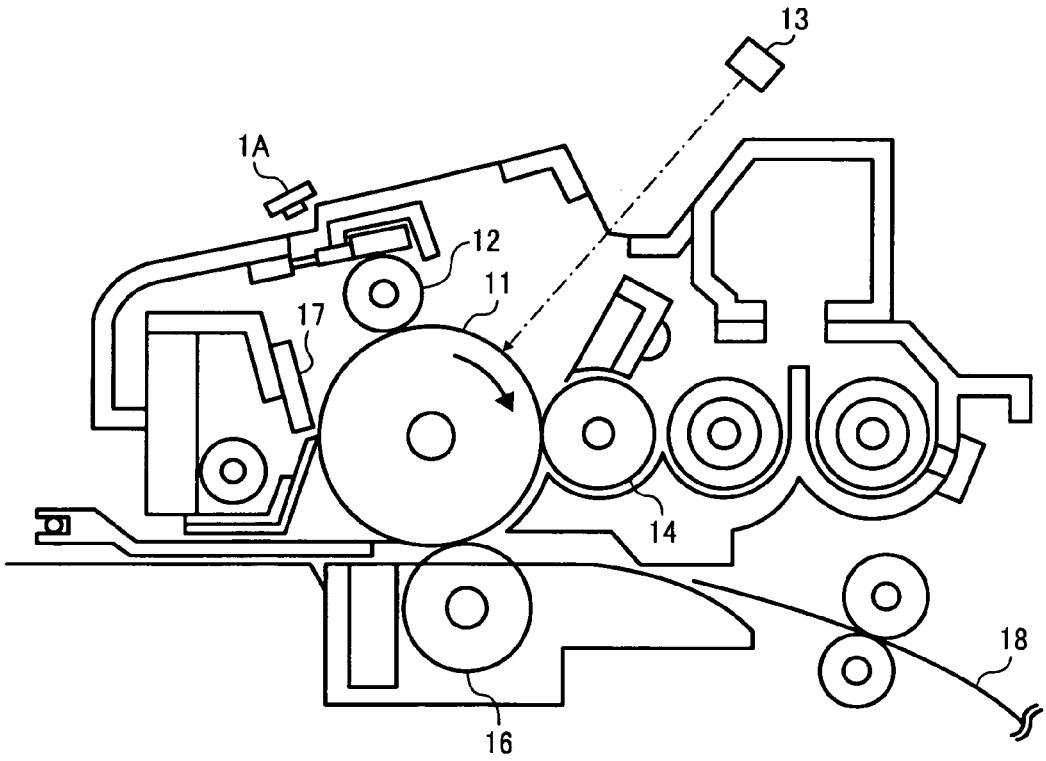
FIG. 3 is a diagram illustrating a cross section of an example in which the image formation element of the image forming apparatus of the present invention is a process cartridge.

The process cartridge includes an image bearing member and at least one element selected from the group consisting of a charging device, an irradiation device, a development device, a transfer device, a cleaning device, a discharging device, etc. and is an integrally supported device (part) detachably attachable to an image forming apparatus. Such a process cartridge can employ various kinds of forms. FIG. 3 is a diagram illustrating one of such typical forms. That is, FIG. 3 is a diagram illustrating a cross section of an example of an image formation element employing the form of a process cartridge for use in the image forming apparatus of the present invention. In the process cartridge, a charging device 12, an irradiation device 13, a development device 14, a transfer device 16, a cleaning device 17 and a discharging device 1A are arranged around an image bearing member 11. The reference numeral 18 denotes a recording medium. The image bearing member 11 satisfies the requisite of the present invention. This type of the process cartridge is detachably attachable and can be easily maintained. The image formation element employing the form of the process cartridge as illustrated in FIG. 3 is multiply provided in the image forming apparatus of the present invention. The multiple image formation elements are arranged horizontally or diagonally.

Figure 4:
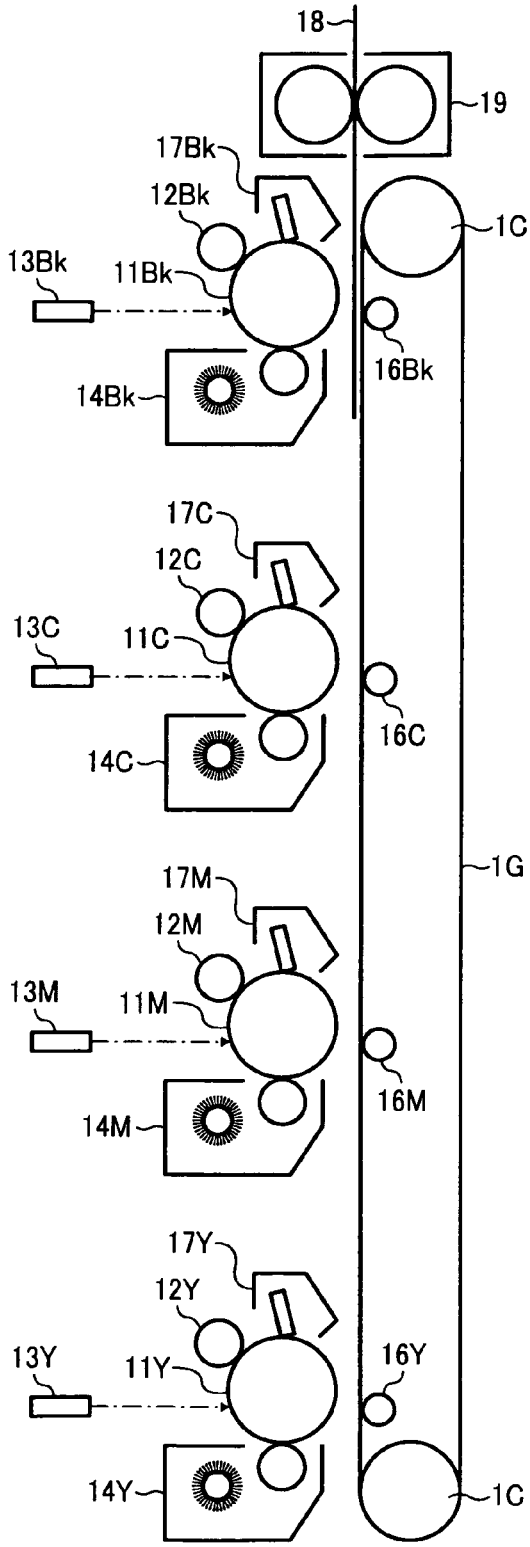
FIG. 4 is a diagram illustrating a cross section of yet another structure example of the image forming apparatus (full color) of the present invention having multiple image formation elements.

FIG. 4 is a diagram illustrating a cross section of another example of the image forming apparatus having multiple image formation elements of the present invention.

The image forming apparatus illustrated in FIG. 4 uses four color toners of yellow (Y), magenta (M), cyan (C), and black (Bk) and has an image formation portion for each color. In addition, respective image bearing members (11Y, 11M, 11C, 11Bk) are provided for each color. The image bearing member 11 for use in the image forming apparatus satisfies the requisite of the present invention.

There are provided charging devices (12Y, 12M, 12C and 12Bk), irradiation devices (13Y, 13M, 13C and 13Bk), development devices (14Y, 14M, 14C and 14Bk), and cleaning devices (17Y, 17M, 17C and 17Bk), etc., around the image bearing members (11Y, 11M, 11C and 11Bk) respectively. A transfer conveyor 1G functioning as a transfer material bearing member is suspended over a driving force 1C and detached and attached to the image bearing members 11Y, 11M, 11C and 11Bk arranged in a straight line at each transfer position. Transfer devices (16Y, 16M, 16C and 16Bk) are provided opposing the image bearing members 11Y, 11M, 11C and 11Bk, respectively, with the transfer conveyor 1G therebetween. A toner image formed by overlapping the toner image formed on the image bearing members (11Y, 11M, 11C and 11Bk) is transferred to a recording medium 18 by way of the system described above, fixed onto the recording medium 18 by a fixing device 19 and discharged from the image forming apparatus.

The image forming apparatus employing a tandem system as illustrated in FIG. 4 includes the image bearing members 11Y, 11M, 11C and 11Bk for respective colors and sequentially transfers each color toner image to the recording medium 18 held on the transfer conveyor 1G. Therefore, the image forming apparatus can output images at an extremely higher speed than an image forming apparatus having only one image bearing member.

Figure 5:
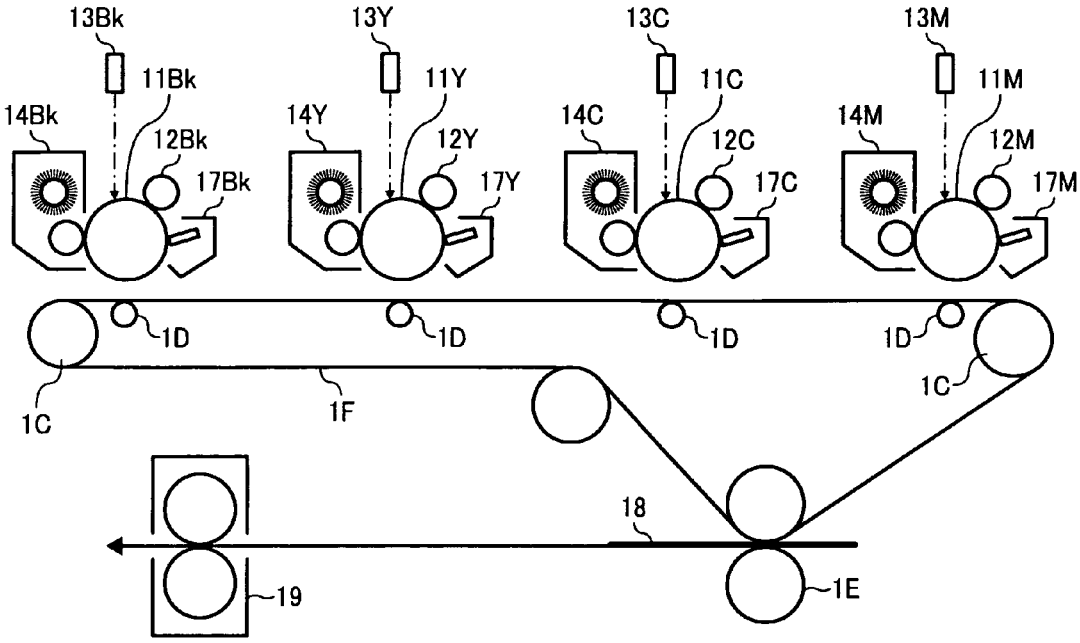
FIG. 5 is a diagram illustrating a cross section of still another structure example of the image forming apparatus (full color) of the present invention having multiple image formation elements.

FIG. 5 is a diagram illustrating a cross section of another example of the image forming apparatus (full color) having multiple image formation elements of the present invention.

As illustrated in FIG. 4, there are provided charging devices (12Y, 12M, 12C and 12Bk), irradiation devices (13Y, 13M, 13C and 13Bk), development devices (14Y, 14M, 14C and 14Bk), and cleaning devices (17Y, 17M, 17C and 17Bk), etc., around the image bearing members (11Y, 11M, 11C and 11Bk), respectively. The toner images formed on the image bearing members (11Y, 11M, 11C and 11Bk) are transferred to an intermediate transfer body 1F by a first transfer device 1D arranged inside the intermediate transfer body 1F. The first transfer body 1D is detachably attachable to each of the image bearing members (11Y, 11M, 11C and 11Bk) and brings the intermediate transfer body 1F into contact with the image bearing members (11Y, 11M, 11C and 11Bk) only during the transfer operation. Each color image is sequentially formed and overlapped atop on the intermediate transfer body 1F. Thereafter, the overlapped toner image is secondarily transferred to the recording medium 18 such as paper at one time by a second transfer device 1E. After the secondary transfer, the toner image on the recording medium 18 is fixed by the fixing device 19. That is, In FIG. 5, each toner image is primarily transferred to the intermediate transfer body 1F having a belt form, which is suspended over the driving device 1C and detached and attached to the image bearing members 11Y, 11M, 11C and 11Bk arranged in a straight line at each transfer position, secondarily transferred to the recording medium 18 at one time, fixed by the fixing device 19 and discharged outside the image forming apparatus.

As described above, semiconductor laser (LD) or luminescent diode (LED) can be used as the light source for the irradiation devices 13 (13Y, 13M, 13C and 13K) illustrated in FIGS. 4 and 5. In addition, various kinds of filters, for example, a sharp cut filter, a band pass filter, an infrared cut filter, a dichroic filter, a coherency filter and a color conversion filter, can be used to irradiate the image bearing member 11 (11Y, 11M, 11C and 11K) with light having only a desired wavelength.

The detachably attachable process cartridge described above can be used as the image formation element for each color in the image forming apparatus having the structure illustrated in FIG. 4 or 5. In addition, the image formation elements for respective colors can be arranged in any order.

The naphthalene tetracarbonic acid diimide derivative represented by the Chemical Structure (A) illustrated above contained in the photosensitive layer in the present invention is described in detail next.

The naphthalene tetracarbonic acid diimide derivative represented by the Chemical Structure (A) can be manufactured by conducting reaction between a naphthalene-1,4,5,8-tetracarboxylic dianhydride derivative and a 1,1-disubstituted hydrazine derivative with or without a solvent.

There is no specific limit to the solvent. Specific examples thereof include, but are not limited to, benzene, toluene, xylene, chloronaphthalene, acetic acid, pyridine, methyl pyridine, N,N-dimethyl formamide, N,N-diimethyl acetaminde, dimethyl ethyleneurea and dimethyl sulphoxide. The reaction temperature is preferably from room temperature to 250° C. Furthermore, pH can be adjusted to accelerate the reaction. A buffer solution can be used for such pH adjustment and manufactured by mixing a basic solution such as lithium hydroxide, potassium hydroxide and sodium hydroxide with an acid such as phosphoric acid.

A method of manufacturing the naphthalene tetracarbonic acid diimide derivative represented by Chemical Structure (A) illustrated above is specified below.

For example, a monoimide is prepared by reacting naphthalene-1,4,5,8-tetracarboxyllic dianhydride with a 1,1-disubstituted hydrazine derivative in the first process (represented by the following Chemical Reaction (I-1).

Chemical Reaction (I-1)

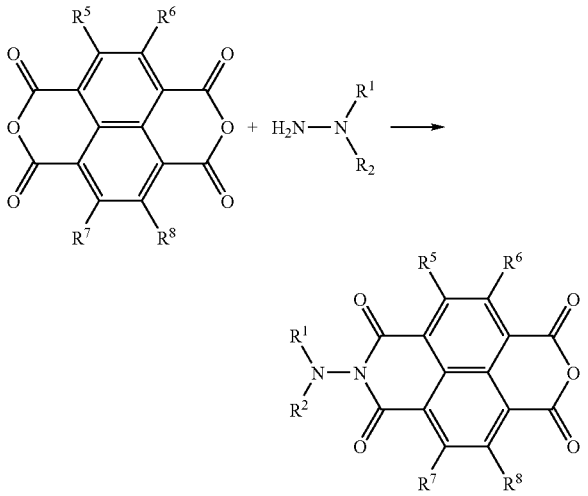

Thereafter, the monoimide is reacted in the second process (represented by the following Chemical Reaction (I-2)) with a hydrazine derivative having a different substituent from the hydrazine derivative for use in the first process to manufacture the naphthalene tetracarbonic acid diimide derivative represented by the Chemical Structure (A) illustrated above.

Chemical Reaction (I-2)

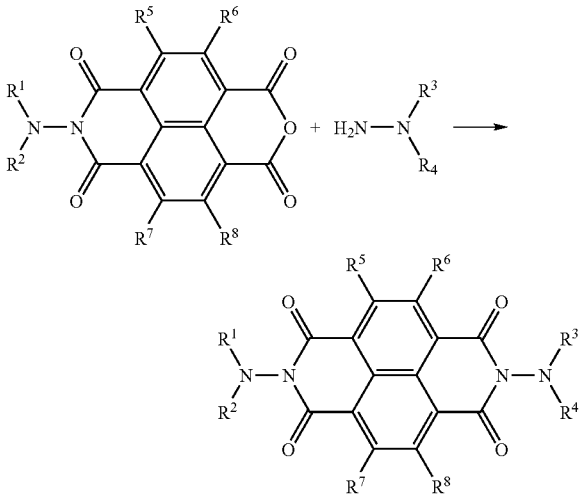

When $R^1$, $R^2$, $R^3$ and $R^4$ in the naphthalene-1,4,5,8-tetracarboxyllic dianhydride are different from each other, a naphthalene tetracarbonic acid diimide derivative represented by the Chemical structure (A) having independently different $R^1$, $R^2$, $R^3$ and $R^4$ is manufactured.

In the reaction (I-1), $R^1$, $R^2$, $R^5$, $R^6$, $R^7$, and $R^8$ are the same as defined for the naphthalene tetracarbonic acid diimide derivative represented by the Chemical structure (1) illustrated above. Also, in the reaction (I-2), $R^1$, $R^2$, $R^3$, $R^4$, $R^5$, $R^6$, $R^7$ and $R^8$ are the same as defined for the naphthalene tetracarbonic acid diimide derivative represented by the Chemical Structure (A) illustrated above.

Also, as illustrated in the following Chemical Reaction (II-1), the naphthalene tetracarbonic acid diimide derivative represented by the chemical Structure (A) can be manufactured by reacting one mole equivalent naphthalane tetracarbonic dianhydride with at least two mole equivalent hydrazine derivative.

Chemical Reaction (II-1)

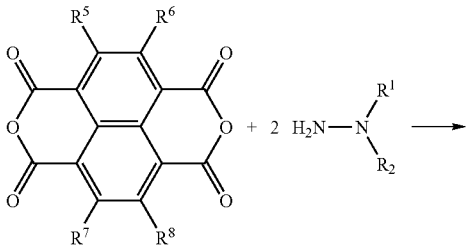

-continued

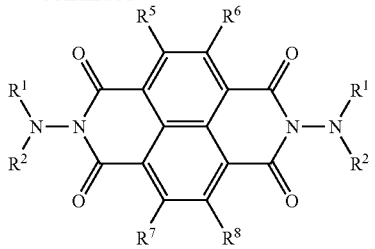

When $R^1$ and $R^2$ in the naphthalene-1,4,5,8-tetracarboxyllic dianhydride derivative are the same, a naphthalene tetracarbonic acid diimide derivative represented by the Chemical Structure (A) in which $R^1$, $R^2$, $R^3$ and $R^4$ are the same is manufactured.

In the reaction (II-1), $R^1$, $R^2$, $R^5$, $R^6$, $R^7$, and $R^8$ are the same as defined for the naphthalene tetracarbonic acid diimide derivative represented by the Chemical Structure (1) illustrated above.

Specific examples of the alkyl groups mentioned in the description of the naphthalene tetracarbonic acid diimide derivative represented by the Chemical Structure (A) include, but are not limited to, methyl group, ethyl group, propyl group, butyl group, hexyl group, and undecanyl group. Specific examples of the aromatic hydrocarbons include, but are not limited to, groups of aromatic rings such as benzene, biphenyl, naphthalene, anthracene, fluorine, andpyrene, and groups of heteroaromatic rings such aspyridine, quinoline, thiophene, furan, oxazole, oxadiazole, and carbazole.

Specific examples of the substitution groups include, but are not limited to, the alkyl groups specified above, alkoxy groups such as methoxy group, ethoxy group, propoxy group, and buthoxy group, halogen atoms such as fluorine atom, chlorine atom, bromine atom, and iodine atom, dialkyl amino groups, diphenyl amino groups, the aromatic hydrocarbon groups specified above, and heterocyclic groups such as pyrolidine, piperidine and piperazine.

Furthermore, when $R^1$ and $R^2$ and $R^3$ and $R^4$ share a bond connectivity to form a heterocyclic ring including the nitrogen atom, specific examples of the heterocyclic rings include, but are not limited to, condensed heterocyclic groups obtained by conducting a condensation reaction of an aromatic hydrocarbon group with pyrolidino group, piperidino group or piperazino group.

Preferred specific examples (hereinafter referred to as illustrated derivatives or illustrated compounds) of the naphthalene tetracarbonic acid diimide derivative represented by the Chemical Structure (A) are shown below. However, the naphthalene tetracarbonic acid diimide derivatives represented by the Chemical Structure (A) are not limited to these specific examples.

| Illustrated Compound No. | Chemical Structure |
|---|---|
| 1 | 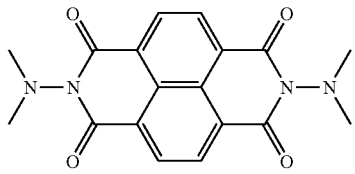 |

-continued
| Illustrated Compound No. | Chemical Structure |
|---|---|
| 2 | 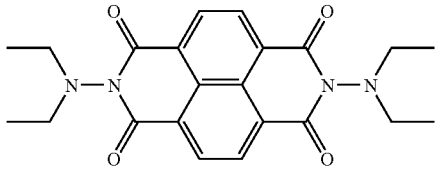 |
| 3 | 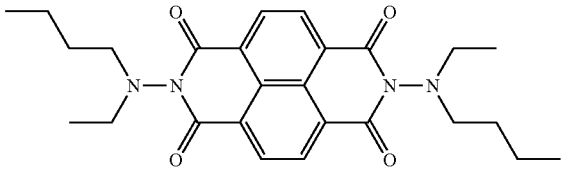 |
| 4 | 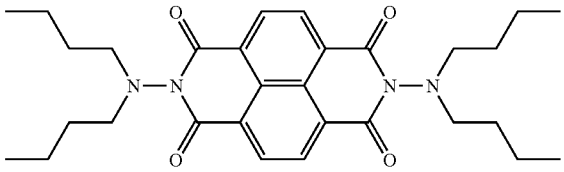 |
| 5 | 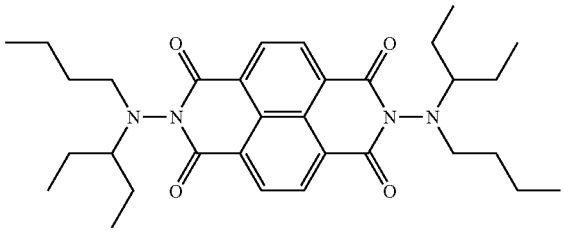 |
| 6 | 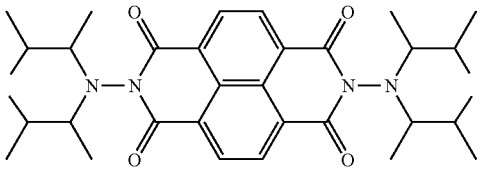 |
| 7 | 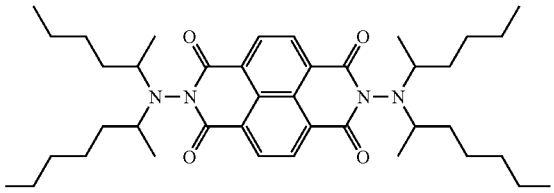 |
| 8 | 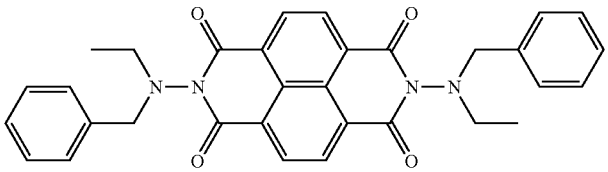 |

-continued
| Illustrated Compound No. | Chemical Structure |
|---|---|
| 9 | 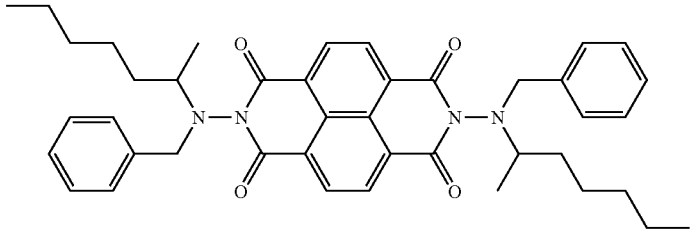 |
| 10 | 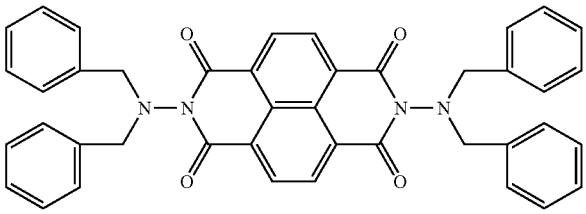 |
| 11 | 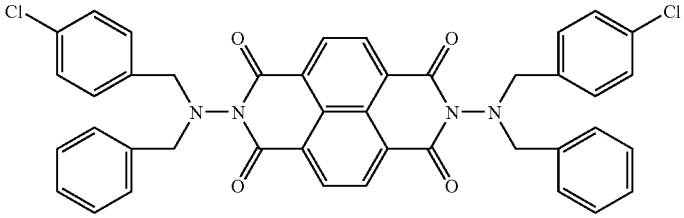 |
| 12 | 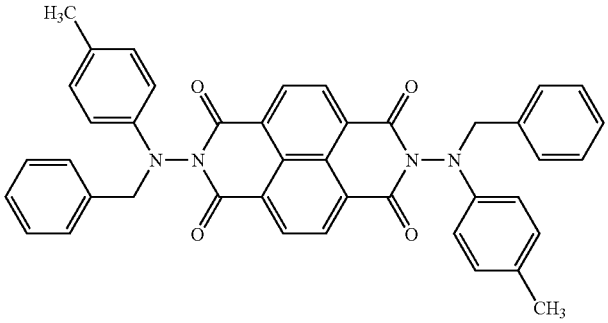 |
| 13 | 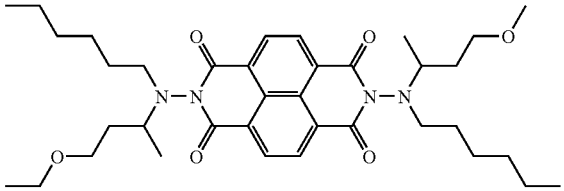 |
| 14 | 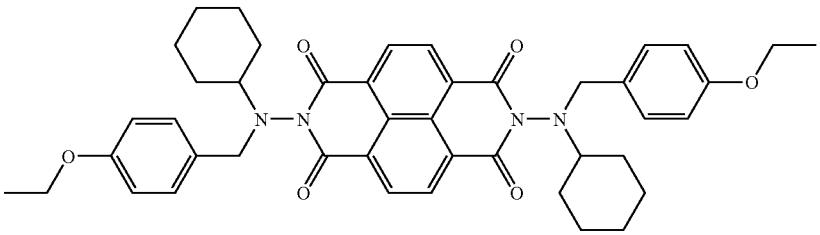 |

-continued
| Illustrated Compound No. | Chemical Structure |
|---|---|
| 15 | 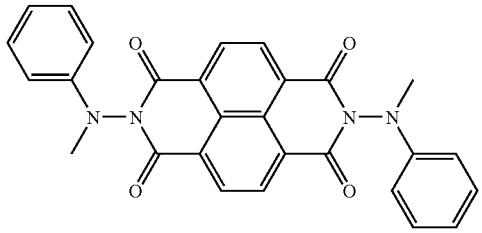 |
| 17 | 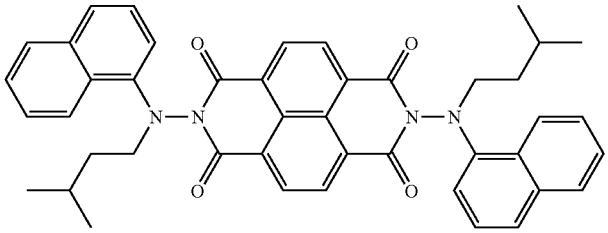 |
| 18 | 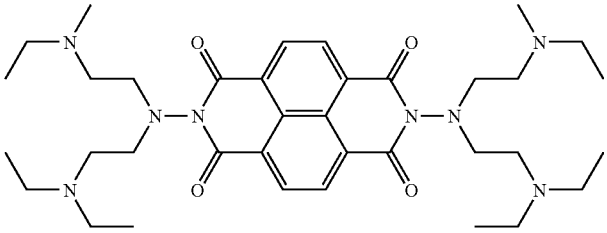 |
| 19 | 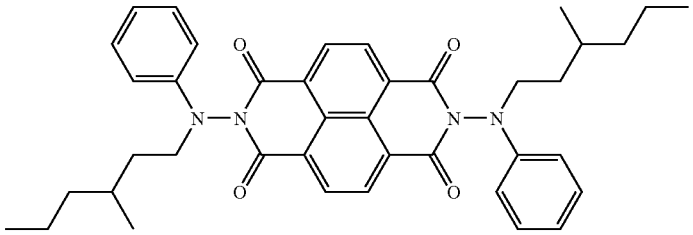 |
| 20 | 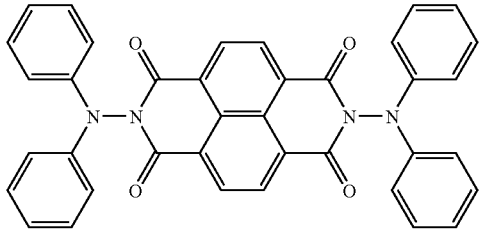 |
| 21 | 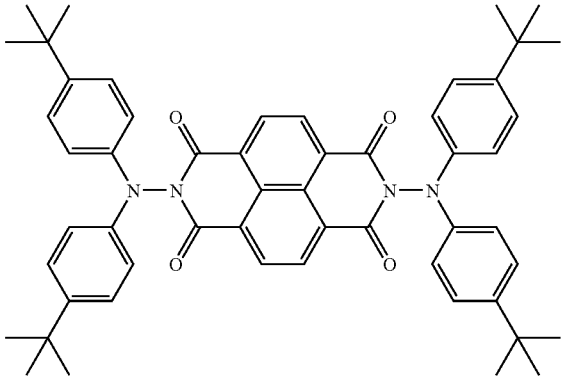 |

-continued
| Illustrated Compound No. | Chemical Structure |
|---|---|
| 22 | 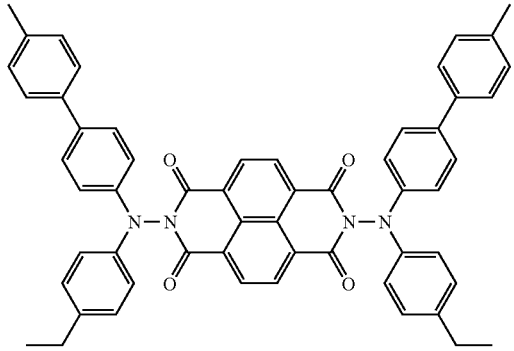 |
| 23 | 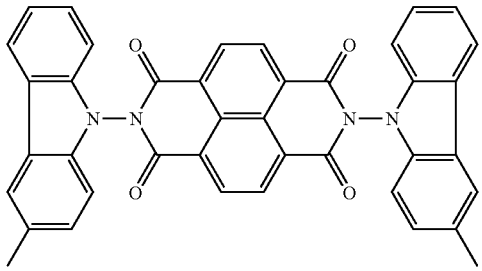 |
| 24 | 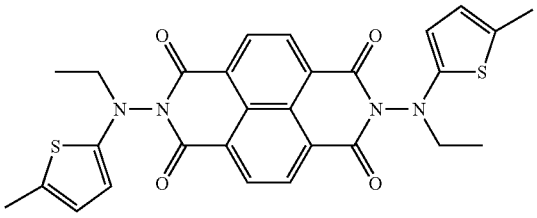 |
| 25 | 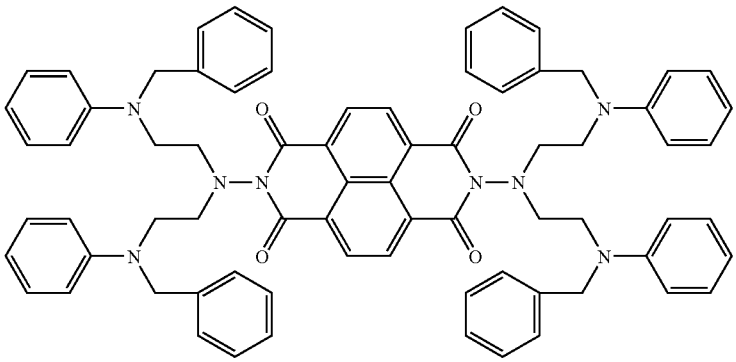 |
| 26 | 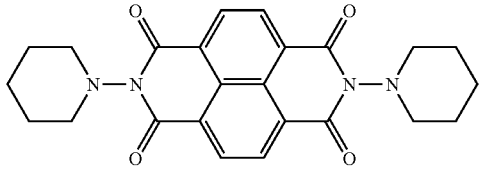 |

-continued
| Illustrated Compound No. | Chemical Structure |
|---|---|
| 27 | 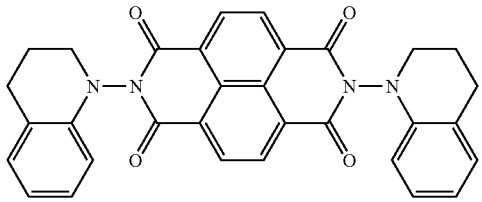 |
| 28 | 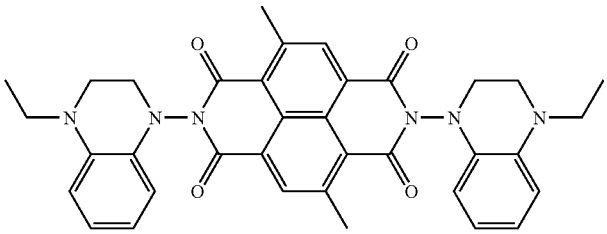 |
| 29 | 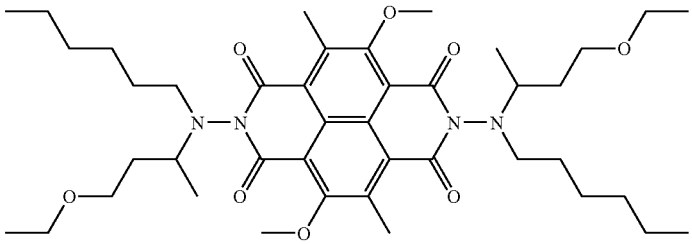 |
| 30 | 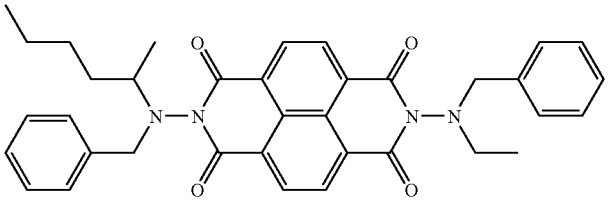 |
| 31 | 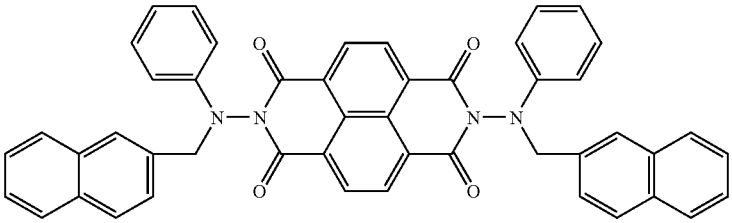 |
| 32 | 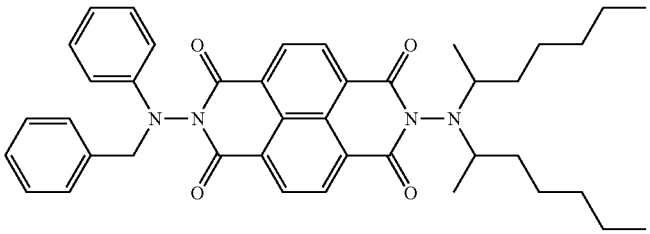 |

-continued

| Illustrated Compound No. | Chemical Structure |
|---|---|
| 33 | 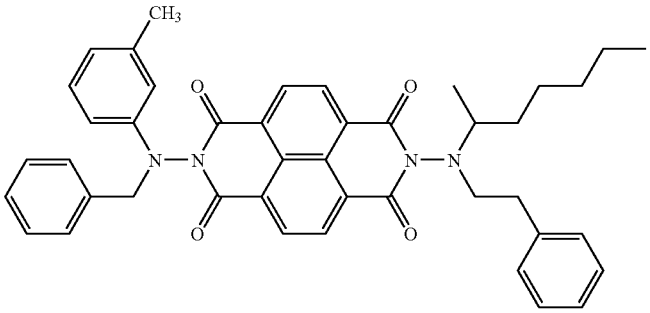 |
| 34 | 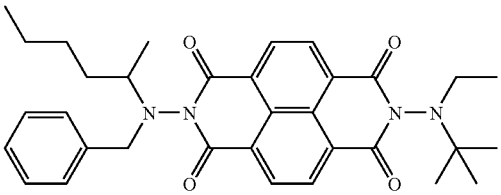 |
| 35 | 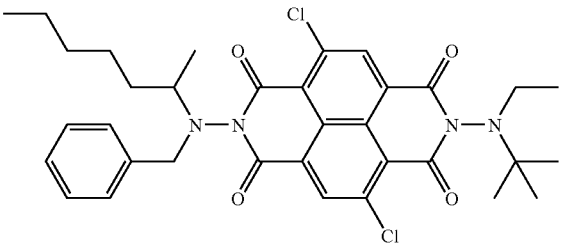 |
| 36 | 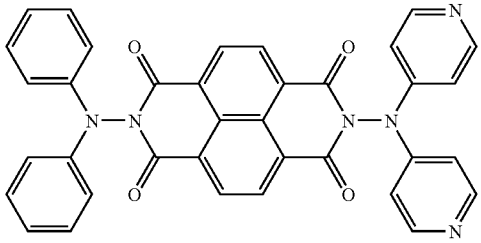 |

The naphthalene tetracarbonic acid diimide derivative represented by the Chemical Structure (B) illustrated above contained in the photosensitive layer in the present invention is described in detail next.

The naphthalene tetracarbonic acid diimide derivative represented by the Chemical Structure (B) can be manufactured by sequentially or simultaneously conducting reaction of a naphthalene-1,4,5,8-tetracarboxylic dianhydride derivative, a 1,1-disubstituted hydrazine derivative and a substituted amine derivative with or without a solvent.

There is no specific limit to the solvent. Specific examples thereof include, but are not limited to, benzene, toluene, xylene, chloronaphthalene, acetic acid, pyridine, methyl pyridine, N,N-dimethyl formamide, N,N-diimethyl acetaminde, dimethyl ethyleneurea and dimethyl sulphoxide. The reaction temperature is preferably from room temperature to 250° C. Furthermore, pH can be adjusted to accelerate the reaction. A buffer solution can be used for such pH adjustment and manufactured by mixing a basic solution such as lithium hydroxide, potassium hydroxide and sodium hydroxide with an acid such as phosphoric acid.

A method of manufacturing the naphthalene tetracarbonic acid diimide derivative represented by Chemical structure (B) illustrated above is specified next.

A monoimide is prepared by reacting a naphthalene-1,4,5,8-tetracarboxyllic dianhydride derivative with a 1,1-disubstituted hydrazine derivative in the first process (represented by the following Chemical reaction (III-1). Thereafter, the monoimide is reacted with a substituted amine derivative in the second process (represented by the following Chemical reaction (III-2)) to manufacture the naphthalene tetracarbonic acid diimide derivative represented by the Chemical structure (B) illustrated above.

Chemical Reaction (III-1)

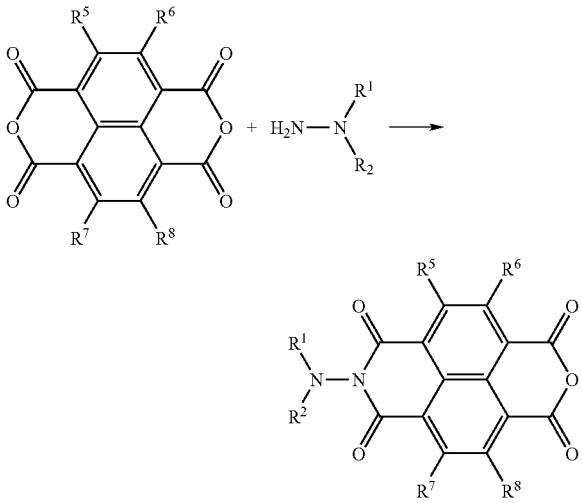

Chemical Reaction (III-2)

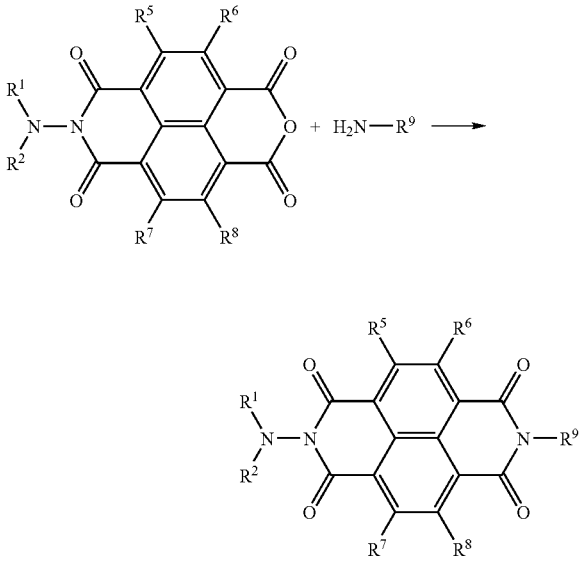

Also, the naphthalene tetracarbonic acid diimide derivative represented by the Chemical Structure (B) can be also manufactured in a similar manner. That is, a naphthalene-1,4,5,8-tetracarboxyllic dianhydride derivative is reacted with a substituted amine derivative in the first process (represented by the following Chemical Reaction (IV-1)) to obtain a monoimide.

Chemical Reaction (IV-1)

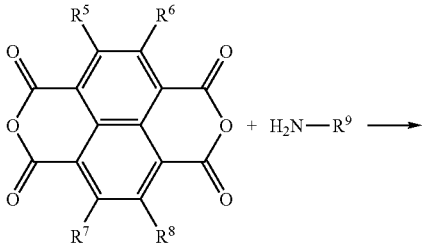

-continued

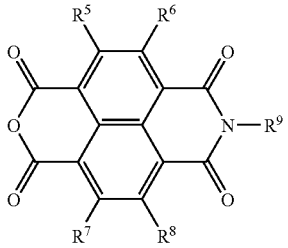

Thereafter, the monoimide is reacted with 1,1-disubstituted hydrazine derivative in the second process (represented by the following Chemical Reaction (IV-2)) to manufacture the naphthalene tetracarbonic acid diimide derivative represented by the Chemical structure (B) illustrated above.

Chemical Reaction (IV-2)

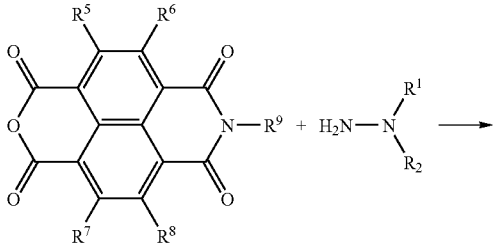

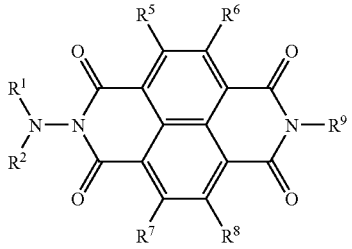

Furthermore, as illustrated in the following Chemical Reaction (V-1), the naphthalene tetracarbonic acid diimide derivative represented by the Chemical Structure (B) can be manufactured by simultaneously conducting a reaction of a naphthalene-1,4,5,8-tetracarboxyllic dianhydride derivative, a substituted amino derivative and a 1,1-disubstituted hydrazine derivative.

Chemical Reaction (V-1)

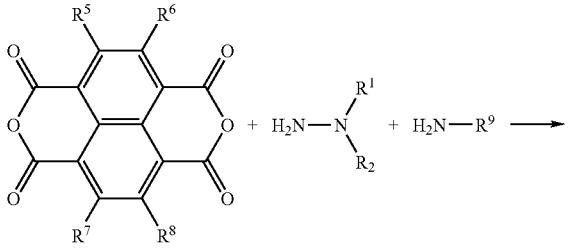

-continued

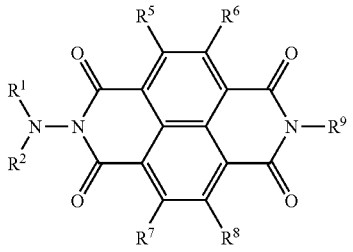

In the Chemical Reaction (III-1), $R^1$, $R^2$, $R^5$, $R^6$, $R^7$ and $R^8$ are the same as defined for the naphthalene tetracarbonic acid diimide derivative represented by the Chemical Structure (1) illustrated above. Also, in the Chemical Reactions (III-2), (IV-1), (IV-2) and (V-1), $R^1$, $R^2$, $R^5$, $R^6$, $R^7$, $R^8$ and $R^9$ are the same as defined for the naphthalene tetracarbonic acid diimide derivative represented by the Chemical structure (B) illustrate above.

Specific examples of the alkyl groups mentioned in the description of the naphthalene tetracarbonic acid diimide derivative represented by the chemical structure (B) include, but are not limited to, methyl group, ethyl group, propyl group, butyl group, hexyl group, and undecanyl group. Specific examples of the aromatic hydrocarbons include, but are not limited to, groups of aromatic rings such as benzene, biphenyl, naphthalene, anthracene, fluorine, and pyrene, and groups of heteroaromatic rings such as pyridine, quinoline, thiophene, furan, oxazole, oxadiazole, and carbazole.

Specific examples of the substitution groups include, but are not limited to, the alkyl groups specified above, alkoxy groups such as methoxy-group, ethoxy group, propoxy group, and buthoxy group, halogen atoms such as fluorine atom, chlorine atom, bromine atom, and iodine atom, dialkyl amino groups, diphenyl amino groups, the aromatic hydrocarbon groups specified above, and heterocyclic groups such as pyrolidine, piperidine and piperazine.

Furthermore, when $R^1$ and $R^2$ share a bond connectivity to form a heterocyclic ring including the nitrogen atom, specific examples of the heterocyclic rings include, but are not limited to, condensed heterocyclic groups obtained by conducting a condensation reaction of an aromatic hydrocarbon group with pyrolidino group, piperidino group, piperazino group, etc.

Preferred specific examples (hereinafter referred to as illustrated derivatives or illustrated compounds) of the naphthalene tetracarbonic acid diimide derivative represented by the chemical structure (B) are shown below. However, the naphthalene tetracarbonic acid diimide derivatives represented by the chemical structure (B) are not limited to these specific examples.

| Illustrated Compound No. | Chemical Structure |
|---|---|
| 37 | 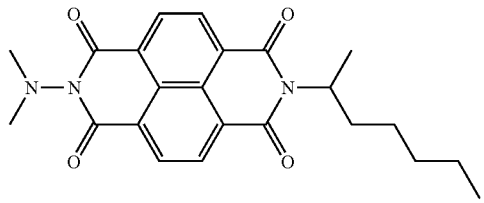 |
| 38 | 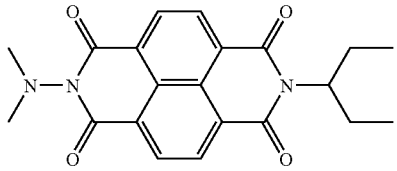 |
| 39 | 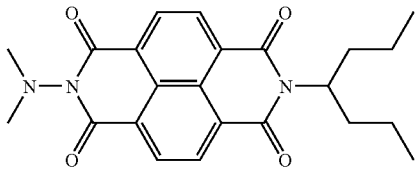 |
| 40 | 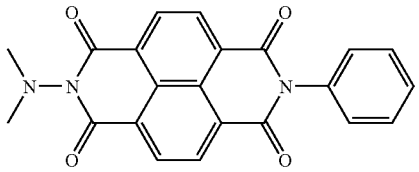 |

-continued
| Illustrated Compound No. | Chemical Structure |
|---|---|
| 41 | 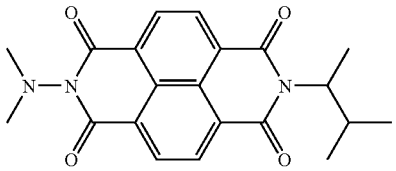 |
| 42 | 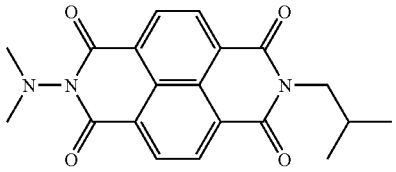 |
| 43 | 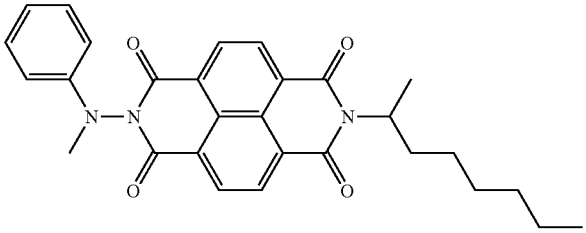 |
| 44 | 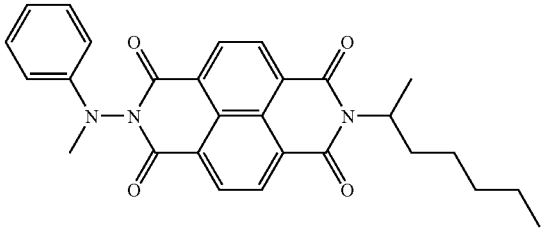 |
| 45 | 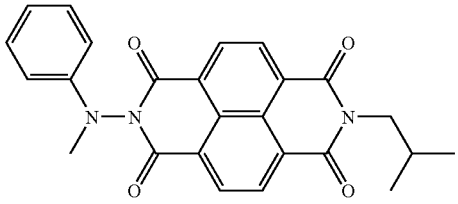 |
| 46 | 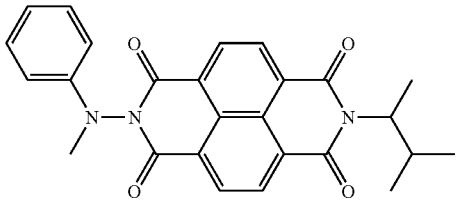 |
| 47 | 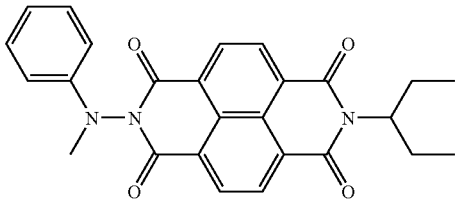 |

-continued
| Illustrated Compound No. | Chemical Structure |
|---|---|
| 48 | 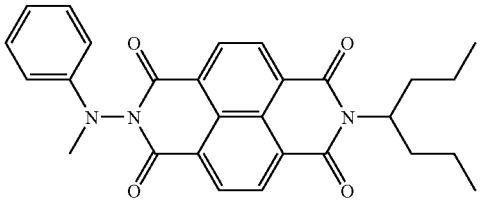 |
| 49 | 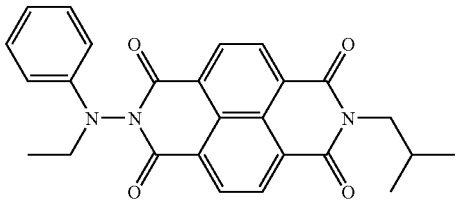 |
| 50 | 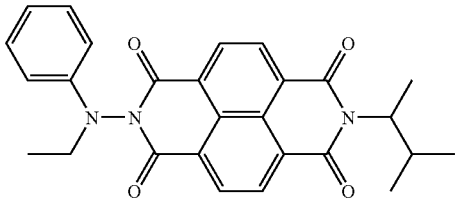 |
| 51 | 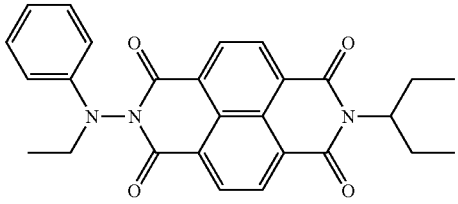 |
| 52 | 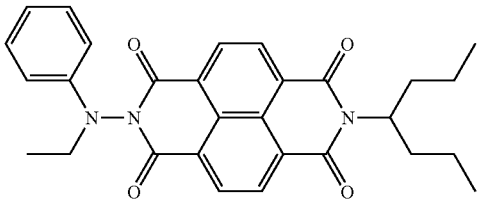 |
| 53 | 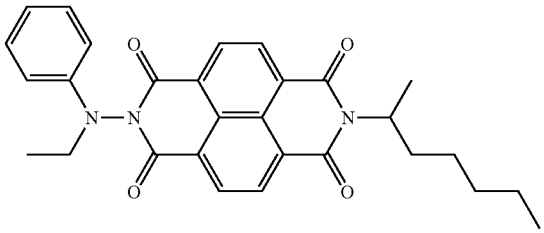 |
| 54 | 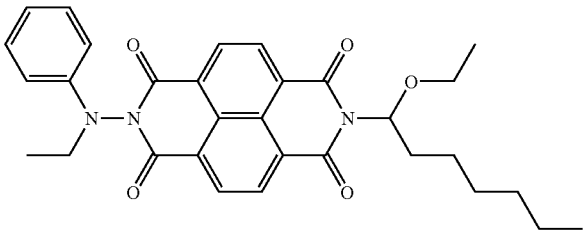 |

-continued
| Illustrated Compound No. | Chemical Structure |
|---|---|
| 55 | 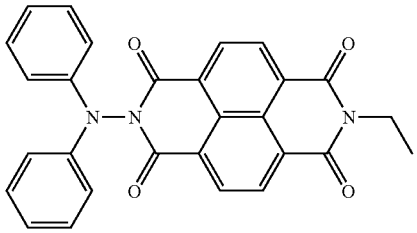 |
| 56 | 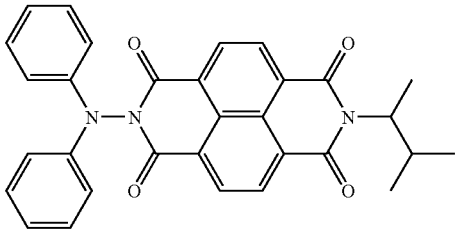 |
| 57 | 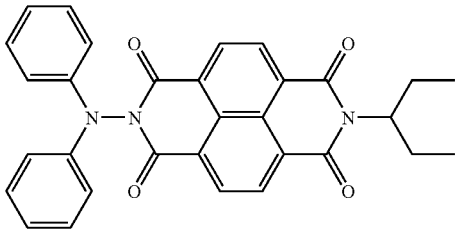 |
| 58 | 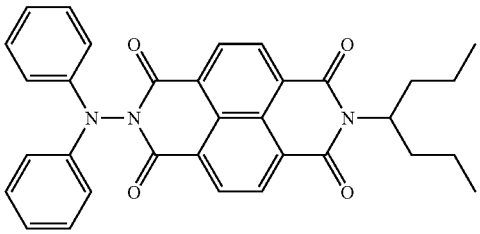 |
| 59 | 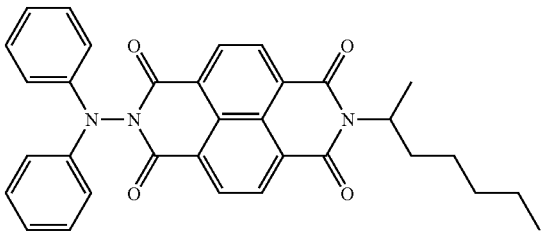 |
| 60 | 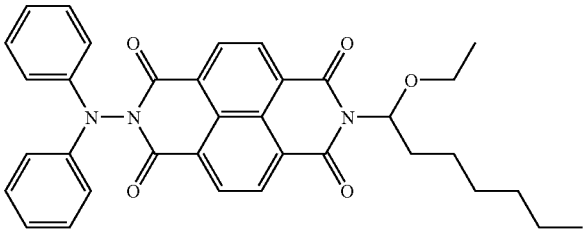 |

-continued
| Illustrated Compound No. | Chemical Structure |
|---|---|
| 61 | 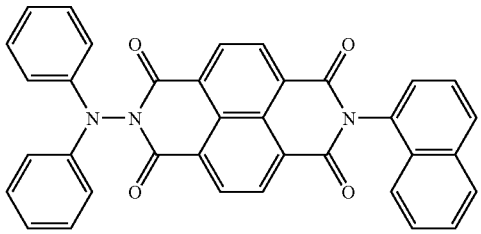 |
| 62 | 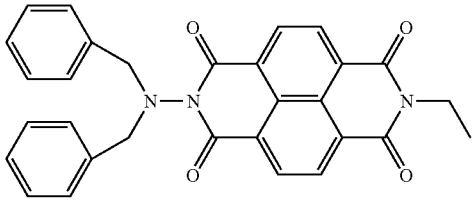 |
| 63 | 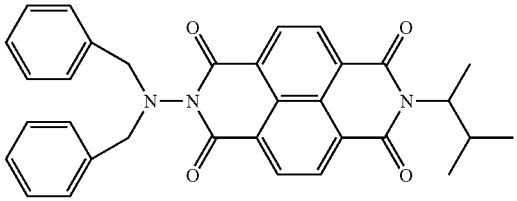 |
| 64 | 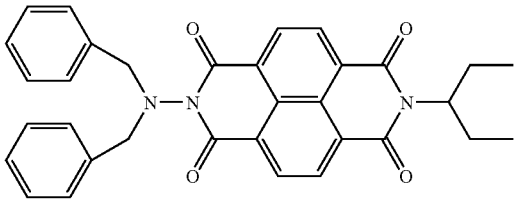 |
| 65 | 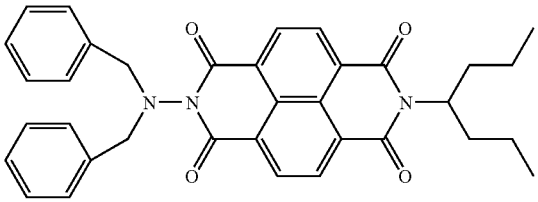 |
| 66 | 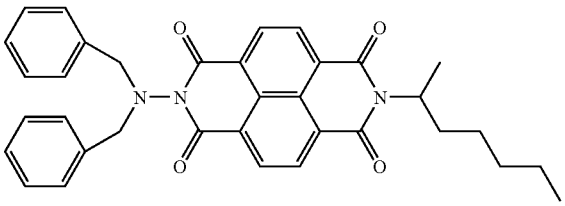 |
| 67 | 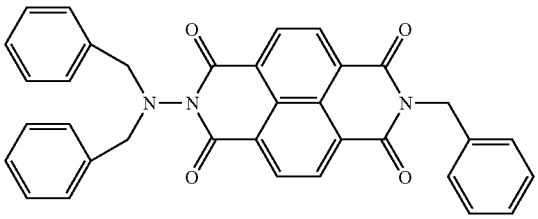 |

-continued
| Illustrated Compound No. | Chemical Structure |
|---|---|
| 68 | 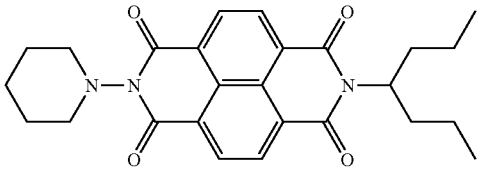 |
| 69 | 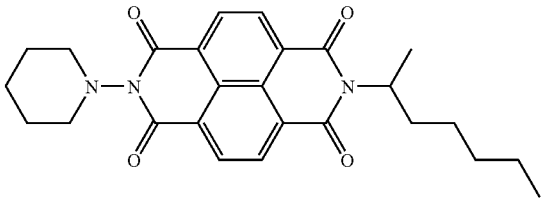 |
| 70 | 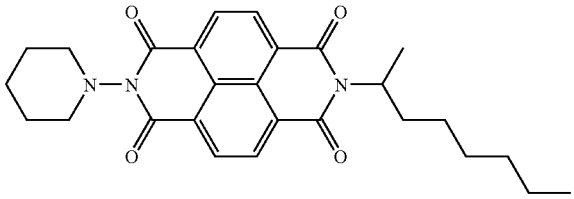 |
| 71 | 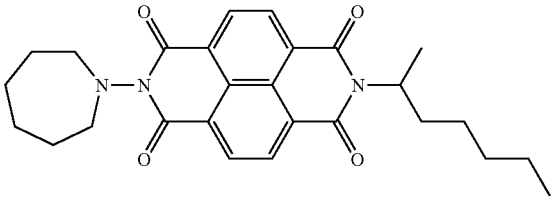 |
| 72 | 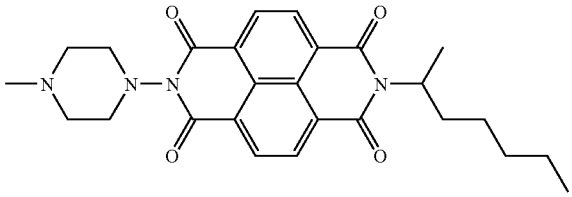 |
| 73 | 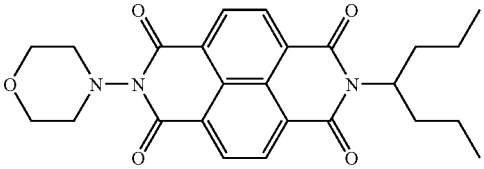 |
| 74 | 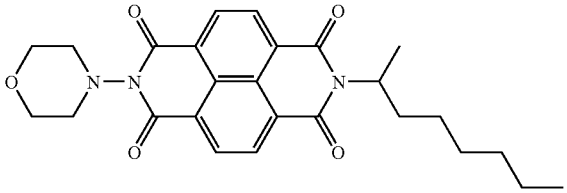 |
| 75 | 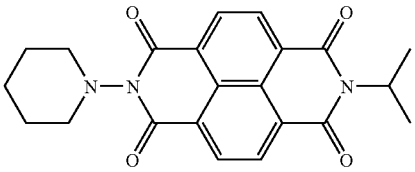 |

-continued
| Illustrated Compound No. | Chemical Structure |
|---|---|
| 76 | 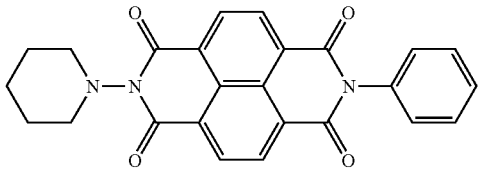 |
| 77 | 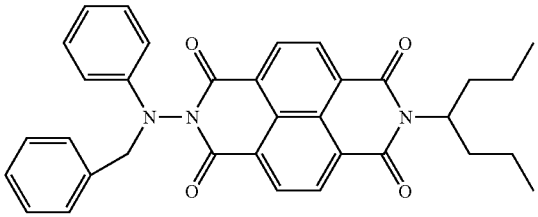 |
| 78 | 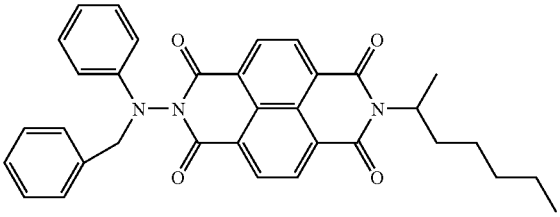 |
| 79 | 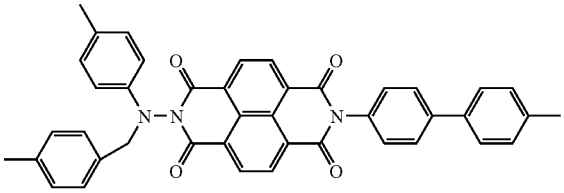 |
| 80 | 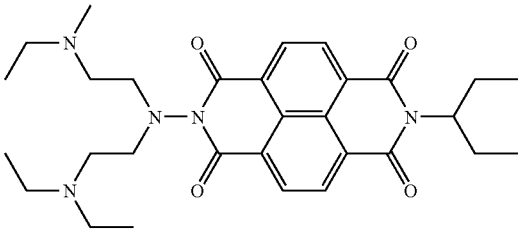 |
| 81 | 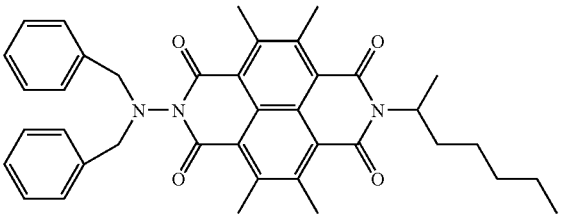 |
| 82 | 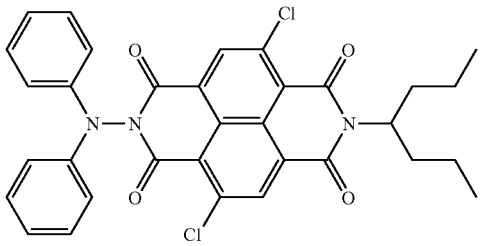 |

-continued

| Illustrated Compound No. | Chemical Structure |
|---|---|
| 83 | 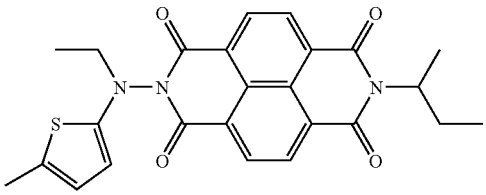 |
| 84 | 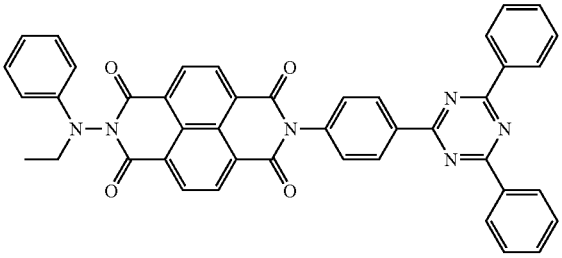 |

Next, the layer structure of the image bearing member (photoreceptor) for use in the present invention is described.

Figure 6:
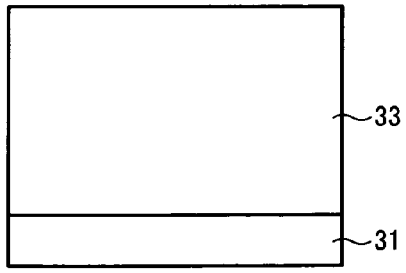
FIG. 6 is a diagram illustrating a cross section of a structure example of an image bearing member for use in the image forming apparatus (full color) of the present invention.

FIG. 6 is a diagram illustrating a cross section of an example structure of the image bearing member installed in the image forming apparatus (full color) of the present invention. The image bearing member (single layer type) has an electroconductive substrate 31 and a photosensitive layer 33 thereon which simultaneously contains a charge transport material and a charge generation material as the main components.

Figure 7:
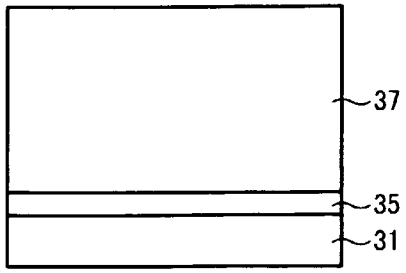
FIG. 7 is a diagram illustrating a cross section of another structure example of an image bearing member for use in the image forming apparatus (full color) of the present invention.

FIG. 7 is a diagram illustrating a cross section of another example structure of the image bearing member installed in the image forming apparatus (full color) of the present invention. The image bearing member (laminate layer type) has an electroconductive substrate 31, a charge generation layer 35 thereon containing a charge generation material as the main component, and a charge transport layer 37 on the charge generation layer 35 containing the charge transport material.

Figure 8:
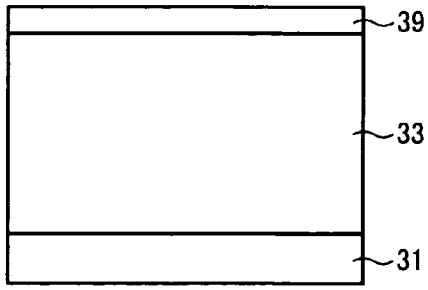
FIG. 8 is a diagram illustrating a cross section of yet another structure example of an image bearing member for use in the image forming apparatus (full color) of the present invention.

FIG. 8 is a diagram illustrating a cross section of yet another example structure of the image bearing member installed in the image forming apparatus (full color) of the present invention. The image bearing member (single layer type) has an electroconductive substrate 31, a photosensitive layer 33 thereon simultaneously containing a charge transport material and a charge generation material as the main components, and a protective layer 39 on the surface of the photosensitive layer 33. The protective layer 39 may contain the naphthalene tetracarbonic acid diimide derivative illustrated above.

Figure 9:
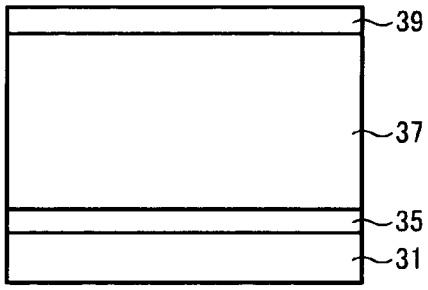
FIG. 9 is a diagram illustrating a cross section of still further structure example of an image bearing member for use in the image forming apparatus (full color) of the present invention.

FIG. 9 is a diagram illustrating a cross section of still another example structure of the image bearing member installed in the image forming apparatus (full color) of the present invention. The image bearing member (laminate layer type) has an electroconductive substrate 31, a charge generation layer 35 thereon containing a charge generation material as the main component, a charge transport layer 37 on the charge generation layer 35 containing the charge transport material, and a protective layer 39 on the charge transport layer 37. The protective layer 39 may contain the naphthalene tetracarbonic acid diimide derivative illustrated above.

Figure 10:
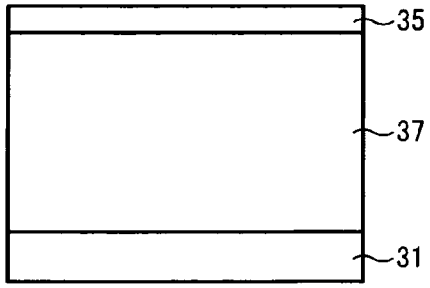
FIG. 10 is a diagram illustrating a cross section of still further structure example of an image bearing member for use in the image forming apparatus (full color) of the present invention.

FIG. 10 is a diagram illustrating a cross section of still another example structure of the image bearing member installed in the image forming apparatus (full color) of the present invention. The image bearing member (laminate layer type) has an electroconductive substrate 31, a charge transport layer 37 thereon containing a charge transport material as the main component, and a charge generation layer 35 on the charge transport layer 37 containing the charge generation material as the main component.

Figure 11:
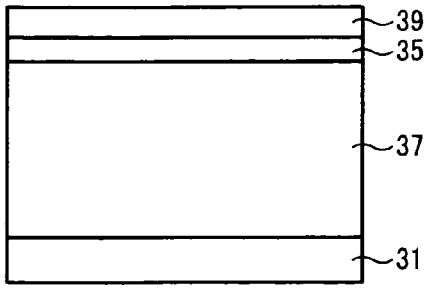
FIG. 11 is a diagram illustrating a cross section of still further structure example of an image bearing member for use in the image forming apparatus (full color) of the present invention.

FIG. 11 is a diagram illustrating a cross section of still another example structure of the image bearing member installed in the image forming apparatus (full color) of the present invention. The image bearing member (laminate layer type) has an electroconductive substrate 31, a charge transport layer 35 thereon containing a charge transport material as the main component, a charge generation layer 35 on the charge transport layer 37 containing the charge generation material as the main component and a protective layer 39 on the charge generation layer 35. The protective layer 39 may contain the naphthalene tetracarbonic acid diimide derivative illustrated above.

Next, the structure elements of the image bearing member for use in the present invention are described.

Materials having a volume resistance of not greater than $10^{10}$ Ω·cm can be used as a material for the electroconductive substrate 31. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and grinding is also usable. In addition, endless nickel belt and endless stainless belt (for example, described in JOP S52-36016) can be used as the electroconductive substrate 31.

The electroconductive substrate 31 for use in the present invention can be formed by applying to the substrate mentioned above a liquid application in which electroconductive powder is dispersed in a suitable binder resin.

Specific examples of such electrconductive powder include, but are not limited to, carbon black, acetylene black, metal powder such as aluminum, nickel, iron, nichrome, copper, zinc and silver, and metal oxide powder such as electroconductive tin oxide, and indium tin oxide (ITO).

Specific examples of the binder resins which are used together with the electroconductive powder include, but are not limited to, thermoplastic resins, thermosetting resins, and optical curing resins such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acryl resin, a silicone resin, an epoxy resin, a melamine resin, a urethane resin, a phenol resin, and an alkyd resin.

Such an electroconductive layer can be formed by dispersing the electroconductive powder and the binder resins mentioned above in a suitable solvent such as tetrahydrofuran (THF), dichloromethane (MDC), methyl ethyl ketone (MEK), and toluene and applying the resultant to the substrate mentioned above.

Also, an electroconductive substrate formed by a heat contraction rubber tube on a suitable cylindrical substrate can be used as the electroconductive substrate 31 for use in the present invention. The heat contraction tube is formed of a material such as polyvinyl chloride, polypropylene, polyester, polystyrene, polyvinylidene chloride, polyethylene, chloride rubber, and fluorine resin (TEFLON®) in which the electroconductive powder mentioned above is contained.

Next, the photosensitive layer 33 is described in detail. The photosensitive layer 33 can have a single layer structure or a laminate layer structure. First, the laminar structure containing the charge generation layer 35 and the charge transport layer 37 is described.

As described above, the charge generation layer 35 is a layer containing a charge generation material as the main component.

Known charge generation material can be used in the charge generation layer 35. Specific examples thereof include, but are not limited to, C.I. Pigment blue 25 (Color Index CI 21180), C.I. Pigment red 41 (Color Index CI 21200), C.I. Acid red 52 (CI 45100), C.I. Basic red 3 (CI 45210), various kinds of azo pigments such as azo pigments having a carbazole skeleton (refer to JOP S53-95033), azo pigments having a distyrilbenzene skeleton (refer to JOP S53-133445), azo pigments having a triphenyl amine skeleton (refer to JOP S53-132347), azo pigments having a dibenzothiophene skeleton (refer to JOP S54-21728), azo pigments having an oxadiazole skeleton (refer to JOP S54-12742), azo pigments having a fluorenone skeleton (refer to JOP S54-22834), azo pigments having a bisstilbene skeleton (refer to JOP S54-17733), azo pigments having an distyril oxadiazole skeleton (refer to JOP S54-2129), azo pigments having a distyril carbazole skeleton (refer to JOP S54-14967), and azo pigments having a benzanthrone skeleton, C.I. Pigment blue 16 (CI 74100), phthalocyanine pigments such as Y type oxotitanium phthalocyanine (refer to JOP S64-17066), A(β) type oxotitanium phthalocyanine, B(α) type oxotitanium phthalocyanine, I type oxotitanium phthalocyanine (refer to JOP H11-21466), II type chlorogallium phthalocyanine (refer to the 67th Spring Annual Meeting of the Chemical Society of Japan, 1B4,04(1994) by Iijima and others), V type hydroxyl gallium phthalocyanine (refer to the 67th Spring Annual Meeting of the Chemical Society of Japan, 1B4,05(1994) by Daimon and others), and X type nonmetal phthalocyanine (refer to U.S. Pat. No. 3,816,118), indigo based pigments such as CI pat brown 5 (CI 73410) and CI pat dye (CI 73030), and perylene based pigments such as Argo scarlet B (manufactured by Bayer A G) and Indanthrene scarlet R (manufactured by Bayer A G). These materials can be used alone or in combination.

The charge generation layer 35 is formed by dispersing a charge generation material and an optional resin in a suitable solvent with a ball mill, an attritor, a sand mill, a bead mill or ultrasonic wave and applying the obtained liquid dispersion to the electroconductive substrate 31 followed by drying.

Specific examples of the optional binder resins for use in the charge generation layer 35 include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, polyacrylamides, polyvinyl benzals, polyesters, phenoxy resins, copolymers of vinyl chloride and vinyl acetate, polyvinyl acetate, polyphenylene oxides, polyamines, polyvinyl pyridines, cellulose based resins, casein, polyvinyl alcohol and polyvinyl pyrrolidone. The content of the binder resin is from 0 to 500 parts by weight or preferably from 10 to 300 parts by weight based on 100 parts by weight of the charge generation material. These binder resins can be added after or before the dispersion.

Specific examples of the solvents mentioned above include, but are not limited to, isopropanol, acetone, methylethyl ketone, cyciohexanone, tetrahydrofuran, dioxane, ethylcellosolve, ethyl acetate, methyl acetate, dichloromethane, dichloroethane, monochlorobenzene, cyclehexane, toluene, xylene, and ligroin. Among these, ketone based solvents, ester based solvents, ether based solvents can be especially suitably used. These can be used alone or in combination.

As described above, the charge generation layer 35 is formed by, for example, an application method using a liquid application containing a charge generation material, a solvent and a binder resin as the main component. The liquid application may contain any additives such as a sensitizer, a dispersion agent, a surface active agent, and a silicone oil. As the application method, a dip coating method, a spray coating method, a bead coating method, a nozzle coating method, a spinner coating method and a ring coating method can be used. The charge generation layer 35 suitably has a thickness of from about 0.01 to about 5 μm and preferably from 0.1 to 2 μm.

The charge transport layer 37 is a layer at least containing the naphthalene tetracarbonic acid diimide derivative represented by the Chemical Structure (1) as a charge transport material. The charge transport material layer 37 can contain at least one charge transport materials different from the naphthalene tetracarbonic acid diimide derivative. The charge transport material 37 is manufactured by applying a liquid application in which the naphthalene tetracarbonic acid diimide derivative represented by the Chemical Structure (1), an optional charge transport material and an optional binder resin are dissolved or dispersed to the charge generation layer 35 followed by drying. The optional charge transport material different from the naphthalene tetracarbonic acid diimide derivative can suitably adjust the charge transport power required for the image bearing member for use in the image forming apparatus (full color) of the present invention. Typical application methods, for example, a dip coating method, a spray coating method, a bead coating method, a nozzle coating method, a spinner coating method or a ring coating method, can be used.

The optional charge transport material different from the naphthalene tetracarbonic acid diimide derivative is described next in terms of positive hole transport materials, electron transport materials and charge transport polymers.

Specific examples of the positive hole transport materials include, but are not limited to, poly-N-carbazole and its derivatives, poly-γ-carbazolyl ethyl glutamate and its derivatives, a condensation product of pyrene-formaldehyde and its derivatives, polyvinyl phenanthrene, oxazole derivatives, imidazole derivatives, triphenyl amine derivatives, and the following compounds represented by the following Chemical Structures (11) to (34) (including Chemical Structures (2), (6), (7) and (10).

Chemical Structure (11)

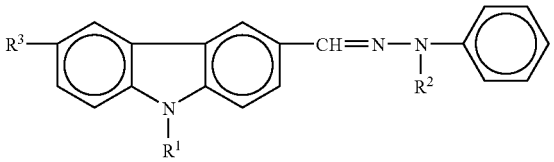

In the Chemical Structure (11), $R^1$ represents methyl group, ethyl group, 2-hydroxyethyl group or 2-chloroethyl group, $R^2$ represents methyl group, ethyl group, benzyl group, or phenyl group, $R^3$ represents hydrogen atom, chlorine atom, bromine atom, an alkyl group having 1 to 4 carbon atoms, an alkoxy group having 1 to 4 carbon atoms, dialkyl amino group or nitro group.

Specific examples of the compounds represented by the Chemical Structure (11) include, but are not limited to, 9-ethylcarbazole-3-carboaldehyde-1-methyl-1-phenyl hydrazone, 9-ethylcarbazole-3-carboaldehyde-1-benzyl-1-phenyl hydrazone, and 9-ethylcarbazole-3-carboaldehyde-1,1-diphenyl hydrazone.

Chemical Structure (12)

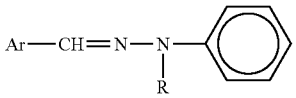

In the Chemical Structure (12), Ar represents naphthalene ring, anthracene ring, pyrrene ring, derivatives thereof, pyridine ring, furan ring, thiophene ring, and R represents an alkyl group, phenyl group or benzyl group.

Specific examples of the compounds represented by the Chemical Structure (12) include, but are not limited to, 4-diethylaminostyryl-β-carboaldehyde-1-methyl-1-phenylhydrazone and 4-methoxynaphtahlene-1-carboaldehyde-1-benzyl-1-phenylhydrazone.

Chemical Structure (13)

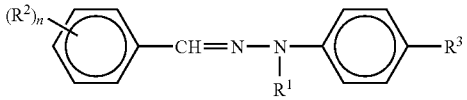

Specific examples of the compounds represented by the Chemical Structure (13) include, but are not limited to, $R^1$ represents an alky group, benzyl group, phenyl group or naphthyl group, $R^2$ represents hydrogen atom, an alky group having 1 to 3 carbon atoms, an alkoxy group having 1 to 3 carbon atoms, dialkyl amino group, dialralkyl group or a diaryl amine group, n represents an integer of from 1 to 4. When n is greater than 1, $R^2$ are independently determined. $R^3$ represents hydrogen atom or methoxy group.

Specific examples of the compounds represented by the Chemical Structure (13) include, but are not limited to, 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

Chemical Structure (14)

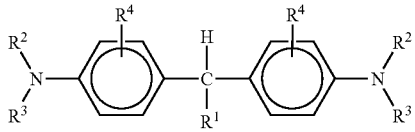

In Chemical Structure (14), $R^1$ represents an alkyl group having 1 to 11 carbon atoms, or a substituted or non-substituted phenyl group or heterocyclic group. $R^2$ and $R^3$ each, independently, represent hydrogen atom, an alkyl group having 1 to 4 carbon atoms, a hydroxyalkyl group, chloroalkyl group, or a substituted or non-substituted aralkyl group. $R^2$ and $R^3$ can share a bond connectivity to form a heterocyclic ring containing the nitrogen atom. Each of $R^4$ independently represents hydrogen atom, an alkyl group having 1 to 4 carbon atoms, an alkoxy group or a halogen atom.

Specific examples of the compounds represented by the Chemical

Structure (14) include, but are not limited to, 1,1-bis(4-benzylaminophenyl)propane, tris(4-diethylaminophenyl) methane, and 2,2'-dimethyl-4,4'-bis(diethylamino)-triphenyl methane.

Chemical Structure (15)

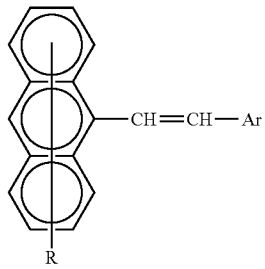

In the Chemical Structure (15), R represents hydrogen atom or a halogen atom and Ar represents a substituted or non-substituted phenyl group, naphthyl group, anthryl group, or carbazolyl group.

Specific examples of the compounds represented by the Chemical Structure (15) include; but are not limited to, 9-(4-diethylaminostyryl) anthracene, and 9-brom-10-(4-diethylaminostyryl)anthracene.

Chemical Structure (16)

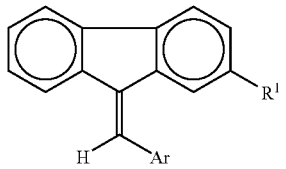

In the Chemical Structure (16), $R^1$ represents hydrogen atom, a halogen atom, cyano group, an alkoxy group having 1 to 4 carbon atoms, or an alkyl group having 1 to 4 carbon atoms. Ar represents compounds represented by the following Chemical Structure (17) or (18):

Chemical Structure (17)

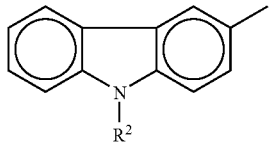

Chemical Structure (18)

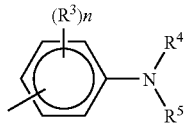

In the Chemical Structures (17) and (18), $R^2$ represents an alkyl group having 1 to 4 carbon atoms, $R^3$ represents hydrogen atom, a halogen atom, an alkyl group having 1 to 4 carbon atoms, an alkoxy group having 1 to 4 carbon atoms or dialkyl amino group. n represents 1 or 2. When n is 2, each of $R^3$ can be independently determined. $R^4$ and $R^5$ each, independently, represent hydrogen atom, a substituted or non-substituted alkyl group or a substituted or non-substituted benzyl group Specific example of the compounds represented by the Chemical Structure (16) include, but are not limited to, 9-(4-dimethylaminobenzylidene)fluorene, and 3-(9-fluorenylidene)-9-ethylcarbazole.

Chemical Structure (19)

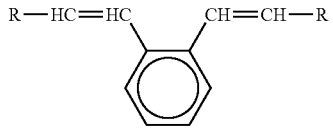

In the Chemical Structure (19), R represents carbazolyl group, pyridyl group, thienyl group, indoryl group, fryl group, a substituted or non-substituted phenyl group, a substituted or non-substituted styryl group, a substituted or non-substituted naphtyl group, or a substituted or non-substituted anthyl group. The substituted groups therefor are selected from the group consisting of a dialkyl amine group, an alkyl group, an alkoxy group, a carboxy group, their esters, a halogen atom, cyano group, an aralkyl amino group, N-alkyl-N-aralkyl amino group, amino group, nitro group and acetyl amino group.

Specific examples of the compounds represented by the Chemical Structure (19) include, but are not limited to, 1,2-bis (4-diethylamino styryl)benzene, and 1,2-bis(2,4-dimethoxy styryl)benzene.

Chemical Structure (20)

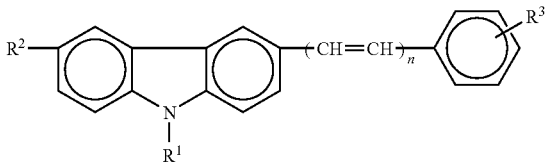

In the Chemical Structure (20), $R^1$ represents a lower alkyl group, a substituted or non-substituted group phenyl group, or benzyl group, $R^2$ and $R^3$ each, independently, hydrogen atom, a lower alkyl group, a lower alkoxy group, a halogen atom, nitro group, amino group or an amino group substituted by a lower alkyl group or benzyl group. n represents 1 or 2.

Specific examples of the compounds represented by the Chemical Structure (20) include, but are not limited to, 3-styryl-9-ethylcarbazole, and 3-(4-methoxystyryl)-9-ethylcarbazole.

Chemical Structure (21)

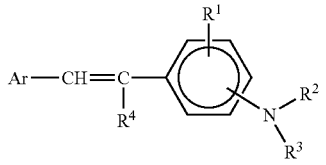

In the Chemical Structure (21), $R^1$ represents hydrogen atom, an alkyl group, an alkoxy group or a halogen atom, $R^2$ and $R^3$ independently represent a substituted or no-substituted aryl group. $R^4$ represents hydrogen atom, a lower alkyl group, or a substituted or non-substituted phenyl group and Ar represents or a substituted or non-substituted phenyl group or naphtyl group.

Specific examples of the compounds represented by the Chemical Structure (21) include, but are not limited to, 4-diphenyl aminostilbene, 4-dibenzyl aminostilbene, 4-ditolylaminostilben, 1-(4-diphenyl aminostyryl)naphthalene, and 1-(4-diphenyl aminostilbene)naphthalene.

Chemical Structure (2)

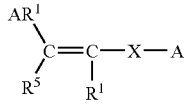

In the Chemical Structure (2), X represents a single bond or vinylene group, $R^1$ represents hydrogen atom, a substituted or non-substituted alkyl group or a substituted or non-substituted aromatic hydrocarbon group, Ar represents a substituted or non-substituted aromatic hydrocarbon group, $R^5$ represents hydrocarbon atom, a substituted or non-substituted alkyl group or a substituted or non-substituted aromatic hydrocarbon group, $Ar^1$ and $R^5$ optionally share a bond connectivity to form a ring, A represents 9-anthryl group, a substituted or non-substituted carbazolyl group, or a group represented by the following Chemical Structure (3) or (4), Chemical Structure (3)

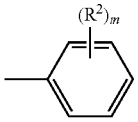

Chemical Structure (4)

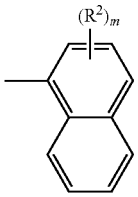

In the Chemical Structures (3) and (4), $R^2$ represents hydrogen atom, an alkyl group, an alkoxy group, or a group represented by the following Chemical Structure (5), Chemical Structure (5)

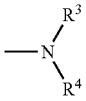

In the Chemical Structure (5), $R^3$ and $R^4$ each, independently, represent a substituted or non-substituted alkyl group or a substituted or non-substituted aromatic hydrocarbon group and optionally share a bond connectivity to form a heterocyclic group including a nitrogen atom, m represents an integer of from 1 to 3 and when m is 2 or 3, each of $R^2$ can be independently different.

Specific examples of the compounds represented by Chemical Structure (2) include, but are not limited to, the charge transport material No. 1, which is represented by the Chemical Structure (I) illustrated in Examples described later, and the compound represented by the following Chemical Structure (22):

Chemical Structure (22)

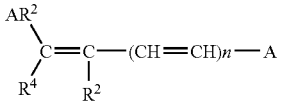

In the Chemical Structure (22), n is 0 or 1, $R^2$ is hydrogen atom, an alkyl group, or a substituted or non-substituted phenyl group, $Ar^2$ represents a substituted or non-substituted aryl group, $R^4$ represents an alkyl group including a substituted or non-substituted alkyl group or a substituted or non-substituted aryl group, A represents 9-anthryl group or a substituted or non-substituted carbazolyl group, or groups represented by the following Chemical Structure (23) or (24).

Chemical Structure (23)

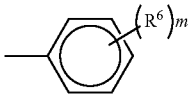

-continued

Chemical Structure (24)

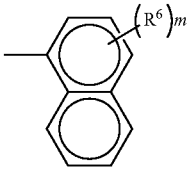

In the Chemical Structures (23) and (24), $R^6$ represents hydrogen atom, an alkyl group, an alkoxy group, a halogen atom or a group represented by the following Chemical Structure (25).

Chemical Structure (25)

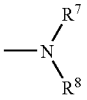

In the Chemical Structure (25), $R^7$ and $R^8$ independently represents a substituted or non-substituted aryl group and can share a bond connectivity to form a heterocyclic group including a nitrogen atom. m represents an integer of from 1 to 3 and when m is 2 or 3, each of $R^2$ can be independently determined. In addition, when n is 0, A and $R^2$ can share a bond connectivity to form a ring.

Specific examples of the compounds represented by the Chemical Structure (22) include, but are not limited to, 4-diphenylamino-α-phenylstilbene, and 4-bis(4-methylphenyl)amino-α-phenylstilbene.

Chemical Structure (26)

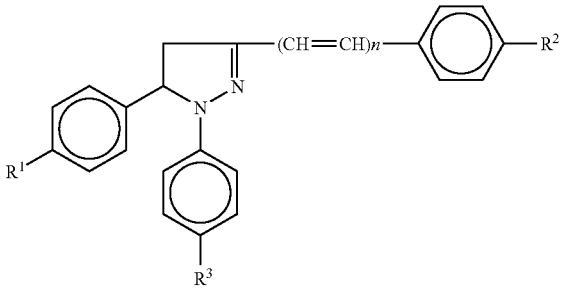

In the Chemical Structure (26), $R^1$, $R^2$ and $R^3$ each, independently, represent hydrogen atom, a lower alkyl group, a lower alkoxy group, a halogen atom or a dialkyl amino group. n represents 0 or 1.

A specific example of the compounds represented by the Chemical Structure (26) includes, but are not limited to, 1-phenyl-3-(4-diethylaminostyryl)-5-(4-diethylaminophenyl)pyrazoline.

Chemical Structure (27)

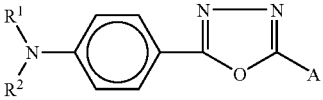

In the Chemical Structure (27), $R^1$ and $R^2$ each, independently, represent a substituted or non-substituted alkyl group, or a substituted or non-substituted aryl group and A represents a substituted amino group or a substituted or non-substituted aryl group or allyl group.

Specific examples of the compounds represented by the Chemical Structure (27) include, but are not limited to, 2,5-bis(4-diethyl aminophenyl)-1,3,4-oxadiazole, 2-N,N-diphenylamino-5-(4-diethyl aminophenyl)-1,3,4-oxadiazole and 2-(4-dimethyl aminophenyl)-5-(4-diethyl aminophenyl)-1,3,4-oxadiazole.

Chemical Structure (28)

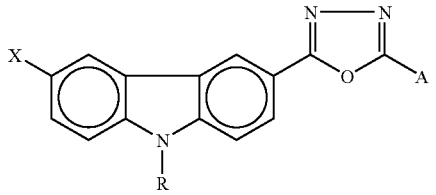

In the Chemical Structure (28), X represents a hydrogen atom, a lower alkyl group or a halogen atom, R represents a substituted or non-substituted alkyl group, or a substituted or non-substituted aryl group and A represents a substituted amino group or a substituted or non-substituted aryl group.

Specific examples of the compounds represented by the Chemical Structure (28) include, but are not limited to, 2-N,N-diphenylamino-5-(N-ethylcarbazole-3-yl)-1,3,4-oxadiazole, 2-(4-diethylaminophenyl)-5-(N-ethylcarbazole-3-yl)-1,3,4-oxadiazole.

Chemical Structure (29)

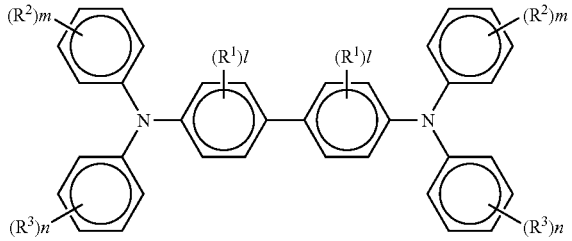

In the Chemical Structure (29), $R^1$ represents a lower alkyl group, a lower alkoxy group or a halogen atom, $R^2$ and $R^3$ each, independently, represent hydrogen atom, a lower alkyl group, a lower alkoxy group or a halogen atom and l, m, and n represent 0 or an integer of from 1 to 4.

Specific examples of the compounds represented by the Chemical Structure (29) include, but are not limited to, N,N'-diphenyl-N,N'-bis(3-methyl phenyl)-[1,1'-biphenyl]-4,4'-diamine, and 3,3'-dimethyl-N,N,N',N'-tetrakis(4-methyl phenyl)-[1,1'-biphenyl]-4,4'-diamine.

Chemical Structure (6)

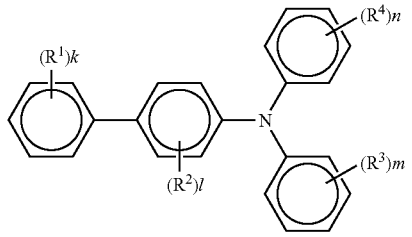

In the Chemical Structure (6), $R^1$, $R^3$ and $R^4$ each, independently, represent hydrogen atom, amino group, an alkoxy group, a thioalkoxy group an aryloxy group, methylene dioxy group, a substituted or non-substituted alkyl group, a halogen atom, or a substituted or non-substituted aromatic hydrocarbon group, $R^2$ represents hydroghen atom, an alkoxy group, a substituted or non-substituted alkyl group or a halogen atom, and k, l, m and n independently represent an integer of from 1 to 4. When each of k, l, m and n is 2, 3, or 4, each of respective $R^1$, $R^2$, $R^3$ and $R^4$ is independently determined.

Specific examples of the compounds represented by the Chemical Structure (6) include, but are not limited to, the charge transport material No. 4, which is represented by the Chemical Structure (IV) illustrated in Examples described later and the compound represented by the following Chemical Structure (30):

Chemical Structure (30)

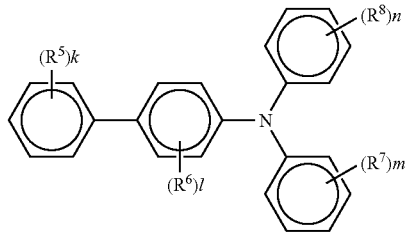

In the Chemical Structure (30), $R^5$, $R^7$ and $R^8$ independently represent hydrogen atom, amino group, an alkoxy group, a thioalkoxy group, an aryloxy group, methylene dioxy group, a substituted or non-substituted alkyl group, a halogen atom, or a substituted or non-substituted aryl group, and $R^6$ represents hydrogen atom, an alkoxy group, a substituted or non-substituted alkyl group, or a halogen atom. However, $R^5$, $R^6$, $R^7$ and $R^8$ are not simultaneously a hydrogen atom. k, l, m and n are an integer of from 1 to 4. When k, l, m, n are 2, 3 or 4, each of respective $R^5$, $R^6$, $R^7$ and $R^8$ are independently determined.

Specific examples of the biphenyl amine compounds represented by the Chemical Structure (30) include, but are not limited to, 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methyhlphenyl)-[1,1'-biphenyl]-4-amine and N,N-bis(3,4-dimethylphenyl)-[1,1'-biphenyl]-4-amine.

Chemical Structure (31)

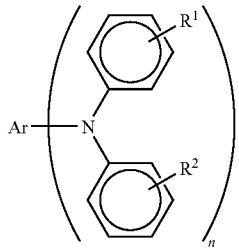

In the Chemical Structure (31), Ar represents a substituted or non-substituted condensed polycyclic hydrocarbon group having 18 carbon atoms at maximum. $R^1$ and $R^2$ each, independently, represent hydrogen atom, a substituted or non-substituted alkyl group, an alkoxy group, or a substituted or non-substituted phenyl group and n represents 1 or 2.

Specific examples of the triaryl amine compounds represented by the Chemical Structure (31) include, but are not limited to, N,N-diphenyl-pyrene-1-amine, N,N-di-p-tolyl-pyrene-1-amine, N,N-di-p-tolyl-1-naphtyl amine, N,N-di(p-tolyl)-1-phenanetolyl amine, 9,9-dimethyl-2-(di-p-tolylamino)fluorine, N,N,N',N'-tetrakis(4-methylphenyl)-phenanthrene-9,10-diamine, and N,N,N',N'-tetrakis(3-methylphenyl)-m-phenylene diamine.

Chemical Structure (10)

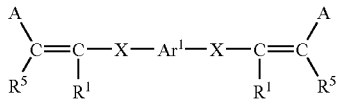

In the Chemical Structure (10), X represents a single bond or vinylene group, $R^1$ represents hydrogen atom, a substituted or non-substituted alkyl group or a substituted or non-substituted aromatic hydrocarbon group, $Ar^1$ represents a substituted or non-substituted divalent aromatic hydrocarbon group, $R^5$ represents hydrogen atom, a substituted or non-substituted alkyl group or a substituted or non-substituted aromatic hydrocarbon group, A represents 9-anthryl group, a substituted or non-substituted carbazolyl group, or a group represented by the following Chemical Structure (3) or (4), Chemical Structure (3)

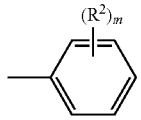

Chemical Structure (4)

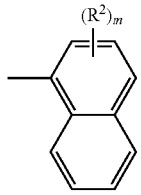

In the Chemical Structures. (3) and (4), $R^2$ represents hydrogen atom, an alkyl group, an alkoxy group, or a group represented by the following Chemical Structure (5), Chemical Structure (5)

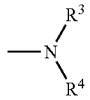

In the Chemical Structure (5), $R^3$ and $R^4$ each, independently, represent a substituted or non-substituted alkyl group or a substituted or non-substituted aromatic hydrocarbon group and optionally share a bond connectivity to form a heterocyclic group including a nitrogen atom, m represents an integer of from 1 to 3 and when m is 2 or 3, each of $R^2$ can be independently determined.

Specific examples of the compounds represented by the Chemical Structure (10) include, but are not limited to, the charge transport material No. 2, which is represented by the Chemical Structure (II) illustrated in Examples described later and the compound represented by the following Chemical Structure (32):

A-CH═CH—Ar—CH═CH-A Chemical Structure (32)

In the Chemical Structure (32), Ar represents a substituted or non-substituted aromatic hydrocarbon group, A represents the group represented by the following Chemical Structure (33):

Chemical Structure (33)

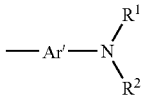

In the Chemical Structure (33), Ar represents a substituted or non-substituted aromatic hydrocarbon group, $R^1$ and $R^2$ independently represents a substituted or non-substituted alkyl group, or a substituted or non-substituted aryl group.

Specific examples of the diolefin compounds represented by Chemical Structure (32) include, but are not limited to, 1,4-bis(4-diphenyl aminostyryl)benzene, and 1,4-bis[4-di(p-tolyl)aminostyryl]benzene.

Chemical Structure (34)

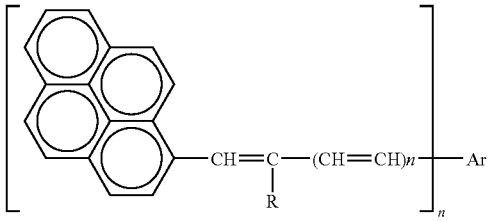

In the Chemical Structure (34), Ar represents a substituted or non-substituted aromatic hydrocarbon group, R represents hydrogen atom, a substituted or non-substituted alkyl group, or a substituted or non-substituted aryl group, n represents 0 or 1, and m represents 1 or 2. When n is 0 and m is 1, Ar and R can share a bond connectivity to form a ring.

Specific examples of the styryl pyrene compounds represented by the Chemical Structure (34) include, but are not limited to, 1-(4-diphenylamino styryl)pyrene, and 1-(N,N-di-p-tolyl-4-aminostyryl)pyrene.

Chemical Structure (7)

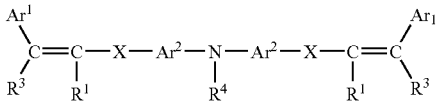

In the Chemical Structure (7), X represents a single bond or vinylene group, $R^1$ represents hydrogen atom, a substituted or non-substituted alkyl group or a substituted or non-substituted aromatic hydrocarbon group, $Ar^1$ represents a substituted or non-substituted aromatic hydrocarbon group, $R^3$ represents hydrocarbon atom, a substituted or non-substituted alkyl group or a substituted or non-substituted aromatic hydrocarbon group, and $Ar^1$ and $R^3$ optionally share a bond connectivity to form a ring. $Ar^2$ represent a group represented by the following Chemical Structure (8) or (9):

Chemical Structure (8)

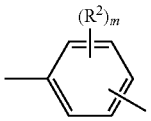

Chemical Structure (9)

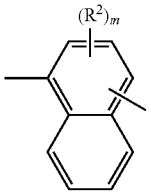

In the Chemical Structures (8) and (9), $R^2$ represents hydrogen atom, an alkyl group, an alkoxy group or a halogen atom, and m represents an integer of from 1 to 3. When m is 2 or 3, each of $R^2$ can be independently determined. $R^4$ represents a substituted or non-substituted alkyl group or a substituted or non-substituted aromatic hydrocarbon group.

Specific examples of the compounds represented by the Chemical Structure (7) include, but are not limited to, the charge transport material No. 3, which is represented by the Chemical Structure (III) illustrated in Examples described later.

Specific examples of the electron transport material includes, but are not limited to, chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno4H-indeno[1,2-b]thiophene-4-one, and 1,3,7-trinitro dibenzothhiophene-5,5-dioxide.

Specific examples of the binder resins for use in forming the charge transport layer 37 described above include, but are not limited to, thermoplastic resins or thermocuring resins, for example, polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetate resins, polyvinylidene chloride resins, polyarylate resins, phenoxy resins, polycarbonate reins, cellulose acetate resins, ethyl cellulose resins, polyvinyl butyral resins, polyvinyl formal resins, polyvinyl toluene resins, poly-N-vinylcarbozole resins, acrylic resin, silicone resins, epoxy resins, melamine resins, urethane resins, phenol resins, and alkyd resins.

When a mixture of the naphthalene tetracarbonic acid diimide derivative represented by the Chemical Structure (1) and another charge transport material is contained in the charge transport layer 37, the total content of the charge transport material is from 20 to 300 parts by weight and preferably from 40 to 150 parts by weight based on 100 parts by weight of a binder resin. In the case of an image forming apparatus having multiple image formation elements as in an example of the present invention, the variance of the electrostatic characteristics and the abrasion amount of the image bearing member for use in each image formation element after repetitive use are small due to the existence of the naphthalene tetracarbonic acid diimide derivative contained in the image bearing member. Therefore, when images obtained at each image formation element are overlapped atop to form a full color image, the quality of the full color image little varies and is stable. However, to improve the durability of the image bearing member by reducing the abrasion amount after furthermore repetitive use, it is preferable that the total content of the binder resin contained in the charge transport layer 37 is greater than the total weight of the charge transport material including the naphthalene tetracarbonic acid diimide derivative represented by the Chemical Structure (1). That is, the total weight of the charge transport material including the naphthalene tetracarbonic acid diimide derivative represented by the Chemical Structure (1) is from 20 to less than 100 parts by weight and preferably from 40 to less than 100 parts by weight based on 100 parts by weight of the binder resin.

In addition, the layer thickness of the charge transport layer 37 is preferably not greater than 25 μm in terms of the definition and responsiveness thereof.

Although depending on the system (especially in relation to charging voltage, etc.), the lower limit of the layer thickness is preferably from 5 μm or less.

In addition, the content of the naphthalene tetracarbonic acid diimide derivative represented by the Chemical Structure (1) is preferably from 0.01 to 150% by weight based on the other charge transport materials. A content that is excessively small tends to reduce the durability against oxidized gas. When the content is too large, the residual voltage tends to increase the rise in the residual voltage.

As described above, the charge transport layer 37 can be formed by using a liquid application in which the naphthalene tetracarbonic acid diimide derivative represented by the Chemical Structure (1) and another optional charge transport material with an optional binder resin are dissolved or dispersed in a suitable solvent. In addition, a plasticizer, a leveling agent, an antioxidant, etc. can be added to the liquid application. These can be used alone or in combination.

Specific examples of the solvent include, but are not limited to, tetrahydrofuran, dioxane, toluene, dichloromethane, monochlorobenzene, dichloroethane, cyclohexanone, methylethylketone and acetone. The charge transport material can be used alone or in combination with other charge transport materials.

Typically known antioxidants can be used as the antioxidant for use in the present invention. Hydroquinone or hindered amine based compounds are especially effective. The antioxidant is to prevent alteration of the naphthalene tetracarbonic acid diimide derivative for use in the present invention.

Thus, the antioxidant is preferably contained in the liquid application in the process prior to the process in which the naphthalene tetracarbonic acid diimide derivative for use in the present invention is contained. To sufficiently demonstrate the effect of the antioxidant, the addition amount thereof is from 0.1 to 200% by weight based on weight of the naphthalene tetracarbonic acid diimide derivative.

A charge transport polymer having functions of a charge transport material and a binder resin can be suitably used as the charge transport material for use in the charge transport layer 37. The charge transport layer formed of such a charge transport polymer has an excellent durability against abrasion. Any known charge transport polymers can be used.

Next, the photosensitive layer 33 having a single layer structure is described.

The photosensitive layer can be formed by applying a liquid application in which a charge generation material, the naphthalene tetracarbonic acid diimide derivative represented by the Chemical Structure (1), an optional charge transport material and an optional binder resin are dissolved or dispersed in a suitable solvent to the electroconductive substrate 31 followed by drying. A plasticizer, a leveling agent, an antioxidant, etc. can be optionally added to the liquid application.

As the binder resins, the binder resins specified for the charge generation layer 35 can be mixed in addition to the binder resins specified for the charge transport layer 37. The charge transport polymers specified above can be also used. The content of the charge generation material is preferably from 5 to 40 parts by weight based on 100 parts of the binder resin. When a mixture of the naphthalene tetracarbonic acid diimide derivative represented by the Chemical Structure (1) and an optional charge transport material is contained in the charge transport (photosensitive) layer, the content of the optional charge transport material is preferably from 0 to 190 parts by weight and more preferably from 50 to 150 parts by weight based on 100 parts of the binder resin. The total content of the naphthalene tetracarbonic acid diimide derivative and the optional charge transport material is from 20 to 300 parts by weight and preferably from 40 to 150 parts by weight. In the case of an image forming apparatus having multiple image formation elements as in an example of the present invention, the variance of the electrostatic characteristics and the abrasion amount of the image bearing member for use in each image formation element after repetitive use are small due to the existence of the naphthalene tetracarbonic acid diimide derivative contained in the image bearing member. Therefore, when images obtained at each image formation element are overlapped atop to form a full color image, the quality of the full color mage little varies and is stable. However, to improve the durability by reducing the abrasion amount after furthermore repetitive use, it is preferable that the total content of the binder resin contained in the charge transport layer 37 is greater than the total weight of the charge transport material including the naphthalene tetracarbonic acid diimide derivative represented by the Chemical Structure (1). That is, the total weight of the charge transport material including the naphthalene tetracarbonic acid diimide derivative represented by the Chemical Structure (1) is from 20 to less than 100 parts by weight and preferably from 40 to less than 100 parts by weight based on 100 parts by weight of the binder resin. The photosensitive layer is formed by a dip coating method, a spray coating method, a beat coating method, a ring coating method, etc. using a liquid application in which a charge generation material, the naphthalene tetracarbonic acid diimide derivative mentioned above, an optional charge transport material and an optional binder resin are dissolved or dispersed by a dispersion device, etc. The photosensitive layer 33 preferably has a layer thickness of from about 5 to about 25 μm.

As to the image bearing member of the present invention, an undercoating layer can be provided between the electroconductive substrate 31 and the photosensitive layer. In general, such an undercoating layer is mainly formed of a resin. Considering the case in which a photosensitive layer is formed on the undercoating layer (i.e., resin) by using a solvent, the resin is preferably hardly soluble in a typically used organic solvent.

Specific examples of such resins include, but are not limited to, water soluble resins, for example, polyvinyl alcohol, casein, and sodium polyacrylate, alcohol soluble resins, for example, copolymerized nylon and methoxymethylized nylon and curing resins which form a three-dimensional mesh structure, for example, polyurethane, melamine resins, phenol resins, alkyd-melamine resins and epoxy resins. In addition, fine powder pigments of metal oxides exemplified by titanium oxide, silica, alumina, zirconium oxide, tin oxide and indium oxide can be added to the undercoating layer to prevent the occurrence of moire, reduce the residual voltage, etc.

The undercoating layer can be formed by using the same solvents and the same coating methods as those specified for the photosensitive layer. Furthermore, silane coupling agents, titanium coupling agents and chromium coupling agents can be used in the undercoating layer for use in the present invention. In addition, $Al_2O_3$ formed by anodic oxidization can be suitably used as the undercoating layer. In addition, organic compounds, for example, polyparaxylylene (parylene) or inorganic materials, for example, $SiO_2$, $SnO_2$, $TiO_2$, ITO and $CeO_2$ can be applied by a vacuum thin layer manufacturing method. Furthermore, any known suitable compounds can be used to form a suitable undercoating layer. The thickness of the undercoating layer is suitably from 0 to 5 μm.

The protective layer 39 formed of a resin can be provided on the photosensitive layer to protect the photosensitive layer 33, 35 or 37 of the image bearing member for use in the present invention. A filler material can be optionally added to the protective layer 39 to improve the anti-abrasion property thereof. Specific examples of the resins for use in the protective layer 39 include, but are not limited to, ABS resins, ACS resins, olefin-vinyl monomer copolymers, chlorinated polyether, aryl resins, phenolic resins, polyacetal, polyamide, polyamideimide, polyallylsulfone, polybutylene, polybutylene terephthalate, polycarbonate, polyethersulfone, polyethylene, polyethylene terephthalate, polyimide, acrylic resins, polymethylpentene, polypropylene, polyphenyleneoxide, polysulfone, polystyrene, polyraylate, AS resins, butadiene-styrene copolymers, polyurethane, polyvinyl chloride, polyvinylidene chloride, epoxy resins, etc. Among these resins, polycarbonate and polyarylate are preferably used in terms of the dispersability of a filler, residual voltage, and applied film deficiency.

All the solvents for use in forming the charge transport layer 37, i.e., tetrahydrofuran, dioxane, toluene, dichloromethane, monochlorobenzene, dichloroethane, cyclohexanone, methylethylketone and acetone, can be used as the solvent used to prepare a liquid application for forming the protective layer 39. A solvent having a high viscosity is preferred to disperse a filler material, but a solvent having a high volatility is preferred when applied. When there is not such a solvent satisfying both conditions, solvents having respective properties can be used in combination, which may have a great effect on the dispersability of a filler and the residual voltage.

Typical methods such as a dip coating method, a spray coating method, a beat coating method, a nozzle coating method, a spinner coating method and a ring coating method can be used to form the protective layer 39. Among these, the spray coating method is preferred in terms of the uniformity of a formed layer.

In addition, the protective layer 39 may contain the naphthalene tetracarbonic acid diimide derivative represented by the Chemical Structure (1) for use in the present invention and/or an amine compound. Furthermore, adding the charge transport materials having a low molecular weight or the charge transport polymers (i.e., the positive hole transport materials and the electron transport materials) specified for the charge transport layer 37 to the protective layer 39 is preferable in terms of reducing the residual voltage and improving the quality of images.

The image bearing member of the present invention may have an intermediate layer between the photosensitive layer 33,35 or 37 and the protective layer 39. Such an intermediate layer contains a binder resin as the main component. Specific examples of the binder resin include, but are not limited to, polyamides, alcohol soluble nylon, water soluble nylon, water soluble polyvinylbutyral, polyvinylbutyral and polyvinyl alcohol. The typical application methods specified above can be used to form the intermediate layer. The intermediate layer has a layer thickness of from about 0.05 to about 2 μm.

In the present invention, to improve the environmental durability, especially to prevent deterioration of the sensitivity and the rise in the residual voltage, known anti-oxidization agents, plasticizers, lubricants, ultraviolet absorbents and leveling agents can be added to each layer of the charge generation layer 35, the charge transport layer 37, the undercoating layer, the protective layer 39, and the intermediate layer Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following Examples 1 to 66, the naphthalene tetracarbonic acid diimide derivative represented by the Chemical structure (A) is used in formation of the charge transport layer or the photosensitive layer. The naphthalene tetracarbonic acid diimide derivative represented by the Chemical structure (A) is synthesized. As Manufacturing Example, manufacturing of the illustrated compound No. 20 (illustrated derivative No. 20) is described. In addition, manufacturing of the illustrated compounds No. 1, 10 and 15 (illustrated derivative No. 1, 10, 15), which are manufactured in the same manner, is also described below.

Manufacturing Example 1

Illustrated Derivative No. 20

2.68 g (10.0 mmol) of naphthalene-1,4,5,8-tetracarbonic dianhydride (manufactured by Tokyo Chemical Industry Co., Ltd.) and 3.68 g (20.0 mmol) of 1,1-diphenylhydradine (manufactured by Tokyo Chemical Industry Co., Ltd.) are added to 30 ml of N,N'-dimethylformamide and stirred at 60° C. in argon atmosphere for 2 hours. 100 ml of water is added to precipitate a crystal and the precipitated crystal is filtered followed by drying by a reduced pressure heating drier to obtain 3.43 g (yield: 57.1%) of brown coarse crystal. The resultant is subject to silica gel column treatment (eluting solvent: mixture solvent of toluene and ethyl acetate with a ratio of 20 to 1 in volume) followed by re-crystallization by toluene and drying by the reduced pressure heating drier. 7.02 g (yield: 29.7%) of the diimide derivative (illustrated derivative No. 20: orange and red crystal) represented by the following Chemical Structure (a) is obtained.

Chemical Structure (a)

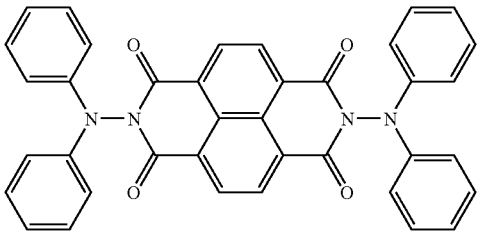

The element analysis of the obtained diimide derivative (illustrated derivative No. 20) is shown in Table 1 below. The heat, generation peak point (decomposition point: decomposition temperature) of DTA (differential thermal analysis) at the glass transition temperature (TG) at the temperature raising speed of 10° C. per minute from room temperature in nitrogen atmosphere is 341° C. when measured by a thermo gravimetry differential thermal analyzer (TG/DTA 6200, manufactured by Seiko Instruments Inc.).

TABLE 1

| | Element | | |
|---|---|---|---|
| | C | H | N |
| Actual value | 76.05 | 4.02 | 9.20 |
| Calculation value | 75.99 | 4.03 | 9.33 |

Manufacturing Examples 2 to 4 (Manufacturing of Illustrated Compounds No. 1, 10 and 15)

The naphthalene tetracarbonic acid diimide derivative of the illustrated compounds Nos. 1, 10 and 15 are manufactured in the same manner as in Manufacturing Example 1. The yield, the decomposition temperature, and the element analysis are shown in Table 2 below.

TABLE 2

| Manufacturing Example | Illustrated derivative | Yield | Decomposition point | Element analysis | | |
|---|---|---|---|---|---|---|
| No. | No. | (%) | (° C.) | C | H | N |
| 2 | 1 | 37.4 | 328 | 61.28 (61.36) | 4.52 (4.58) | 15.84 (15.90) |
| 3 | 10 | 61.3 | 352 | 76.90 (76.81) | 4.90 (4.91) | 8.78 (8.53) |
| 4 | 15 | 56.5 | 380 | 70.68 (70.58) | 4.10 (4.23) | 11.98 (11.76) |

Example 1

The liquid application for an undercoating layer, the liquid application for a charge generation layer and the liquid application for a charge transport layer, each having the following recipe, are sequentially applied to an aluminum drum having a diameter of 30 mm and a length of 340 mm by a dip coating method. Subsequent to drying, an image bearing member No. 1 is obtained which has an undercoating layer of 4.5 μm, a charge generation layer of 0.2 μm and a charge transport layer of 28 μm.

Recipe for Liquid Application for Undercoating Layer

| | |
|---|---|
| Powder of titanium dioxide (Tipaque CR-EL, manufactured by Ishihara Sangyo Kaisha Ltd.) | 400 parts |
| Melamine resin (Super Beckamine G821-60, manufactured by DIC Corporation) | 65 parts |
| Alkyd resin (Beckolite M6401-50, manufactured by DIC Corporation) | 120 parts |
| 2-butanone | 400 parts |

Recipe for Liquid Application for Charge Generation Layer

| | |
|---|---|
| X type non-metal phthalocyanine (FastogenBlue8120B, manufactured by DIC Corporation) | 10 parts |
| Polyvinylbutyral (XYHL, manufactured by Union Carbide Corporation) | 5 parts |
| 2-butanone | 200 parts |
| Cyclohexanone | 400 parts |

Recipe for Liquid Application for Charge Transport Layer

| | |
|---|---|
| Polycarbonate resin (Panlite TS-2050, manufactured by Teijin Chemicals Ltd.). | 12 parts |
| Naphthalene tetracarbonic acid diimide derivative (illustrated compound No. 4) | 12 parts |
| Tetrahydrofuran | 100 parts |
| Silicone oil (KF50-100CS, manufactured by Shin-Etsu Chemical Co., Ltd.) | 0.02 parts |

The thus manufactured image bearing member is arranged for installation and thereafter installed in a process cartridge for electrophotography. A running test is continuously performed repetitively up to corresponding to the total print number of 80,000 using a machine remodeled based on IPSiO CX8200 (manufactured by Ricoh Co., Ltd.) in which the charging system for the installed process cartridge is changed to the positive charging system with a voltage at dark portions of 750 (V). During the test, the voltage at light portions (voltage at irradiated portions when a black solid image is written all over a sheet) at the initial stage and after the repetitive tests is measured. In addition, with regard to the dot definitions of the image at the initial stage and after the repetitive tests, 10 dot images having an image density of 5% with a dot density of 600 dpi×600 dpi are continuously printed. The dot forms are observed with a stereoscopic microscope and the sharpness of the contour of the dots are evaluated according to the following dot image evaluation criteria (5 to 1 corresponding to excellent to bad). The results are shown in Table 3 below.

Dot Image Evaluation Criteria

5: Excellent (clear contour)

4: Good (extremely slight blur of the contour is observed)

3: Fair (blur of the contour is slightly observed)

2: Poor (blur of the contour is observed, which can make a problem depending on the kind of images.)

1: Bad (unable to distinguish dots from dots or dot images are not formed.)

Examples 2 to 15

Image bearing members Nos. 2 to 15 of Examples 2 to 15 are manufactured and evaluated in the same manner as in Example 1 except that the naphthalene tetracarbonic acid diimide derivative of the illustrated compound No. 4 for use in the liquid application for the charge transport layer is changed to the respective compounds shown in Table 3 below. The results of Examples 2 to 15 are shown in Table 3.

TABLE 3

| | | | Initial stage | | After 80,000 prints | |
|---|---|---|---|---|---|---|
| Example No. | Image bearing member No. | Illustrated derivative No. | Voltage at light portion (V) | Dot definition | Voltage at light portion (V) | Dot definition |
| 1 | 1 | 4 | 170 | 5 | 180 | 5 |
| 2 | 2 | 2 | 155 | 5 | 180 | 5 |
| 3 | 3 | 3 | 155 | 5 | 175 | 5 |
| 4 | 4 | 5 | 155 | 5 | 175 | 4 |
| 5 | 5 | 7 | 180 | 5 | 185 | 5 |
| 6 | 6 | 9 | 180 | 5 | 180 | 4 |
| 7 | 7 | 11 | 145 | 5 | 160 | 5 |
| 8 | 8 | 13 | 170 | 5 | 180 | 4 |
| 9 | 9 | 15 | 175 | 5 | 185 | 4 |
| 10 | 10 | 17 | 160 | 5 | 180 | 5 |
| 11 | 11 | 21 | 165 | 5 | 180 | 4 |
| 12 | 12 | 23 | 160 | 5 | 180 | 5 |
| 13 | 13 | 25 | 145 | 5 | 175 | 4 |
| 14 | 14 | 30 | 155 | 5 | 170 | 5 |
| 15 | 15 | 34 | 150 | 5 | 180 | 5 |

Example 16

First, oxotitanium phthalocyanine used in Example 16 as the charge generation material for use in the photosensitive layer is manufactured in the following manner:

Manufacturing of Oxotitanium Phthalocyanine

Figure 12:
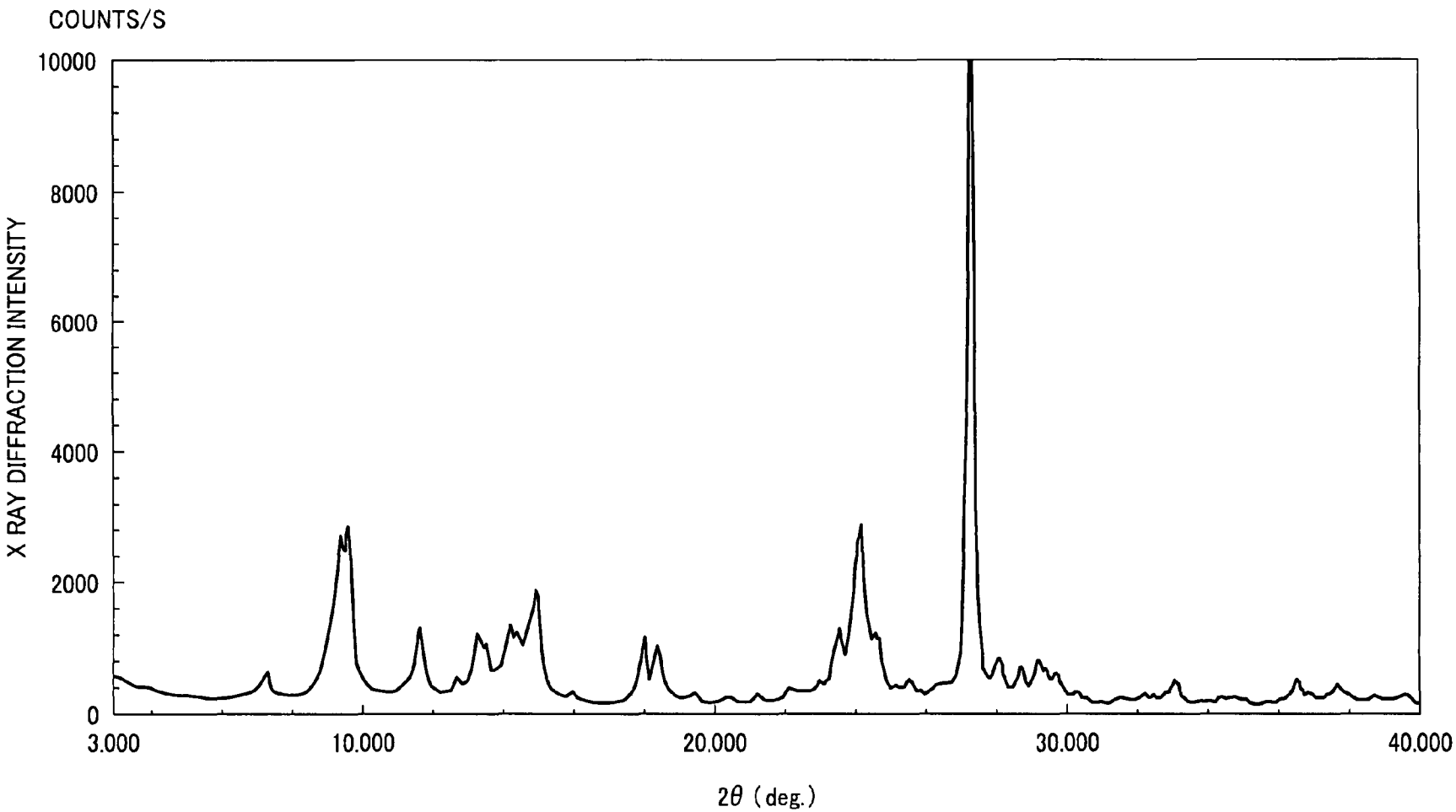
FIG. 12 is a graph illustrating an X-ray diffraction spectrum (powder XD spectrum) of oxotitanium phthalocyanine manufactured in Examples of the present invention.

As described in Synthesis Example 4 of JOP 2001-019871, 29.2 g of 1,3-diiminoisoindoline and 200 ml of sulfolane are mixed and 20.4 g of titanium tetrabuthoxide are dripped to the mixture in nitrogen atmosphere. After completion of the dripping, the mixture is heated gradually up to 180° C. and stirred for 5 hours to conduct a reaction while the reaction temperature is maintained between 170 to 180° C. Subsequent to completion of the reaction and cooling down, the precipitate is filtered and washed with chloroform until the color of the obtained powder becomes blue. The powder is washed with methanol several times followed by washing with hot water at 80° C. several times. Coarse titanyl phthalocyanine is obtained after drying. The coarse titanyl phthalocycnine is dissolved in concentrated sulfuric acid having an amount of 20 times as much as that of the coarse titanyl phthalocyanine. The resultant is dripped to iced water having an amount of 10 times while stirring. The precipitated crystal is filtered and repeatedly washed until the washing liquid is neutral. Thus, a wet cake of titanyl phthalocyanine pigment is obtained. The X-ray diffraction spectrum (powder XD spectrum) of the dried product (oxotitanium phthalocyanine) of this cake is shown in FIG. 12. 2 g of the obtained wet cake is placed in 20 g of carbon disulfide followed by a 4 hour stirring. 100 g of methanol is added and the resultant is filtered and dried after a 1 hour stirring to obtain crystal powder of oxotitanium phthalocyanine.

Next, a liquid application having the following recipe for a photosensitive layer is applied to an aluminum drum having a diameter of 30 mm and a length of 34 mm followed by drying to obtain an image bearing member No. 16 having a single layered photosensitive layer having a layer thickness of 30 μm.

Liquid Application for Photosensitive Layer

| | |
|---|---|
| Oxotitanium phthalocyanine manufactured as described above | 1 part |
| Charge transport material No. 1 represented by the following Chemical Structure (I) | 30 parts |

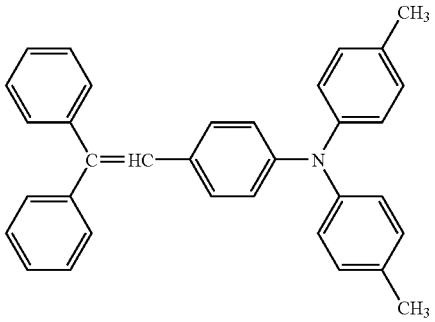

Chemical Structure (I)

-continued

| | |
|---|---|
| Naphthalene tetracarbonic acid diimide derivative of illustrated compound No. 7 | 20 parts |
| Polycarbonate resin (Panlite TS-2050, Teijin Chemicals Ltd.) | 50 parts |
| Tetrahydrofuran | 400 parts |
| Silicone oil (KF50-100CS, manufactured by Shin-Etsu Chemical Co., Ltd.) | 0.08 parts |

The thus manufactured image bearing member is arranged for installation and evaluated in the same manner as in Example 1. The evaluation results of Example 16 are shown in Table 4 below.

Examples 17 to 19

The image bearing members Nos. 17 to 19 of Examples 17 to 19 are manufactured in the same manner as in Example 16 except that the naphthalene tetracarbonic acid diimide derivative of the illustrated compound No. 7 for use in Example 16 is changed to the respective compounds shown in Table 4 below. The image bearing members Nos. 17 to 19 of Examples 17 to 19 are arranged for installation and evaluated in the same manner as in Example 1. The evaluation results of Examples 17 to 19 are shown in Table 4 below.

TABLE 4

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 16 | 16 | 7 | 50 | 5 | 80 | 5 |
| 17 | 17 | 9 | 55 | 5 | 75 | 5 |
| 18 | 18 | 17 | 65 | 5 | 75 | 5 |
| 19 | 19 | 25 | 55 | 5 | 85 | 5 |

Example 20

The image bearing member No. 20 of Example 20 is manufactured in the same manner as in Example 16 except that the charge transport material No. 1 for use in Example 16 is changed to the charge transport material No. 2 represented by the Chemical Structure (II).

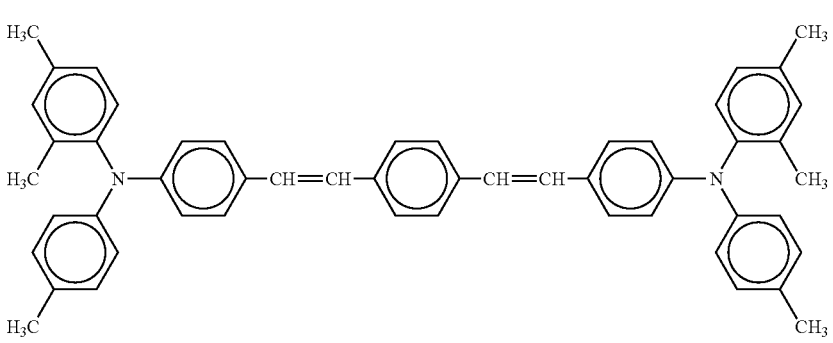

Chemical Structure (II)

The image bearing member No. 20 of Example 20 is arranged for installation and evaluated. The evaluation results of Example 20 are shown in Table 5 below.

Examples 21 to 23

The image bearing members Nos. 21 to 23 of Examples 21 to 23 are manufactured in the same manner as in Example 20 except that the naphthalene tetracarbonic acid diimide derivative of the illustrated compound No. 7 for use in Example 20 is changed to the respective compounds shown in Table 5 below. The image bearing members Nos. 21 to 23 of Examples 21 to 23 are arranged for installation and evaluated in the same manner as in Example 1. The evaluation results of Examples 21 to 23 are shown in Table 5 below.

TABLE 5

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 20 | 20 | 7 | −95 | 5 | −120 | 5 |
| 21 | 21 | 9 | −90 | 5 | −125 | 5 |

TABLE 5-continued

| Examples No. | Image bearing No. | Illustrated derivative No. | Initial stage Voltage at light portion (V) | Initial stage Dot definition | After 80,000 prints Voltage at light portion (V) | After 80,000 prints Dot definition |
|---|---|---|---|---|---|---|
| 22 | 22 | 17 | −80 | 5 | −100 | 5 |
| 23 | 23 | 25 | −100 | 5 | −110 | 5 |

Example 24

The image bearing member No. 24 of Example 24 is manufactured in the same manner as in Example 16 except that the charge transport material No. 1 for use in Example 16 is changed to the charge transport material No. 3 represented by the following Chemical Structure (III).

Chemical Structure (III)

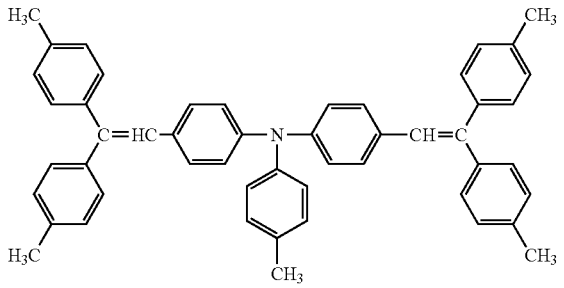

The image bearing member No. 24 of Example 24 is arranged for installation and evaluated. The evaluation results of Example 24 are shown in Table 6 below.

Examples 25 to 27

The image bearing members Nos. 25 to 27 of Examples 25 to 27 are manufactured in the same manner as in Example 24 except that the naphthalene tetracarbonic acid diimide derivative of the illustrated compound No. 7 for use in Example 24 is changed to the respective compounds shown in Table 6 below. The image bearing members Nos. 25 to 27 of Examples 25 to 27 are arranged for installation and evaluated in the same manner as in Example 1. The evaluation results of Examples 25 to 27 are shown in Table 6 below.

TABLE 6

| Examples No. | Image bearing No. | Illustrated derivative No. | Initial stage Voltage at light portion (V) | Initial stage Dot definition | After 80,000 prints Voltage at light portion (V) | After 80,000 prints Dot definition |
|---|---|---|---|---|---|---|
| 24 | 24 | 7 | 80 | 5 | 100 | 5 |
| 25 | 25 | 9 | 100 | 5 | 125 | 5 |
| 26 | 26 | 17 | 90 | 5 | 130 | 5 |
| 27 | 27 | 25 | 105 | 5 | 140 | 5 |

Example 28

The image bearing member No. 28 of Example 28 is manufactured in the same manner as in Example 16 except that the charge transport material No. 1 for use in Example 16 is changed to the charge transport material No. 4 represented by the following Chemical Structure (IV).

Chemical Structure (IV)

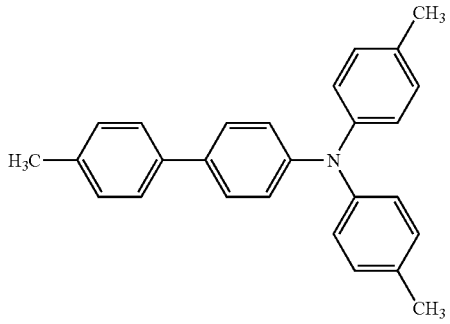

The image bearing member No. 28 of Example 28 is arranged for installation and evaluated. The evaluation results of Example 28 are shown in Table 7 below.

Examples 29 to 31

The image bearing members Nos. 29 to 31 of Examples 29 to 31 are manufactured in the same manner as in Example 16 except that the naphthalene tetracarbonic acid diimide derivative of the illustrated compound No. 7 for use in Example 28 is changed to the respective compounds shown in Table 7 below. The image bearing members Nos. 29 to 31 of Examples 29 to 31 are arranged for installation and evaluated in the same manner as in Example 1. The evaluation results of Examples to 31 are shown in Table 7 below.

TABLE 7

| Examples No. | Image bearing No. | Illustrated derivative No. | Initial stage Voltage at light portion (V) | Initial stage Dot definition | After 80,000 prints Voltage at light portion (V) | After 80,000 prints Dot definition |
|---|---|---|---|---|---|---|
| 28 | 28 | 7 | 100 | 5 | 130 | 5 |
| 29 | 29 | 9 | 90 | 5 | 105 | 5 |
| 30 | 30 | 17 | 100 | 5 | 120 | 5 |
| 31 | 31 | 25 | 95 | 5 | 130 | 5 |

Example 32

The same liquid application for an undercoating layer, the liquid application for a charge generation layer and the liquid application for a charge transport layer as in Example 1 are sequentially applied to an aluminum drum having a diameter of 30 mm and a length of 256 mm by a dip coating method. Subsequent to drying, the image bearing member No. 32 is obtained having an undercoating layer of 3.5 μm, a charge generation layer of 0.2 μm and a charge transport layer of 29 μm.

The thus manufactured image bearing member is arranged for installation and thereafter installed in a process cartridge for electrophotography. A running test is continuously performed repetitively up to corresponding to the total print number of 80,000 using a machine remodeled based on IPSiO CX400 (manufactured by Ricoh Co., Ltd., employing the system in which images are primarily transferred to an intermediate transfer belt followed by secondary transfer from the intermediate transfer belt to a transfer medium) in which the charging system for the installed process cartridge is changed to the positive charging system with a voltage at dark portions of 550 (V). During the test, the voltage at light portions (voltage at irradiated portions when a black solid image is written all over a sheet) at the initial stage and after the repetitive tests is measured. In addition, with regard to the dot definitions of the image at the initial stage and after the repetitive test, 10 dot images having an image density of 5% with a dot density of 600 dpi×600 dpi are continuously printed. The dot forms are observed with a stereoscopic microscope and the sharpness of the contour of the dots are evaluated according to the following dot image evaluation criteria (5 to 1 corresponding to excellent to bad). The results are shown in Table 8 below.

Dot Image Evaluation Criteria

5: Excellent (clear contour)
4: Good (extremely slight blur of the contour is observed)
3: Fair (blur of the contour is slightly observed)
2: Poor (blur of the contour is observed, which can make a problem depending on the kind of images.)
1: Bad (unable to distinguish dots from dots or dot images are not formed.)

Examples 33 to 46

The image bearing members Nos. 33 to 46 of Examples 33 to 46 are manufactured in the same manner as in Example 32 except that the naphthalene tetracarbonic acid diimide derivative of the illustrated compound No. 4 for use in Example 32 is changed to the respective compounds shown in Table 8 below. The image bearing members No. 33 to 46 of Examples 33 to 46 are arranged for installation and evaluated in the same manner as in Example 32. The evaluation results of Examples 33 to 46 are shown in Table 8 below.

TABLE 8

| | | | Initial stage | | After 80,000 prints | |
|---|---|---|---|---|---|---|
| Example No. | Image bearing member No. | Illustrated derivative No. | Voltage at light portion (V) | Dot definition | Voltage at light portion (V) | Dot definition |
| 32 | 32 | 4 | 60 | 5 | 80 | 5 |
| 33 | 33 | 2 | 55 | 5 | 85 | 5 |
| 34 | 34 | 3 | 50 | 5 | 70 | 5 |
| 35 | 35 | 5 | 65 | 5 | 85 | 5 |
| 36 | 36 | 7 | 75 | 5 | 95 | 4 |
| 37 | 37 | 9 | 65 | 5 | 90 | 5 |
| 38 | 38 | 11 | 60 | 5 | 85 | 5 |
| 39 | 39 | 13 | 55 | 5 | 80 | 4 |
| 40 | 40 | 15 | 50 | 5 | 85 | 4 |
| 41 | 41 | 17 | 75 | 5 | 80 | 5 |
| 42 | 42 | 20 | 60 | 5 | 85 | 5 |
| 43 | 43 | 23 | 75 | 5 | 95 | 5 |
| 44 | 44 | 25 | 70 | 5 | 85 | 4 |
| 45 | 45 | 30 | 65 | 5 | 90 | 5 |
| 46 | 46 | 34 | 70 | 5 | 80 | 5 |

Example 47

The same liquid application for a photosensitive layer as in Example 16 is applied to an aluminum drum having a diameter of 30 mm and a length of 256 mm followed by drying to obtain the image bearing member No. 47 having a single layered photosensitive layer with a thickness of 31 μm. The thus obtained image bearing member is arranged for installation and evaluated in the same manner as in Example 32. The evaluation results of Example 47 are shown in Table 9 below.

Examples 48 to 50

The image bearing members Nos. 48 to 50 of Examples 48 to 50 are manufactured in the same manner as in Example 47 except that the naphthalene tetracarbonic acid diimide derivative of the illustrated compound No. 7 for use in Example 47 is changed to the respective compounds shown in Table 9 below. The image bearing members No. 48 to 50 of Examples 48 to 50 are arranged for installation and evaluated in the same manner as in Example 32. The evaluation results of Examples 48 to 50 are shown in Table 9 below.

TABLE 9

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 47 | 47 | 7 | 65 | 5 | 80 | 5 |
| 48 | 48 | 9 | 80 | 5 | 95 | 5 |
| 49 | 49 | 17 | 65 | 5 | 90 | 5 |
| 50 | 50 | 25 | 50 | 5 | 85 | 5 |

Example 51

The image bearing member No. 51 of Example 51 is manufactured in the same manner as in Example 47 except that the charge transport material No. 1 represented by the Chemical Structure (I) for use in Example 47 is changed to the charge transport material No. 2 represented by the Chemical Structure (II). The image bearing member No. 51 of Example 51 is arranged for installation and evaluated. The evaluation results of Example 51 are shown in Table 10 below.

Examples 52 to 54

The image bearing members Nos. 52 to 54 of Examples 52 to 54 are manufactured in the same manner as in Example 51 except that the naphthalene tetracarbonic acid diimide derivative of the illustrated compound No. 7 for use in Example 51 is changed to the respective compounds shown in Table 10 below. The image bearing members No. 52 to 54 of Examples 52 to 54 are arranged for installation and evaluated in the same manner as in Example 32. The evaluation results of Examples 52 to 54 are shown in Table 10 below.

TABLE 10

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 51 | 51 | 7 | 50 | 5 | 70 | 5 |
| 52 | 52 | 9 | 65 | 5 | 85 | 5 |
| 53 | 53 | 17 | 60 | 5 | 90 | 5 |
| 54 | 54 | 25 | 55 | 5 | 75 | 5 |

Example 55

The image bearing member No. 55 of Example 55 is manufactured in the same manner as in Example 47 except that the charge transport material No. 1 represented by the Chemical Structure (I) for use in Example 47 is changed to the charge transport material No. 3 represented by the Chemical Structure (III) illustrated above. The image bearing member No. 55 of Example 55 is arranged for installation and evaluated. The evaluation results of Example 55 are shown in Table 11 below.

Examples 56 to 58

The image bearing members Nos. 56 to 58 of Examples 56 to 58 are manufactured in the same manner as in Example 55 except that the naphthalene tetracarbonic acid diimide derivative of the illustrated compound No. 7 for use in Example 55 is changed to the respective compounds shown in Table 11 below. The image bearing members No. 56 to 58 of Examples 56 to 58 are arranged for installation and evaluated in the same manner as in Example 32. The evaluation results of Examples 56 to 58 are shown in Table 11 below.

TABLE 11

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 55 | 55 | 7 | 65 | 5 | 80 | 5 |
| 56 | 56 | 9 | 55 | 5 | 85 | 5 |
| 57 | 57 | 17 | 60 | 5 | 85 | 5 |
| 58 | 58 | 25 | 50 | 5 | 85 | 5 |

Example 59

The image bearing member No. 59 of Example 59 is manufactured in the same manner as in Example 47 except that the charge transport material No. 1 represented by the Chemical Structure (I) illustrated above for use in Example 47 is changed to the charge transport material No. 4 represented by the Chemical Structure (IV) illustrated above. The image bearing member No. 59 of Example 59 is arranged for installation and evaluated. The evaluation results of Example 59 are shown in Table 12 below.

Examples 60 to 62

The image bearing members Nos. 60 to 62 of Examples 60 to 62 are manufactured in the same manner as in Example 59 except that the naphthalene tetracarbonic acid diimide derivative of the illustrated compound No. 7 for use in Example 59 is changed to the respective compounds shown in Table 12 below. The image bearing members No. 60 to 62 of Examples 60 to 62 are arranged for installation and evaluated in the same manner as in Example 32. The evaluation results of Examples 60 to 62 are shown in Table 12 below.

TABLE 12

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 59 | 59 | 7 | 50 | 5 | 90 | 5 |
| 60 | 60 | 9 | 85 | 5 | 105 | 5 |
| 61 | 61 | 17 | 50 | 5 | 75 | 5 |
| 62 | 62 | 25 | 65 | 5 | 90 | 5 |

Example 63

The image bearing member No. 63 of Example 63 is manufactured in the same manner as in Example 1 except that the liquid application for a charge transport layer is changed to the following:

| | |
|---|---|
| Polycarbonate resin (Panlite TS-2050, Teijin Chemicals Ltd.) | 15 parts |
| Naphthalene tetracarbonic acid diimide derivative of the illustrated compound No. 4 | 9 parts |

The image bearing member No. 63 is evaluated in the same manner as in Example 1. The evaluation results thereof are shown in Table 13.

Example 64

The image bearing member No. 64 of Example 64 is manufactured in the same manner as in Example 16 except that 30 parts of the charge transport material No. 1 represented by the Chemical Structure (I) to 25 parts, 20 parts of the naphthalene tetracarbonic acid diimide derivative of the illustrated compound No. 1 is changed to 15 parts and 50 parts of the polycarbonate resin (Panlite TS-2050, Teijin Chemicals Ltd.) is changed to 60 parts and evaluated in the same manner as in Example 16. The evaluation results of the image bearing member No. 64 are shown in Table 13.

Example 65

The image bearing member No. 65 of Example 65 is manufactured in the same manner as in Example 32 except that the composition of the liquid for a charge transport layer is changed to that for use in Example 63 and evaluated in the same manner as in Example 32. The evaluation results of the image bearing member No. 65 are shown in Table 13.

Example 66

The image bearing member No. 66 of Example 66 is manufactured in the same manner as in Example 47 except that the composition of the liquid for a photosensitive layer is changed to that for use in Example 64 and evaluated in the same manner as in Example 47. The evaluation results of the image bearing member No. 66 are shown in Table 13.

TABLE 13

| Examples No. | Image bearing No. | Illustrated derivative No. | Initial stage: Voltage at light portion (V) | Initial stage: Dot definition | After 80,000 prints: Voltage at light portion (V) | After 80,000 prints: Dot definition |
|---|---|---|---|---|---|---|
| 63 | 63 | 4 | 55 | 5 | 65 | 5 |
| 64 | 64 | 7 | 55 | 5 | 60 | 5 |
| 65 | 65 | 4 | 45 | 5 | 65 | 5 |
| 66 | 66 | 7 | 55 | 5 | 70 | 5 |

Comparative Example 1

The comparative image bearing member No. 1 of Comparative Example 1 is manufactured in the same manner as in Example 1 except that the naphthalene tetracarbonic acid diimide derivative of the illustrated compound No. 4 for use in Example 1 is changed to the comparative compound No. 1 represented by the following Chemical Structure (V) and evaluated in the same manner as in Example 1.

Chemical Structure (V)

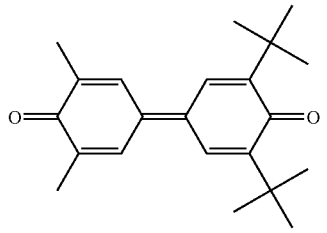

The evaluation results of the comparative image bearing member No. 1 are shown in Table 14 below.

Comparative Example 2

The comparative image bearing member No. 2 of Comparative Example 2 is manufactured in the same manner as in Example 1 except that the naphthalene tetracarbonic acid diimide derivative of the illustrated compound No. 4 for use in Example 1 is changed to the comparative compound No. 2 represented by the following Chemical Structure (VI) and evaluated in the same manner as in Example 1.

Chemical Structure (VI)

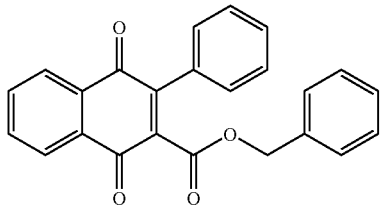

The evaluation results of the comparative image bearing member No. 2 are shown in Table 14 below.

Comparative Example 3

The comparative image bearing member No. 3 of Comparative Example 3 is manufactured in the same manner as in Example 16 except that the naphthalene tetracarbonic acid diimide derivative of the illustrated compound No. 7 for use in Example 16 is changed to the comparative compound No. 3 represented by the following Chemical Structure (VII) and evaluated in the same manner as in Example 16.

Chemical Structure (VII)

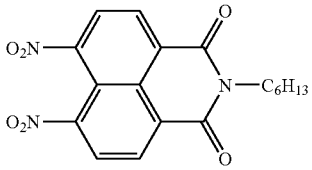

The evaluation results of the comparative image bearing member No. 3 are shown in Table 14 below.

Comparative Example 4

The comparative image bearing member No. 4 of Comparative Example 4 is manufactured in the same manner as in Example 16 except that the naphthalene tetracarbonic acid diimide derivative of the illustrated compound No. 7 for use in Example 16 is changed to the comparative compound No. 4 represented by the following Chemical Structure (VIII) and evaluated in the same manner as in Example 16.

Chemical Structure (VIII)

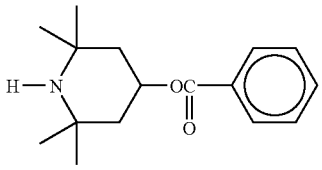

The evaluation results of the comparative image bearing member No. 4 are shown in Table 14 below.

Comparative Example 5

The comparative image bearing member No. 5 of Comparative Example 5 is manufactured in the same manner as in Example 16 except that the naphthalene tetracarbonic acid diimide derivative of the illustrated compound No. 7 for use in Example 16 is changed to the comparative compound No. 5 represented by the following Chemical Structure (IX) and evaluated in the same manner as in Example 16.

Chemical Structure (IX)

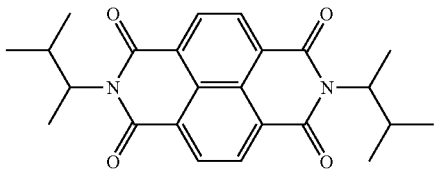

The evaluation results of the comparative image bearing member No. 5 are shown in Table 14 below.

Comparative Example 6

The comparative image bearing member No. 6 of Comparative Example 6 is manufactured in the same manner as in Example 32 except that the naphthalene tetracarbonic acid diimide derivative of the illustrated compound No. 4 for use in Example 32 is changed to the comparative compound No. 1 represented by the following Chemical Structure (V) and evaluated in the same manner as in Example 32. The evaluation results of the comparative image bearing member No. 6 are shown in Table 14 below.

Comparative Example 7

The comparative image bearing member No. 7 of Comparative Example 7 is manufactured in the same manner as in Example 32 except that the naphthalene tetracarbonic acid diimide derivative of the illustrated compound No. 4 for use in Example 32 is changed to the comparative compound No. 2 represented by the following Chemical Structure (VI) and evaluated in the same manner as in Example 32. The evaluation results of the comparative image bearing member No. 7 are shown in Table 14 below.

Comparative Example 8

The comparative image bearing member No. 8 of Comparative Example 8 is manufactured in the same manner as in Example 47 except that the naphthalene tetracarbonic acid diimide derivative of the illustrated compound No. 7 for use in Example 47 is changed to the comparative compound No. 3 represented by the following Chemical Structure (VII) and evaluated in the same manner as in Example 47. The evaluation results of the comparative image bearing member No. 8 are shown in Table 14 below.

Comparative Example 9

The comparative image bearing member No. 9 of Comparative Example 9 is manufactured in the same manner as in Example 47 except that the naphthalene tetracarbonic acid diimide derivative of the illustrated compound No. 7 for use in Example 47 is changed to the comparative compound No. 4 represented by the following Chemical Structure (VIII) and evaluated in the same manner as in Example 47. The evaluation results of the comparative image bearing member No. 9 are shown in Table 14 below.

Comparative Example 10

The comparative image bearing member No. 10 of Comparative Example 10 is manufactured in the same manner as in Example 47 except that the naphthalene tetracarbonic acid diimide derivative of the illustrated compound No. 7 for use in Example 47 is changed to the comparative compound No. 5 represented by the following Chemical Structure (IX) and evaluated in the same manner as in Example 47. The evaluation results of the comparative image bearing member No. 10 are shown in Table 14 below.

TABLE 14

| | | Initial stage | | After 80,000 prints | |
|---|---|---|---|---|---|
| Comparative Example No. | Comparative Image bearing No. | Voltage at light portion (V) | Dot definition | Voltage at light portion (V) | Dot definition |
| Comparative Example 1 | Comparative Image bearing No. 1 | 220 | 2 | 460 | Impossible to evaluate |

TABLE 14-continued

| | | Initial stage | | After 80,000 prints | |
|---|---|---|---|---|---|
| Comparative Example No. | Comparative Image bearing No. | Voltage at light portion (V) | Dot definition | Voltage at light portion (V) | Dot definition |
| Comparative Example 2 | Comparative Image bearing No. 2 | 100 | 3 | 375 | 1 |
| Comparative Example 3 | Comparative Image bearing No. 3 | 200 | 4 | 295 | 1 |
| Comparative Example 4 | Comparative Image bearing No. 4 | 250 | 2 | 480 | 1 |
| Comparative Example 5 | Comparative Image bearing No. 5 | 65 | 5 | 105 | 2 |
| Comparative Example 6 | Comparative Image bearing No. 6 | 75 | 3 | 175 | 1 |
| Comparative Example 7 | Comparative Image bearing No. 7 | 90 | 3 | 540 | Impossible to evaluate |
| Comparative Example 8 | Comparative Image bearing No. 8 | 105 | 4 | 345 | 1 |
| Comparative Example 9 | Comparative Image bearing No. 9 | 80 | 4 | 265 | 1 |
| Comparative Example 10 | Comparative Image bearing No. 10 | 60 | 5 | 100 | 2 |

In the following Examples 67 to 132, the naphthalene tetracarbonic acid diimide derivative represented by the Chemical Structure (B) illustrated above is used in formation of the charge transport layer or the photosensitive layer. The naphthalene tetracarbonic acid diimide derivative represented by the Chemical structure (B) is synthesized. For example, manufacturing of the illustrated compound No. 66 is described below as a Manufacturing Example.

Manufacturing Example 5

(1) Manufacturing of Monoimide 5.36 g (20.0 mmol) of naphthalene-1,4,5,8-tetracarbonic dianhydride (manufactured by Tokyo Chemical Industry Co., Ltd.), 30 ml of N,N'-dimethyl formamide and 3 ml of acetic acid are placed in a flask and refluxed while heated. A solution of 2.42 g (21.0 mmol) of 2 heptyl amine and 6 ml of N,N-dimethyl formamide are dripped to the flask in about two hours while stirring. The reaction is conducted during a 5 hour reflux followed by cooling down. The solvent is removed by distillation under a reduced pressure and toluene is added to the residual. The unsolved matter is filtered followed by refinement by silica gel chromatography. Thereafter, the refined matter is re-crystallized by a solvent mixture of cyclohexane and toluene to obtain 3.02 g (yield 41.3%) of the monoimide represented by the following Chemical Structure (b).

Chemical Structure (b)

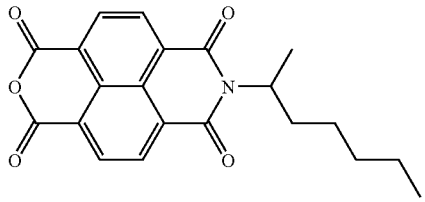

The melting point of the obtained monoimide is from 149.0 to 150.0° C. The infrared absorption spectrum (by KBr pill method) is observed for the monoimide at 1,787 $cm^{-1}$ ascribable to acid anhydride and at 1,670 $cm^{-1}$ ascribable to imide. The element snsylsys of the monoimide is shown in Table 15 below.

TABLE 15

| | Element | | |
|---|---|---|---|
| | C | H | N |
| Actual value | 69.05 | 5.27 | 3.74 |
| Calculation value | 69.03 | 5.24 | 3.83 |

(2) Manufacturing of Diimide Derivative (Illustrated Derivative No. 66)

1.06 g (5.00 mmol) of 1,1-dibenzyl hydradine (manufactured by Tokyo Chemical Industry Co., Ltd.) is added to 1.83 g (5.00 mmol) of the monoimide manufactured in (1) and 15 ml of N,N'-dimethyl formamide and the mixture is stirred at 60° C. in argon atmosphere for 3.5 hours. The solvent of N,N'-dimethyl formamide is removed by distillation under reduced pressure to obtain a red crystal. The resultant is subject to silica gel column treatment (eluting solvent: mixture solvent of toluene and ethyl acetate with a ratio of 30 to 1 in volume) to obtain a red and orange crystal. The obtained crystal is re-crystallized by a solvent mixture of ethyl acetate and ethanol. The obtained crystal is dried by a reduced pressure heating drier to obtain 2.21 g (yield 78.9%) of a diimide derivative crystal having a yellow needle form represented by the following Chemical Structure (c).

Chemical Structure (c)

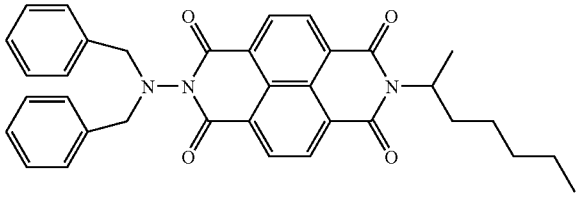

The melting point of the obtained diimide derivative (illustrated derivative No. 66) is from 147.0 to 148.0° C. In addition, the element analysis is shown in Table 16 below.

TABLE 16

| | Element | | |
|---|---|---|---|
| | C | H | N |
| Actual value | 75.05 | 6.02 | 7.40 |
| Calculation value | 75.11 | 5.94 | 7.51 |

Example 67

Manufacturing of Image Bearing Member

The liquid application for an undercoating layer, the liquid application for a charge generation layer and the liquid application for a charge transport layer, each having the following recipe, are sequentially applied to an aluminum drum having a diameter of 30 mm and a length of 340 mm by a dip coating method. Subsequent to drying, an image bearing member No. 67 is obtained which has an undercoating layer of 3.5 μm, a charge generation layer of 0.2 μm and a charge transport layer of 26 μm.

Recipe for Liquid Application for Undercoating Layer

| | |
|---|---|
| Powder of titanium dioxide (Tipaque CR-EL, manufactured by Ishihara Sangyo Kaisha Ltd.) | 400 parts |
| Melamine resin (Super Beckamine G821-60, manufactured by DIC Corporation) | 65 parts |
| Alkyd resin (Becoklite M6401-50, manufactured by DIC Corporation) | 120 parts |
| 2-butanone | 400 parts |

Recipe for Liquid Application for Charge Generation Layer

| | |
|---|---|
| X type non-metal phthalocyanine (FastogenBlue8120B, manufactured by DIC Corporation) | 10 parts |
| Polyvinylbutyral (XYHL, manufactured by Union Carbide Corporation) | 5 parts |
| 2-butanone | 200 parts |
| Cyclohexanone | 400 parts |

Recipe for Liquid Application for Charge Transport Layer

| | |
|---|---|
| Polycarbonate resin (Panlite TS-2050, manufactured by Teijin Chemicals Ltd.). | 12 parts |
| Naphthalene tetracarbonic acid diimide derivative (illustrated compound No. 44) | 12 parts |
| Tetrahydrofuran | 100 parts |
| Silicone oil (KF50-100CS, manufactured by Shin-Etsu Chemical Co., Ltd.) | 0.02 parts |

The thus manufactured image bearing member is arranged for installation and thereafter installed in a process cartridge for electrophotography. A running test is continuously performed repetitively up to corresponding to the total print number of 80,000 using a machine remodeled based on IPSiO CX8200 (manufactured by Ricoh Co., Ltd.) in which the charging system for the installed process cartridge is changed to the positive charging system with a voltage at dark portions of 750 (V). During the test, the voltage at light portions (voltage at irradiated portions when a black solid image is written all over a sheet) at the initial stage and after the repetitive tests is measured. In addition, with regard to the dot definition of the image at the initial stage and after the repetitive test, 10 dot images having an image density of 5% with a dot density of 600 dpi×600 dpi are continuously printed. The dot forms are observed with a stereoscopic microscope and the sharpness of the contour of the dots are evaluated according to the following dot image evaluation criteria (5 to 1 corresponding to excellent to bad). The results are shown in Table 17 below.

Dot Image Evaluation Criteria

5: Excellent (clear contour)
4: Good (extremely slight blur of the contour is observed)
3: Fair (blur of the contour is slightly observed)
2: Poor (blur of the contour is observed, which can make a problem depending on the kind of images.)
1: Bad (unable to distinguish dots from dots or dot images are not formed.)

Examples 68 to 81

Image bearing members Nos. 68 to 81 of Examples 68 to 81 are manufactured and evaluated in the same manner as in Example 67 except that the naphthalene tetracarbonic acid diimide derivative of the illustrated compound No. 44 for use in the liquid application for the charge transport layer is changed to the respective compounds shown in Table 17 below. The results of Examples 68 to 81 are shown in Table 17.

TABLE 17

| | | | Initial stage | | After 80,000 prints | |
|---|---|---|---|---|---|---|
| Example No. | Image bearing member No. | Illustrated derivative No. | Voltage at light portion (V) | Dot definition | Voltage at light portion (V) | Dot definition |
| 67 | 67 | 44 | 150 | 5 | 170 | 5 |
| 68 | 68 | 37 | 155 | 5 | 180 | 5 |
| 69 | 69 | 39 | 155 | 5 | 175 | 5 |
| 70 | 70 | 41 | 145 | 5 | 165 | 4 |
| 71 | 71 | 43 | 160 | 5 | 165 | 5 |
| 72 | 72 | 45 | 170 | 5 | 180 | 4 |
| 73 | 73 | 47 | 155 | 5 | 180 | 5 |
| 74 | 74 | 49 | 150 | 5 | 160 | 4 |
| 75 | 75 | 51 | 155 | 5 | 165 | 4 |
| 76 | 76 | 53 | 150 | 5 | 160 | 5 |
| 77 | 77 | 57 | 155 | 5 | 170 | 4 |
| 78 | 78 | 59 | 150 | 5 | 175 | 5 |
| 79 | 79 | 61 | 150 | 5 | 165 | 4 |
| 80 | 80 | 65 | 155 | 5 | 165 | 5 |
| 81 | 81 | 69 | 165 | 5 | 170 | 5 |

Example 82

First, oxotitanium phthalocyanine used in Example 82 as the charge generation material for use in the photosensitive layer is manufactured in the following manner:

Manufacturing of Oxotitanium Phthalocyanine

As described in Synthesis Example 4 of JOP 2001-019871, 29.2 g of 1,3-diiminoisoindoline and 200 ml of sulfolane are mixed and 20.4 g of titanium tetrabuthoxide are dripped to the mixture in nitrogen atmosphere. After completion of the dripping, the mixture is heated gradually up to 180° C. and stirred for 5 hours to conduct a reaction while the reaction temperature is maintained between 170 to 180° C. Subsequent to completion of the reaction and cooling down, the precipitate is filtered and washed with chloroform until the color of the obtained powder becomes blue. The powder is washed with methanol several times followed by washing with hot water at 80° C. several times. Coarse titanyl phthalocyanine is obtained after drying. The coarse titanyl phthalocycnine is dissolved in concentrated sulfuric acid having an amount of 20 times as much as that of the coarse titanyl phthalocyanine. The resultant is dripped to iced water having an amount of 10 times while stirring. The precipitated crystal is filtered and repeatedly washed until the washing liquid is neutral. Thus, a wet cake of titanyl phthalocyanine pigment is obtained. The X-ray diffraction spectrum (powder XD spectrum) of the dried product (oxotitanium phthalocyanine) of this cake is shown in FIG. 12. 2 g of the obtained wet cake is placed in 20 g of carbon disulfide followed by a 4 hour stirring. 100 g of methanol is added and the resultant is filtered and dried after a 1 hour stirring to obtain crystal powder of oxotitanium phthalocyanine.

Next, a liquid application having the following recipe for a photosensitive layer is applied to an aluminum drum having a diameter of 30 mm and a length of 34 mm followed by drying to obtain an image bearing member No. 82 having a single layered photosensitive layer having a layer thickness of 30 μm.

Liquid Application for Photosensitive Layer

| | |
|---|---|
| Oxotitanium phthalocyanine manufactured as described above | 1 part |
| Charge transport material No. 1 represented by the following Chemical Structure (I) | 30 parts |
| Naphthalene tetracarbonic acid diimide derivative of illustrated compound No. 37 | 20 parts |
| Polycarbonate resin (Panlite TS-2050, Teijin Chemicals Ltd.) | 50 parts |
| Tetrahydrofuran | 400 parts |
| Silicone oil (KF50-100CS, manufactured by Shin-Etsu Chemical Co., Ltd.) | 0.08 parts |

Chemical Structure (I)

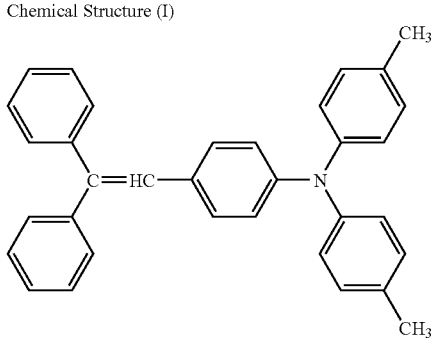

The thus manufactured image bearing member is arranged for installation and evaluated in the same manner as in Example 67. The evaluation results of Example 82 are shown in Table 18 below.

Examples 83 to 85

The image bearing members Nos. 83 to 85 of Examples 83 to 85 are manufactured in the same manner as in Example 82 except that the naphthalene tetracarbonic acid diimide derivative of the illustrated compound No. 37 for use in Example 82 is changed to the respective compounds shown in Table 18 below. The image bearing members Nos. 83 to 85 of Examples 83 to 85 are arranged for installation and evaluated in the same manner as in Example 67. The evaluation results of Examples 83 to 85 are shown in Table 18 below.

TABLE 18

| Example No. | Image bearing No. | Illustrated derivative No. | Initial stage: Voltage at light portion (V) | Initial stage: Dot definition | After 80,000 prints: Voltage at light portion (V) | After 80,000 prints: Dot definition |
|---|---|---|---|---|---|---|
| 82 | 82 | 37 | 55 | 5 | 70 | 5 |
| 83 | 83 | 52 | 65 | 5 | 85 | 5 |
| 84 | 84 | 56 | 60 | 5 | 70 | 5 |
| 85 | 85 | 66 | 55 | 5 | 75 | 5 |

The image bearing member No. 86 of Example 86 is manufactured in the same manner as in Example 82 except that the charge transport material No. 1 for use in Example 82 is changed to the charge transport material No. 2 represented by the Chemical Structure (II). The image bearing member No. 86 of Example 86 is arranged for installation and evaluated. The evaluation results of Example 86 are shown in Table 19 below.

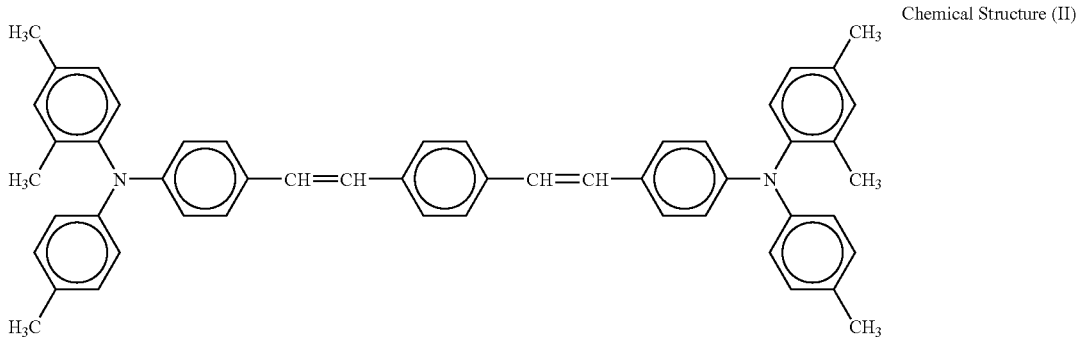

Examples 87 to 89

The image bearing members Nos. 87 to 89 of Examples 87 to 89 are manufactured in the same manner as in Example 86 except that the naphthalene tetracarbonic acid diimide derivative of the illustrated compound No. 37 for use in Example 86 is changed to the respective compounds shown in Table 19 below. The image bearing members Nos. 87 to 89 of Examples 87 to 89 are arranged for installation and evaluated in the same manner as in Example 67. The evaluation results of Examples 87 to 89 are shown in Table 19 below.

TABLE 19

| Example No. | Image bearing No. | Illustrated derivative No. | Initial stage: Voltage at light portion (V) | Initial stage: Dot definition | After 80,000 prints: Voltage at light portion (V) | After 80,000 prints: Dot definition |
|---|---|---|---|---|---|---|
| 86 | 86 | 37 | −95 | 5 | −120 | 5 |
| 87 | 87 | 52 | −100 | 5 | −115 | 5 |
| 88 | 88 | 56 | −100 | 5 | −110 | 5 |
| 89 | 89 | 66 | −105 | 5 | −130 | 5 |

Example 90

The image bearing member No. 90 of Example 90 is manufactured in the same manner as in Example 82 except that the charge transport material No. 1 for use in Example 82 is changed to the charge transport material No. 3 represented by the following Chemical structure (III).

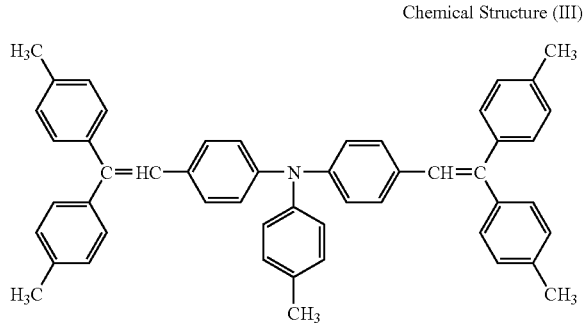

The image bearing member No. 90 of Example 90 is arranged for installation and evaluated. The evaluation results of Example 90 are shown in Table 20 below.

Examples 91 to 93

The image bearing members Nos. 91 to 93 of Examples 91 to 93 are manufactured in the same manner as in Example 90 except that the naphthalene tetracarbonic acid diimide derivative of the illustrated compound No. 37 for use in Example 90 is changed to the respective compounds shown in Table 20 below. The image bearing members Nos. 91 to 93 of Examples 91 to 93 are arranged for installation and evaluated in the same manner as in Example 67. The evaluation results of Examples 91 to 93 are shown in Table 20 below. Table 20

TABLE 20

| Example No. | Image bearing No. | Illustrated derivative No. | Initial stage: Voltage at light portion (V) | Initial stage: Dot definition | After 80,000 prints: Voltage at light portion (V) | After 80,000 prints: Dot definition |
|---|---|---|---|---|---|---|
| 90 | 90 | 37 | 95 | 5 | 120 | 5 |
| 91 | 91 | 52 | 100 | 5 | 115 | 5 |
| 92 | 92 | 56 | 100 | 5 | 110 | 5 |
| 93 | 93 | 66 | 105 | 5 | 130 | 5 |

Example 94

The image bearing member No. 94 of Example 94 is manufactured in the same manner as in Example 82 except that the charge transport material No. 1 for use in Example 82 is changed to the charge transport material No. 4 represented by the following Chemical Structure (IV).

Chemical Structure (IV)

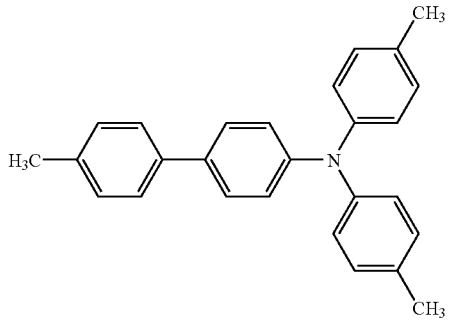

The image bearing member No. 94 of Example 94 is arranged for installation and evaluated. The evaluation results of Example 94 are shown in Table 21 below.

Examples 95 to 97

The image bearing members Nos. 95 to 97 of Examples 95 to 97 are manufactured in the same manner as in Example 82 except that the naphthalene tetracarbonic acid diimide derivative of the illustrated compound No. 37 for use in Example 84 is changed to the respective compounds shown in Table 21 below. The image bearing members Nos. 95 to 97 of Examples 95 to 97 are arranged for installation and evaluated in the same manner as in Example 67. The evaluation results of Examples 95 to 97 are shown in Table 21 below.

TABLE 21

| | | | Initial stage | | After 80,000 prints | |
|---|---|---|---|---|---|---|
| Example No. | Image bearing No. | Illustrated derivative No. | Voltage at light portion (V) | Dot definition | Voltage at light portion (V) | Dot definition |
| 94 | 94 | 37 | 95 | 5 | 120 | 5 |
| 95 | 95 | 52 | 100 | 5 | 115 | 5 |
| 96 | 96 | 56 | 100 | 5 | 110 | 5 |
| 97 | 97 | 66 | 105 | 5 | 130 | 5 |

Example 98

The same liquid application for an undercoating layer, the liquid application for a charge generation layer and the liquid application for a charge transport layer as in Example 67, are sequentially applied to an aluminum drum having a diameter of 30 mm and a length of 256 mm by a dip coating method. Subsequent to drying, the image bearing member No. 98 is obtained having an undercoating layer of 3.5 μm, a charge generation layer of 0.2 μm and a charge transport layer of 27 μm.

The thus manufactured image bearing member is arranged for installation and thereafter installed in a process cartridge for electrophotography. A running test is continuously performed repetitively up to corresponding to the total print number of 80,000 using a machine remodeled based on IPSiO CX400 (manufactured by Ricoh Co., Ltd., employing the system in which images are primarily transferred to an intermediate transfer belt followed by secondary transfer from the intermediate transfer belt to a transfer medium) in which the charging system for the installed process cartridge is changed to the positive charging system with a voltage at dark portions of 550 (V). During the test, the voltage at light portions (voltage at irradiated portions when a black solid image is written all over a sheet) at the initial stage and after the repetitive tests is measured. In addition, with regard to the dot definition of the image at the initial stage and after the repetitive test, 10 dot images having an image density of 5% with a dot density of 600 dpi×600 dpi are continuously printed. The dot forms are observed with a stereoscopic microscope and the sharpness of the contour of the dots are evaluated according to the following dot image evaluation criteria (5 to 1 corresponding to excellent to bad). The results are shown in Table 22 below.

Dot Image Evaluation Criteria

5: Excellent (clear contour)
4: Good (extremely slight blur of th contour is observed)
3: Fair (blur of the contour is slightly observed)
2: Poor (blur of the contour is observed, which can make a problem depending on the kind of images.)
1: Bad (unable to distinguish dots from dots or dot images are not formed.)

Examples 99 to 112

The image bearing members Nos. 99 to 112 of Examples 99 to 112 are manufactured in the same manner as in Example 32 except that the naphthalene tetracarbonic acid diimide derivative of the illustrated compound No. 44 for use in Example 98 is changed to the respective compounds shown in Table 22 below. The image bearing members No. 99 to 112 of Examples 99 to 112 are arranged for installation and evaluated in the same manner as in Example 98. The evaluation results of Examples 99 to 112 are shown in Table 22 below.

TABLE 22

| | | | Initial stage | | After 80,000 prints | |
|---|---|---|---|---|---|---|
| Example No. | Image bearing member No. | Illustrated derivative No. | Voltage at light portion (V) | Dot definition | Voltage at light portion (V) | Dot definition |
| 98 | 98 | 44 | 55 | 5 | 70 | 5 |
| 99 | 99 | 37 | 65 | 5 | 80 | 5 |
| 100 | 100 | 39 | 70 | 5 | 75 | 4 |
| 101 | 101 | 41 | 55 | 5 | 65 | 5 |
| 102 | 102 | 43 | 65 | 5 | 65 | 4 |
| 103 | 103 | 45 | 75 | 5 | 85 | 5 |
| 104 | 104 | 47 | 65 | 5 | 80 | 5 |
| 105 | 105 | 49 | 60 | 5 | 80 | 4 |
| 106 | 106 | 51 | 55 | 5 | 75 | 4 |
| 107 | 107 | 53 | 55 | 5 | 65 | 5 |
| 108 | 108 | 57 | 65 | 5 | 75 | 4 |
| 109 | 109 | 59 | 55 | 5 | 85 | 5 |
| 110 | 110 | 61 | 55 | 5 | 75 | 4 |
| 111 | 111 | 65 | 60 | 5 | 75 | 5 |
| 112 | 112 | 69 | 70 | 5 | 80 | 5 |

Example 113

The same liquid application for a photosensitive layer as in Example 82 is applied to an aluminum drum having a diameter of 30 mm and a length of 256 mm followed by drying to obtain the image bearing member No. 113 having a single layered photosensitive layer with a thickness of 31 μm. The thus obtained image bearing member is arranged for installation and evaluated in the same manner as in Example 98. The evaluation results of Example 113 are shown in Table 23 below.

Examples 114 to 116

The image bearing members Nos. 114 to 116 of Examples 114 to 116 are manufactured in the same manner as in Example 113 except that the naphthalene tetracarbonic acid diimide derivative of the illustrated compound No. 37 for use in Example 113 is changed to the respective compounds shown in Table 23 below. The image bearing members No. 114 to 116 of Examples 114 to 116 are arranged for installation and evaluated in the same manner as in Example 98. The evaluation results of Examples 114 to 116 are shown in Table 23 below.

TABLE 23

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 113 | 113 | 37 | 55 | 5 | 70 | 5 |
| 114 | 114 | 52 | 65 | 5 | 85 | 5 |
| 115 | 115 | 56 | 60 | 5 | 70 | 5 |
| 116 | 116 | 66 | 55 | 5 | 75 | 5 |

Example 117

The image bearing member No. 117 of Example 117 is manufactured in the same manner as in Example 113 except that the charge transport material No. 1 represented by the Chemical Structure (I) for use in Example 113 is changed to the charge transport material No. 2 represented by the Chemical structure (II). The image bearing member No. 117 of Example 117 is arranged for installation and evaluated. The evaluation results of Example 117 are shown in Table 24 below.

Examples 118 to 120

The image bearing members Nos. 118 to 120 of Examples 118 to 120 are manufactured in the same manner as in Example 117 except that the naphthalene tetracarbonic acid diimide derivative of the illustrated compound No. 37 for use in Example 117 is changed to the respective compounds shown in Table 24 below. The image bearing members No. 118 to 120 of Examples 118 to 120 are arranged for installation and evaluated in the same manner as in Example 98. The evaluation results of Examples 118 to 120 are shown in Table 24 below.

TABLE 24

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 117 | 117 | 37 | 55 | 5 | 70 | 5 |
| 118 | 118 | 52 | 50 | 5 | 65 | 5 |
| 119 | 119 | 56 | 50 | 5 | 70 | 5 |
| 120 | 120 | 66 | 65 | 5 | 75 | 5 |

Example 121

The image bearing member No. 121 of Example 121 is manufactured in the same manner as in Example 113 except that the charge transport material No. 1 represented by the Chemical Structure (I) for use in Example 47 is changed to the charge transport material No. 3 represented by the Chemical Structure (III) illustrated above. The image bearing member No. 121 of Example 121 is arranged for installation and evaluated. The evaluation results of Example 121 are shown in Table 25 below.

Examples 122 to 124

The image bearing members Nos. 122 to 124 of Examples 122 to 124 are manufactured in the same manner as in Example 121 except that the naphthalene tetracarbonic acid diimide derivative of the illustrated compound No. 37 for use in Example 121 is changed to the respective compounds shown in Table 25 below. The image bearing members No. 122 to 124 of Examples 122 to 124 are arranged for installation and evaluated in the same manner as in Example 98. The evaluation results of Examples 122 to 124 are shown in Table 25 below.

TABLE 25

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 121 | 121 | 37 | 55 | 5 | 60 | 5 |
| 122 | 122 | 52 | 50 | 5 | 65 | 5 |
| 123 | 123 | 56 | 60 | 5 | 75 | 5 |
| 124 | 124 | 66 | 55 | 5 | 70 | 5 |

Example 125

The image bearing member No. 125 of Example 125 is manufactured in the same manner as in Example 113 except that the charge transport material No. 37 represented by the Chemical Structure (I) illustrated above for use in Example 113 is changed to the charge transport material No. 4 represented by the Chemical Structure (IV) illustrated above. The image bearing member No. 125 of Example 125 is arranged for installation and evaluated. The evaluation results of Example 125 are shown in Table 26 below.

Examples 126 to 128

The image bearing members Nos. 126 to 128 of Examples 126 to 128 are manufactured in the same manner as in Example 125 except that the naphthalene tetracarbonic acid diimide derivative of the illustrated compound No. 37 for use in Example 125 is changed to the respective compounds shown in Table 26 below. The image bearing members No. 126 to 128 of Examples 126 to 128 are arranged for installation and evaluated in the same manner as in Example 98. The evaluation results of Examples 126 to 128 are shown in Table 26 below.

TABLE 26

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 125 | 125 | 37 | 55 | 5 | 70 | 5 |
| 126 | 126 | 52 | 60 | 5 | 75 | 5 |
| 127 | 127 | 56 | 50 | 5 | 70 | 5 |
| 128 | 128 | 66 | 55 | 5 | 70 | 5 |

Example 129

The image bearing member No. 129 of Example 129 is manufactured in the same manner as in Example 67 except that the liquid application for a charge transport layer is changed to the following:

| | |
|---|---|
| Polycarbonate resin (Panlite TS-2050, Teijin Chemicals Ltd.) | 15 parts |
| Naphthalene tetracarbonic acid diimide derivative of the illustrated compound No. 44 | 9 parts |

The image bearing member No. 129 is evaluated in the same manner as in Example 67. The evaluation results thereof are shown in Table 27.

Example 130

The image bearing member No. 130 of Example 130 is manufactured in the same manner as in Example 82 except that 30 parts of the charge transport material No. 1 represented by the Chemical Structure (I) to 25 parts, 20 parts of the naphthalene tetracarbonic acid diimide derivative of the illustrated compound No. 37 is changed to 15 parts and 50 parts of the polycarbonate resin (Panlite TS-2050, Teijin Chemicals Ltd.) is changed to 60 parts and evaluated in the same manner as in Example 82. The evaluation results of the image bearing member No. 130 are shown in Table 27.

Example 131

The image bearing member No. 131 of Example 131 is manufactured in the same manner as in Example 98 except that the composition of the liquid for a charge transport layer is changed to that for use in Example 129 and evaluated in the same manner as in Example 98. The evaluation results of the image bearing member No. 131 are shown in Table 27.

Example 132

The image bearing member No. 132 of Example 132 is manufactured in the same manner as in Example 113 except that the composition of the liquid for a photosensitive layer is changed to that for use in Example 130 and evaluated in the same manner as in Example 113. The evaluation results of the image bearing member No. 132 are shown in Table 27.

TABLE 27

| | | | Initial stage | | After 80,000 prints | |
|---|---|---|---|---|---|---|
| Examples No. | Image bearing No. | Illustrated derivative No. | Voltage at light portion (V) | Dot definition | Voltage at light portion (V) | Dot definition |
| 129 | 129 | 44 | 50 | 5 | 60 | 5 |
| 130 | 130 | 37 | 45 | 5 | 60 | 5 |
| 131 | 131 | 44 | 55 | 5 | 60 | 5 |
| 132 | 132 | 37 | 50 | 5 | 65 | 5 |

Comparative Example 11

The comparative image bearing member No. 11 of Comparative Example 11 is manufactured in the same manner as in Example 67 except that the naphthalene tetracarbonic acid diimide derivative of the illustrated compound No. 44 for use in Example 67 is changed to the comparative compound No. 1 represented by the following Chemical Structure (V) and evaluated in the same manner as in Example 67.

Chemical Structure (V)

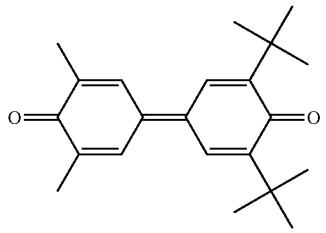

The evaluation results of the comparative image bearing member No. 11 are shown in Table 28 below.

Comparative Example 12

The comparative image bearing member No. 12 of Comparative Examples 12 is manufactured in the same manner as in Example 67 except that the naphthalene tetracarbonic acid diimide derivative of the illustrated compound No. 44 for use in Example 67 is changed to the comparative compound No. 2 represented by the following Chemical Structure (VI) and evaluated in the same manner as in Example 67.

Chemical Structure (VI)

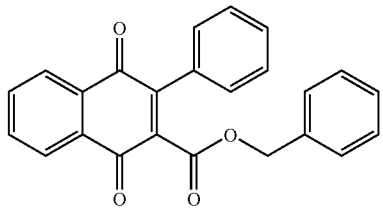

The evaluation results of the comparative image bearing member No. 12 are shown in Table 28 below.

Comparative Example 13

The comparative image bearing member No. 13 of Comparative Examples 13 is manufactured in the same manner as in Example 82 except that the naphthalene tetracarbonic acid diimide derivative of the illustrated compound No. 37 for use in Example 82 is changed to the comparative compound No. 3 represented by the following Chemical Structure (VII) and evaluated in the same manner as in Example 82.

Chemical Structure (VII)

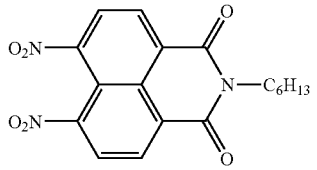

The evaluation results of the comparative image bearing member No. 13 are shown in Table 28 below.

Comparative Example 14

The comparative image bearing member No. 14 of Comparative Examples 14 is manufactured in the same manner as in Example 82 except that the naphthalene tetracarbonic acid diimide derivative of the illustrated compound No. 37 for use in Example 82 is changed to the comparative compound No. 4 represented by the following Chemical Structure (VIII) and evaluated in the same manner as in Example 82.

Chemical Structure (VIII)

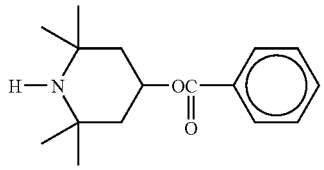

The evaluation results of the comparative image bearing member No. 14 are shown in Table 28 below.

Comparative Example 15

The comparative image bearing member No. 15 of Comparative Examples 15 is manufactured in the same manner as in Example 82 except that the naphthalene tetracarbonic acid diimide derivative of the illustrated compound No. 37 for use in Example 82 is changed to the comparative compound No. 5 represented by the following Chemical Structure (IX) and evaluated in the same manner as in Example 82.

Chemical Structure (IX)

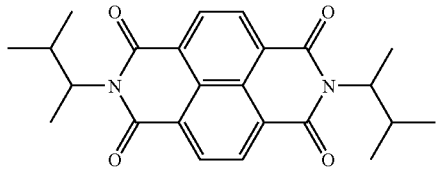

The evaluation results of the comparative image bearing member No. 15 are shown in Table 28 below.

Comparative Example 16

The comparative image bearing member No. 16 of Comparative Examples 16 is manufactured in the same manner as in Example 98 except that the naphthalene tetracarbonic acid diimide derivative of the illustrated compound No. 44 for use in Example 98 is changed to the comparative compound No. 1 represented by the Chemical Structure (V) illustrated above and evaluated in the same manner as in Example 98. The evaluation results of the comparative image bearing member No. 16 are shown in Table 28 below.

Comparative Example 17

The comparative image bearing member No. 17 of Comparative Examples 17 is manufactured in the same manner as in Example 98 except that the naphthalene tetracarbonic acid diimide derivative of the illustrated compound No. 44 for use in Example 98 is changed to the comparative compound No. 2 represented by the Chemical Structure (VI) illustrated above and evaluated in the same manner as in Example 98. The evaluation results of the comparative image bearing member No. 17 are shown in Table 28 below.

Comparative Example 18

The comparative image bearing member No. 18 of Comparative Examples 18 is manufactured in the same manner as in Example 113 except that the naphthalene tetracarbonic acid diimide derivative of the illustrated compound No. 37 for use in Example 113 is changed to the comparative compound No. 3 represented by the Chemical Structure (VII) illustrated above and evaluated in the same manner as in Example 113. The evaluation results of the comparative image bearing member No. 18 are shown in Table 28 below.

Comparative Example 19

The comparative image bearing member No. 19 of Comparative Examples 19 is manufactured in the same manner as in Example 113 except that the naphthalene tetracarbonic acid diimide derivative of the illustrated compound No. 37 for use in Example 113 is changed to the comparative compound No. 4 represented by the Chemical Structure (VIII) illustrated above and evaluated in the same manner as in Example 113. The evaluation results of the comparative image bearing member No. 19 are shown in Table 28 below.

Comparative Example 20

The comparative image bearing member No. 20 of Comparative Examples 20 is manufactured in the same manner as in Example 113 except that the naphthalene tetracarbonic acid diimide derivative of the illustrated compound No. 37 for use in Example 113 is changed to the comparative compound No. 5 represented by the Chemical Structure (IX) illustrated above and evaluated in the same manner as in Example 113. The evaluation results of the comparative image bearing member No. 20 are shown in Table 28 below.

TABLE 28

| | | Initial stage | | After 80,000 prints | |
|---|---|---|---|---|---|
| Comparative Example No. | Comparative Image bearing No. | Voltage at light portion (V) | Dot definition | Voltage at light portion (V) | Dot definition |
| Comparative Example 11 | Comparative Image bearing No. 11 | 190 | 2 | 440 | 1 |

TABLE 28-continued

| Comparative Example No. | Comparative Image bearing No. | Initial stage: Voltage at light portion (V) | Initial stage: Dot definition | After 80,000 prints: Voltage at light portion (V) | After 80,000 prints: Dot definition |
|---|---|---|---|---|---|
| Comparative Example 12 | Comparative Image bearing No. 12 | 100 | 3 | 355 | 1 |
| Comparative. Example 13 | Comparative Image bearing No. 13 | 200 | 4 | 285 | 1 |
| Comparative Example 14 | Comparative Image bearing No. 14 | 250 | 2 | 480 | 1 |
| Comparative Example 15 | Comparative Image bearing No. 15 | 55 | 5 | 75 | 2 |
| Comparative Example 16 | Comparative Image bearing No. 16 | 80 | 3 | 155 | 1 |
| Comparative Example 17 | Comparative Image bearing No. 17 | 100 | 3 | 440 | 2 |
| Comparative. Example 18 | Comparative. Image bearing No. 18 | 105 | 4 | 345 | 1 |
| Comparative Example 19 | Comparative Image bearing No. 19 | 80 | 4 | 265 | 1 |
| Comparative Example 20 | Comparative Image bearing No. 20 | 60 | 5 | 80 | 2 |

As seen in the evaluation results shown in Tables 3 to 28, an image forming apparatus (full color) using an image bearing member containing the naphthalene tetracarbonic acid diimide derivative for use in the present invention (Examples) is confirmed to stably produce quality images after the continuous running test in which corresponding to 80,000 prints are output in a repetitive manner as well as at the initial stage in comparison with Comparative Examples.

That is, the image bearing member for use in the image forming apparatus of the present invention has a high durability and an image forming apparatus (full color) using the image bearing member stably forms quality full color images without production of abnormal images over repetitive use.

This document claims priority and contains subject matter related to Japanese Patent Applications Nos. 2008-003897, 2008-240762, 2008-240769 and 2008-007489, filed on Jan. 11, 2008, Sep. 19, 2008, Sep. 19, 2008 and Jan. 17, 2008, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member comprising a substrate having a photosensitive layer thereon, the image bearing member configured to bear a latent electrostatic image on a surface thereof;

a charging device configured to charge the surface of the image bearing member;

an irradiation device configured to irradiate the surface of the image bearing member with light to form a latent electrostatic image thereon;

a development device configured to develop the latent electrostatic image with toner to obtain a developed image;

a transfer device configured to transfer the developed image to a recording medium; and a cleaning device configured to clean the surface of the image bearing member, wherein the photosensitive layer comprises naphthalene tetracarbonic acid diimide derivative as a charge transport material represented by a following Chemical Structure (1):

Chemical Structure (1)

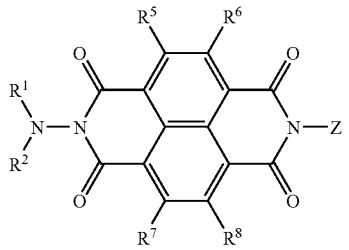

where Z represents a group represented by a following Chemical Formula (2):

$$-R^9$$

Chemical Formula (2)

where $R^1$, $R^2$, and $R^9$ each, independently, represent a substituted or non-substituted alkyl group or a substituted or non-substituted aromatic hydrocarbon group, and $R^5$, $R^6$, $R^7$ and $R^8$ each, independently, represent a hydrogen atom, a substituted or non-substituted alkyl group, or a substituted or non-substituted aromatic hydrocarbon group.

2. The image forming apparatus according to claim 1, wherein the photosensitive layer further comprises a charge transport material different from the naphthalene tetracarbonic acid diimide derivative.

3. The image forming apparatus according to claim 2, wherein the charge transport material different from the naphthalene tetracarbonic acid diimide derivative is a derivative represented by a following Chemical Structure (2):

Chemical Structure (2)

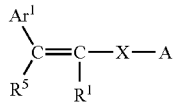

where X represents a single bond or vinylene group, $R^1$ represents a hydrogen atom, a substituted or non-substituted alkyl group or a substituted or non-substituted aromatic hydrocarbon group, $Ar^1$ represents a substituted or non-substituted aromatic hydrocarbon group, $R^5$ represents hydrocarbon atom, a substituted or non-substituted alkyl group or a substituted or non-substituted aromatic hydrocarbon group, $Ar^1$ and $R^5$ optionally share a bond connectivity to form a ring, A represents 9-anthryl group, a substituted or non-substituted carbazolyl group, or a group represented by a following Chemical Structure (3) or a following Chemical Structure (4), Chemical Structure (3)

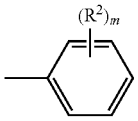

Chemical Structure (4)

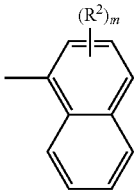

where $R^2$ represents a hydrogen atom, an alkyl group, an alkoxy group, or a group represented by a following Chemical Structure (5), Chemical Structure (5)

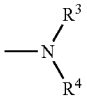

where $R^3$ and $R^4$ each, independently, represent a hydrogen atom, a substituted or non-substituted alkyl group or a substituted or non-substituted aromatic hydrocarbon group and optionally share a bond connectivity to form a heterocyclic group including a nitrogen atom, m represents an integer of from 1 to 3 and when m is 2 or 3, each of $R^2$ is independently determined.

4. The image forming apparatus according to claim 2, wherein the charge transport material different from the naphthalene tetracarbonic acid diimide derivative is a derivative represented by a following Chemical Structure (6):

Chemical Structure (6)

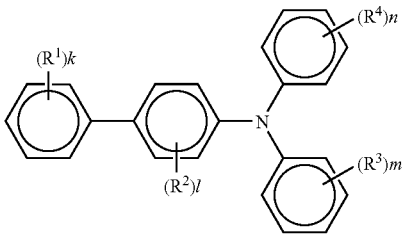

where $R^1$, $R^3$, $R^4$ are each, independently, a hydrogen atom, an amino group, an alkoxy group, a thioalkoxy group, an aryloxy group, methylene dioxy group, a substituted or non-substituted alkyl group, a halogen atom or a substituted or non-substituted aromatic hydrocarbon group, $R^2$ represents a hydrogen atom, an alkoxy group, a substituted or non-substituted alkyl group, or a halogen atom, k, l, m and n each, independently, represent an integer of from 1 to 4 and when k, l, m and n each, independently, represent 2, 3 or 4, each of respective $R^1$, $R^2$, $R^3$ and $R^4$ is independently determined.

5. The image forming apparatus according to claim 2, wherein the charge transport material different from the naphthalene tetracarbonic acid diimide derivative is a derivative represented by a following Chemical Structure (7):

Chemical Structure (7)

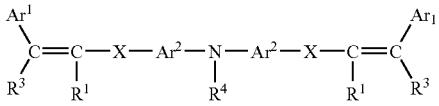

where X represents a single bond or vinylene group, $R^1$ represents a hydrogen atom, a substituted or non-substituted alkyl group, or a substituted or non-substituted aromatic hydrocarbon group, $Ar^1$ represents a substituted or non-substituted aromatic hydrocarbon group, $R^3$ represents a hydrogen atom, a substituted or non-substituted alkyl group, or a substituted or non-substituted aromatic hydrocarbon group, $Ar^1$ and $R^3$ optionally share a bond connectivity to form a ring and $Ar^2$ represents a group represented by a following Chemical Structure (8)

Chemical Structure (8)

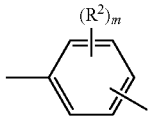

or a following Chemical Structure (9),

Chemical Structure (9)

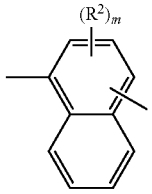

where $R^2$ represents a hydrogen atom, an alkyl group, an alkoxy group, or a halogen atom, m represents an integer of from 1 to 3, when m is 2 or 3, each of $R^2$ is independently determined and $R^4$ represents a substituted or non-substituted alkyl group or a substituted or non-substituted aromatic hydrocarbon group.

6. The image forming apparatus according to claim 2, wherein the charge transport material different from the naphthalene tetracarbonic acid diimide derivative is a derivative represented by a following Chemical Structure (10):

Chemical Structure (10)

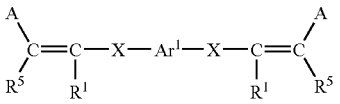

where X represents a single bond or vinylene group, $R^1$ represents a hydrogen atom, a substituted or non-substituted alkyl group or a substituted or non-substituted aromatic hydrocarbon group, $Ar^1$ represents a substituted or non-substituted aromatic hydrocarbon group, $R^5$ represents a hydrocarbon atom, a substituted or non-substituted alkyl group or a substituted or non-substituted aromatic hydrocarbon group, A represents 9-anthryl group, a substituted or non-substituted carbazolyl group, or a group represented by a following Chemical Structure (3) or a following Chemical Structure (4), Chemical Structure (3)

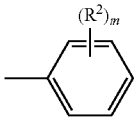

Chemical Structure (4)

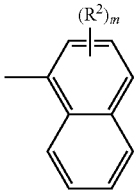

where $R^2$ represents a hydrogen atom, an alkyl group, an alkoxy group, a halogen atom or a group represented by a following Chemical Structure (5), Chemical Structure (5)

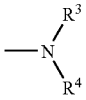

where $R^3$ and $R^4$ each, independently, represent a hydrogen atom, a substituted or non-substituted alkyl group or a substituted or non-substituted aromatic hydrocarbon group and optionally share a bond connectivity to form a heterocyclic group including a nitrogen atom, m represents an integer of from 1 to 3 and when m is 2 or 3, each of $R^2$ is independently determined.

7. The image forming apparatus according to claim 1, wherein the photosensitive layer has a laminate structure comprising a charge generation layer comprising a charge generation material and a charge transport layer comprising the naphthalene tetracarbonic acid diimide derivative.

8. The image forming apparatus according to claim 7, wherein the charge transport layer further comprises a charge transport material different from the naphthalene tetracarbonic acid diimide derivative and represented by a following Chemical Structure (2), Chemical Structure (2)

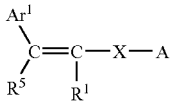

where X represents a single bond or vinylene group, $R^1$ represents a hydrogen atom, a substituted or non-substituted alkyl group or a substituted or non-substituted aromatic hydrocarbon group, $Ar^1$ represents a substituted or non-substituted aromatic hydrocarbon group, $R^5$ represents hydrocarbon atom, a substituted or non-substituted alkyl group or a substituted or non-substituted aromatic hydrocarbon group, $Ar^1$ and $R^5$ optionally share a bond connectivity to form a ring, A represents 9-anthryl group, a substituted or non-substituted carbazolyl group, or a group represented by a following Chemical Structure (3) or a following Chemical Structure (4), Chemical Structure (3)

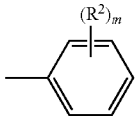

Chemical Structure (4)

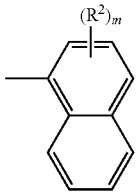

where $R^2$ represents a hydrogen atom, an alkyl group, an alkoxy group, or a group represented by a following Chemical Structure (5), Chemical Structure (5)

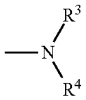

where $R^3$ and $R^4$ each, independently, represent a hydrogen atom, a substituted or non-substituted alkyl group or a substituted or non-substituted aromatic hydrocarbon group and optionally share a bond connectivity to form a heterocyclic group including a nitrogen atom, m represents an integer of from 1 to 3 and when m is 2 or 3, each of $R^2$ is independently determined, and wherein a total weight of the binder resin is greater than a total weight of the naphthalene tetracarbonic acid diimide derivative and the charge transport material different from the naphthalene tetracarbonic acid diimide derivative.

9. The image forming apparatus according to claim 1, wherein the photosensitive layer has a single layer structure comprising a charge generation material and the naphthalene tetracarbonic acid diimide derivative.

10. The image forming apparatus according to claim 9, wherein the photosensitive layer further comprises a charge-transport material different from the naphthalene tetracarbonic acid diimide derivative optionally and a binder resin, and wherein a total weight of the binder resin is greater than a total weight of the naphthalene tetracarbonic acid diimide derivative and the charge transport material different from the naphthalene tetracarbonic acid diimide derivative.

11. The image forming apparatus according to claim 1, wherein the transfer device comprises an intermediate transfer device to which the developed images are primarily and sequentially transferred to form a color image and the color image is secondarily transferred to the recording medium at one time.

12. A process cartridge comprising:

an image bearing member comprising a substrate having a photosensitive layer thereon, the image bearing member configured to bear a latent electrostatic image on a surface thereof; and at least one device selected from the group consisting of a charging device configured to charge the surface of the image bearing member, a development device configured to develop the latent electrostatic image with toner to obtain a developed image, a cleaning device configured to clean the surface of the image bearing member, and a discharging device configured to discharge the surface of the image bearing member, wherein the photosensitive layer comprises naphthalene tetracarbonic acid diimide derivative as a charge transport material represented by a following Chemical Structure (1)

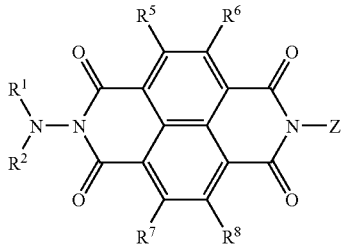

where Z represents a group represented by a following Chemical Formula (2), $$-R^9$$ Chemical Formula (2)

where $R^1$, $R^2$, and $R^9$ each, independently, represent a substituted or non-substituted alkyl group or a substituted or non-substituted aromatic hydrocarbon group, and $R^5$, $R^6$, $R^7$ and $R^8$ each, independently, represent hydrogen atom, a substituted or non-substituted alkyl group, or a substituted or non-substituted aromatic hydrocarbon group and wherein the image bearing member and the at least one device integrally form the process cartridge and the process cartridge is detachably attached to an image forming apparatus.

* * * * *